US010641239B2

(12) United States Patent
Wong

(10) Patent No.: US 10,641,239 B2
(45) Date of Patent: May 5, 2020

(54) PNEUMATIC ENGINE AND RELATED METHODS

(71) Applicant: Sunnyco Inc., Markham (CA)

(72) Inventor: Bun Wong, Toronto (CA)

(73) Assignee: SUNNYCO INC., Markham (CA)

( * ) Notice: Subject to any disclaimer, the term of this patent is extended or adjusted under 35 U.S.C. 154(b) by 148 days.

(21) Appl. No.: 15/648,790

(22) Filed: Jul. 13, 2017

(65) Prior Publication Data

US 2018/0266385 A1 Sep. 20, 2018

Related U.S. Application Data

(63) Continuation-in-part of application No. 15/460,427, filed on Mar. 16, 2017, now Pat. No. 10,465,518.

(60) Provisional application No. 62/333,396, filed on May 9, 2016.

(51) Int. Cl.

| | |
|---|---|
| ***F03C 2/30*** | (2006.01) |
| ***F01C 1/344*** | (2006.01) |
| ***F01C 20/04*** | (2006.01) |
| ***F01C 11/00*** | (2006.01) |
| ***F01C 20/24*** | (2006.01) |

(52) U.S. Cl.

CPC ..... *F03C 2/304* (2013.01); *F01C 1/344* (2013.01); *F01C 1/3442* (2013.01); *F01C 11/002* (2013.01); *F01C 20/04* (2013.01); *F01C 20/24* (2013.01)

(58) Field of Classification Search

CPC . F15B 2211/7107; F01C 1/344; F01C 1/3446
USPC ..... 60/424
See application file for complete search history.

(56) References Cited

U.S. PATENT DOCUMENTS

| | | | | |
|---|---|---|---|---|
| 1,358,954 A | | 11/1920 | Holström | |
| 2,966,776 A | | 1/1961 | Taga | |
| 3,442,344 A | * | 5/1969 | Ocule | B60K 17/10 180/6.3 |
| 4,025,224 A | | 5/1977 | Starbard | |

(Continued)

FOREIGN PATENT DOCUMENTS

| | | |
|---|---|---|
| CN | 201521347 U | 7/2010 |
| DE | 102008058891 B4 | 6/2010 |

(Continued)

OTHER PUBLICATIONS

International Search Report and Written Opinion of corresponding PCT Application No. PCT/CA2017/050924.

*Primary Examiner* — Thomas E Lazo
*Assistant Examiner* — Matthew Wiblin
(74) *Attorney, Agent, or Firm* — Bereskin & Parr LLP/S.E.N.C.R.L., s.r.l.

(57) ABSTRACT

A pneumatic engine includes first and second pneumatic motors. Each motor has a stator, a rotor, and a gas flow path. The rotor is rotatably connected to the stator. The gas flow path is defined at least in part by the stator and the rotor, and extends from a gas inlet to a terminal gas outlet. The gas flow path has an expansion portion extending between the gas inlet and an intermediate gas outlet, and a compression portion extending between the intermediate gas outlet and the terminal gas outlet. The terminal gas outlet of the first pneumatic motor is fluidly connected upstream of the gas inlet of the second pneumatic motor.

7 Claims, 44 Drawing Sheets

(56) References Cited

U.S. PATENT DOCUMENTS

| | | | | |
|---|---|---|---|---|
| 4,276,896 | A * | 7/1981 | Hunck | B62D 11/183 137/101 |
| 4,522,269 | A * | 6/1985 | Adman | B25B 21/008 173/1 |
| 4,557,674 | A | 12/1985 | Arnett | |
| 4,622,503 | A | 11/1986 | Sundblom et al. | |
| 4,766,787 | A * | 8/1988 | Sugimoto | B25B 21/02 173/93.5 |
| 4,822,264 | A | 4/1989 | Kettner | |
| 5,043,617 | A | 8/1991 | Rostron | |
| 5,708,306 | A | 1/1998 | Lin | |
| 5,954,144 | A | 9/1999 | Thames | |
| 7,117,839 | B2 | 10/2006 | Horstin | |
| 7,753,036 | B2 | 7/2010 | Lents et al. | |
| 8,839,620 | B2 * | 9/2014 | Teng | F01C 1/3446 418/173 |
| 2009/0048747 | A1 * | 2/2009 | Stridsberg | B60K 6/387 701/55 |
| 2011/0067391 | A1 * | 3/2011 | Harms | E01H 10/007 60/420 |
| 2013/0055884 | A1 | 3/2013 | Feng | |
| 2013/0180237 | A1 * | 7/2013 | Recoura | F04B 1/047 60/484 |
| 2014/0119967 | A1 * | 5/2014 | Feustel | F04C 2/082 418/1 |
| 2014/0224207 | A1 | 8/2014 | Thomassin et al. | |
| 2014/0349808 | A1 * | 11/2014 | Huang | B60L 58/40 477/3 |
| 2015/0082791 | A1 * | 3/2015 | Riley | F01K 7/165 60/641.15 |
| 2015/0233286 | A1 | 8/2015 | Julien | |
| 2016/0258291 | A1 | 9/2016 | Griffin | |
| 2017/0321554 | A1 | 11/2017 | Wong | |

FOREIGN PATENT DOCUMENTS

| | | | |
|---|---|---|---|
| GB | 999459 | A | 7/1965 |
| GB | 2071767 | B | 9/1981 |
| WO | 2016032737 | A1 | 3/2016 |

* cited by examiner

PNEUMATIC ENGINE AND RELATED METHODS

FIELD

This disclosure relates to the field of pneumatic engines and related methods.

INTRODUCTION

A pneumatic motor is a device that converts energy from a flow of gaseous fluid ("gas") to mechanical power. Known pneumatic motors include rotary vane, axial piston, radial piston, gerotor, screw type, and turbine type pneumatic motors.

SUMMARY

In one aspect, a pneumatic engine is provided. The pneumatic engine may include a plurality of pneumatic motors and an engine drive shaft. Each motor may have a motor gas inlet, a motor gas outlet, and a rotor driven by gas flow between the motor gas inlet and the motor gas outlet. The engine drive shaft may be drivingly coupled to the motor drive shaft of each of the pneumatic motors.

In another aspect, a pneumatic engine is provided. The pneumatic engine may include first and second pneumatic motors. Each pneumatic motor has a stator, a rotor, and a gas flow path. The rotor may be rotatably connected to the stator. The gas flow path may be defined at least in part by the stator and the rotor. The gas flow path extends from a gas inlet to a terminal gas outlet. The gas flow path may have an expansion portion extending between the gas inlet and an intermediate gas outlet, and a compression portion extending between the intermediate gas outlet and the terminal gas outlet. The terminal gas outlet of the first pneumatic motor may be fluidly connected to the gas inlet of the second pneumatic motor.

In another aspect, a pneumatic engine is provided. The pneumatic engine may include first and second pneumatic motors, a gas flow path, and a first gas valve. Each pneumatic motor has a gas inlet and a gas outlet. The gas flow path may extend through both of the first and second pneumatic motors. The first gas valve may be movable between a first position and a second position to reconfigure flow through the first and second pneumatic motors in the gas flow path. In the first position, the first and second pneumatic motors may be fluidly connected in parallel. In the second position, the first and second pneumatic motors may be fluidly connected in series.

In another aspect, a pneumatic motor is provided. The pneumatic motor may include a stator, a rotor rotatably connected to the stator, and a plurality of gas flow paths defined by the stator and the rotor, each gas flow path extending from a respective gas inlet to a respective terminal gas outlet.

DRAWINGS

DESCRIPTION OF VARIOUS EMBODIMENTS

Figure 1:
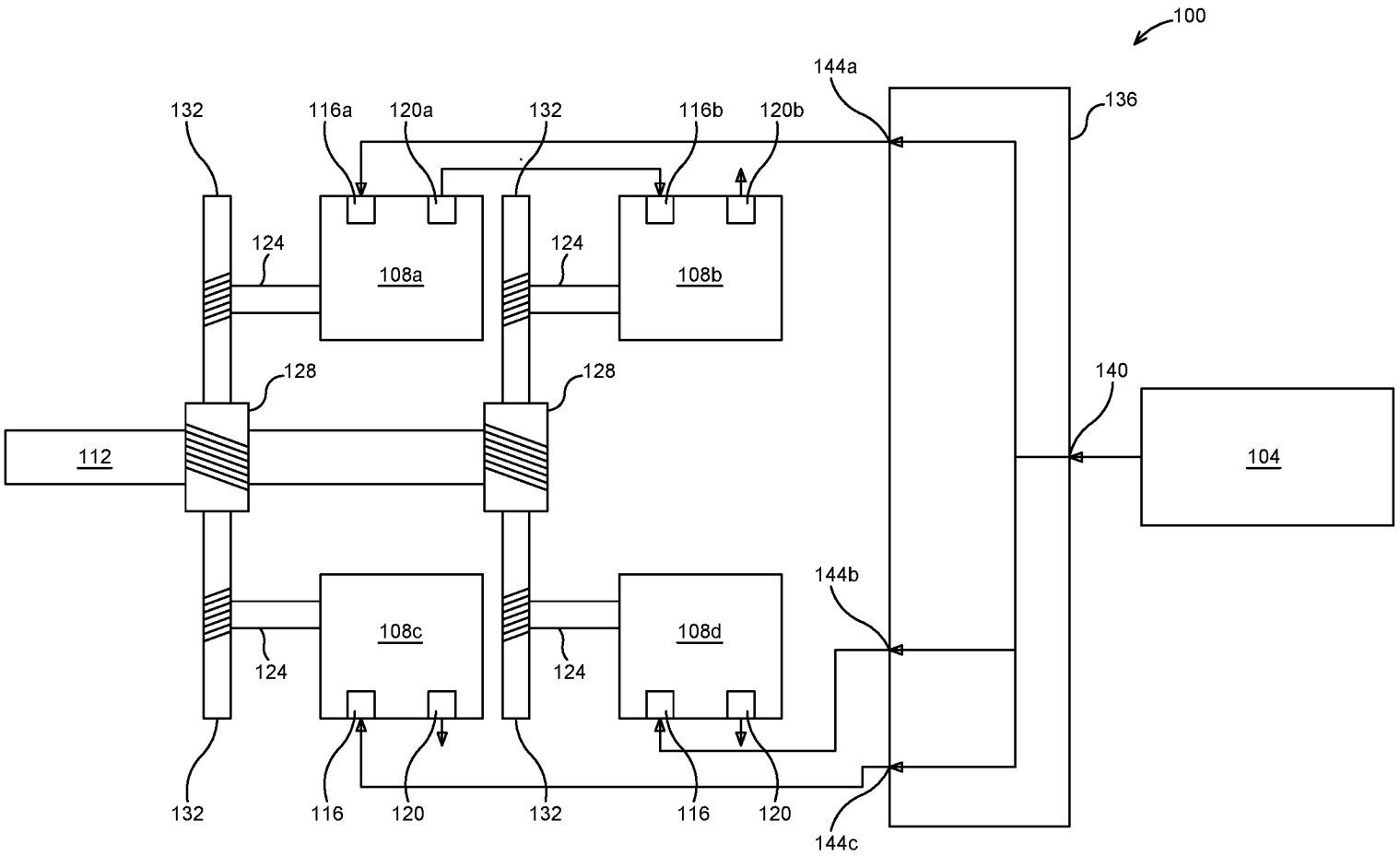
FIG. 1 is a schematic illustration of a pneumatic engine in accordance with at least one embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein and in the claims, a first element is said to be "received" in a second element where at least a portion of the first element is received in the second element unless specifically stated otherwise.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

As used herein and in the claims, two components are said to be "fluidly connected" or "fluidly coupled" where the two components are positioned along a common fluid flow path. The fluid connection may be formed in any manner that can transfer fluids between the two components, such as by a fluid conduit which may be formed as a pipe, hose, channel, or bored passageway for example. One or more other components can be positioned between the two fluidly coupled components. Two components described as being "downstream" or "upstream" of one another, are by implication fluidly connected.

As used herein and in the claims, two components are said to be "communicatively coupled" where at least one of the components is capable of communicating signals (e.g. electrical signals) to the other component, such as across a wired connection (e.g. copper wire cable), or a wireless connection (e.g. radio frequency).

FIG. 1 shows a schematic illustration of a pneumatic engine 100 connected to a gas source 104 in accordance with at least one embodiment. As used herein and in the claims, a "pneumatic" device is a device that is operated by gaseous fluid, such as pressurized air or steam. For example, a pneumatic motor is a device that converts energy from an input gas flow to a mechanical output.

As shown, pneumatic engine 100 includes a plurality of pneumatic motors 108 and an engine drive shaft 112. Pneumatic motors 108 are drivingly coupled to engine drive shaft 112 to provide the motive force for rotating engine drive shaft 112. Each pneumatic motor 108 is fluidly connected to gas source 104. Gas source 104 provides a flow of pressurized gas (e.g. air or steam) to pneumatic motors 108, which pneumatic motors 108 utilize to produce mechanical output (e.g. rotation or reciprocation).

The plurality of pneumatic motors 108 can collectively provide greater output power to engine drive shaft 112 than any one of pneumatic motors 108 can provide alone. To provide engine drive shaft 112 with power equivalent to the plurality of pneumatic motors 108 collectively with a single pneumatic motor would therefore require a much larger pneumatic motor. However, in some cases, a large pneumatic motor can be more expensive than a plurality of smaller pneumatic motors which can collectively provide equivalent output power. Further, a pneumatic engine including a single large pneumatic motor will become disabled if the pneumatic motor fails. In contrast, some embodiments of pneumatic engine 100 allow engine 100 to remain operation in the event that a subset of the pneumatic motors 108 fails. Further, the failed pneumatic motor(s) 108 can be replaced to restore pneumatic engine 100 to full power. Also, a single large pneumatic motor is often incapable of operating at the high speeds available from smaller pneumatic motors, unless a gear box or similar is employed.

Pneumatic motors 108 can be any device that converts the energy of a pressurized flow of gaseous fluid ("gas") to mechanical power. Examples of pneumatic motors 108 include rotary vane, axial piston, radial piston, gerotor, screw type, and turbine type pneumatic motors. As shown, each pneumatic motor 108 may include a motor gas inlet 116, a motor gas outlet 120, and a motor rotor 124 driven to rotate by gas flow between the motor gas inlet 116 and motor gas outlet 120. Pneumatic engine 100 can include any number of pneumatic motors 108 greater than 1. For example, pneumatic engine 100 may include from 2-100 pneumatic motors 108 or more depending on the application. In the illustrated example, pneumatic engine 100 includes four pneumatic motors 108.

In the illustrated embodiment, motor rotor 124 of each pneumatic motor 108 is mechanically connected to engine drive shaft 112 in any manner that allows the transmission of power developed in the pneumatic motor 108 to the engine drive shaft 112. For example, a motor rotor 124 may be drivingly connected to engine drive shaft 112 by one or more of gears, belts, or chains for example. In the illustrated example, a drive gear 128 is connected to engine drive shaft 112, and each motor rotor 124 is connected to a rotor gear 132 engaged with the drive gear 128. This allows for transmission of mechanical power from each motor rotor 124 to the engine drive shaft 112 across gears 128 and 132.

All of pneumatic motors 108 in pneumatic engine 100 may be substantially identical. This can allow for convenient repair or replacement of pneumatic motors 108. For example, only a small inventory of parts or replacement motors may be required to maintain pneumatic engine 100. In other embodiments, one or more (or all) of pneumatic motors 108 may differ in size, type, and/or rotor-to-drive shaft connectivity than one or more (or all) of the other pneumatic motors 108 in pneumatic engine 100. This can provide pneumatic engine 100 with enhanced operational modes whereby selected pneumatic motor(s) 108 may be activated (and the other deactivated) to accommodate a particular use-case (e.g. torque or RPM requirement).

Still referring to FIG. 1, pneumatic engine 100 is shown including an inlet manifold 136. Inlet manifold 136 includes a manifold gas inlet 140 and a plurality of manifold gas outlets 144. Manifold gas inlet 140 is connected to a gas source 104, and each manifold gas outlet 144 is fluidly connected downstream to manifold gas inlet 140. As shown, each manifold gas outlet 144 is fluidly connected to at least one of pneumatic motors 108. Each motor gas inlet 116 is positioned downstream of a manifold gas outlet 144 for receiving gas flow from the gas source 104.

In some embodiments, a manifold gas outlet 144 may be fluidly connected to a single pneumatic motor 108. For example, manifold gas outlet 144*b* feeds gas flow to a single pneumatic motor 108*d*. As shown, manifold gas outlet 144*b* is positioned upstream of motor gas inlet 116*d*.

In some embodiments, a manifold gas outlet 144 may be fluidly connected to a plurality of pneumatic motors 108. For example, the plurality of pneumatic motors 108 may be fluidly arranged in parallel or in series relative to the manifold gas outlet 144. In the illustrated example, manifold gas outlet 144*a* feeds gas flow to pneumatic motors 108*a* and 108*b* which are arranged in series. As shown, motor gas inlet 116*b* is fluidly connected downstream of motor gas outlet 120*a*. Fluidly connecting pneumatic motors 108 in series, as shown by example with pneumatic motors 108*a* and 108*b*, allows the downstream pneumatic motor 108 to capture energy remaining in the gas flow exhausted from the motor gas outlet 120 of the upstream pneumatic motor 108. This may allow pneumatic engine 100 to achieve greater efficiency in the conversion of gas flow energy to mechanical power. In turn, this may allow a smaller pneumatic engine 100 to provide the same or greater mechanical power output than a larger pneumatic engine (without pneumatic motors 108 fluidly arranged in series) from the same gas source 104. By the same logic, this may allow pneumatic engine 100 to obtain greater mechanical power output than the same sized pneumatic engine (without pneumatic motors 108 fluidly arranged in series) from the same gas source 104. Still, some embodiments of pneumatic engine 100 do not include any pneumatic motors 108 fluidly arranged in series.

Pneumatic engine 100 may be fluidly connectable (e.g. by a fluid conduit such as a hose, pipe, or tube) to any gas source 104 that can supply pressurized gas (i.e. gas above ambient pressure) to pneumatic motors 108. For example, gas source 104 may include a pressurized gas cylinder, an air compressor, a steam boiler, or an exhaust gas flow from a power plant or other external process for example. In some embodiments, gas source 104 includes a heat exchanger that transfers heat from an external process (e.g. from exhaust gas) to the gas flow that circulates through pneumatic engine 100. In some examples, gas source 104 provides a flow of gas that is liquid at ambient temperature (e.g. at 20° C.), such as steam (evaporated water) or another evaporated liquid.

Figure 1B:
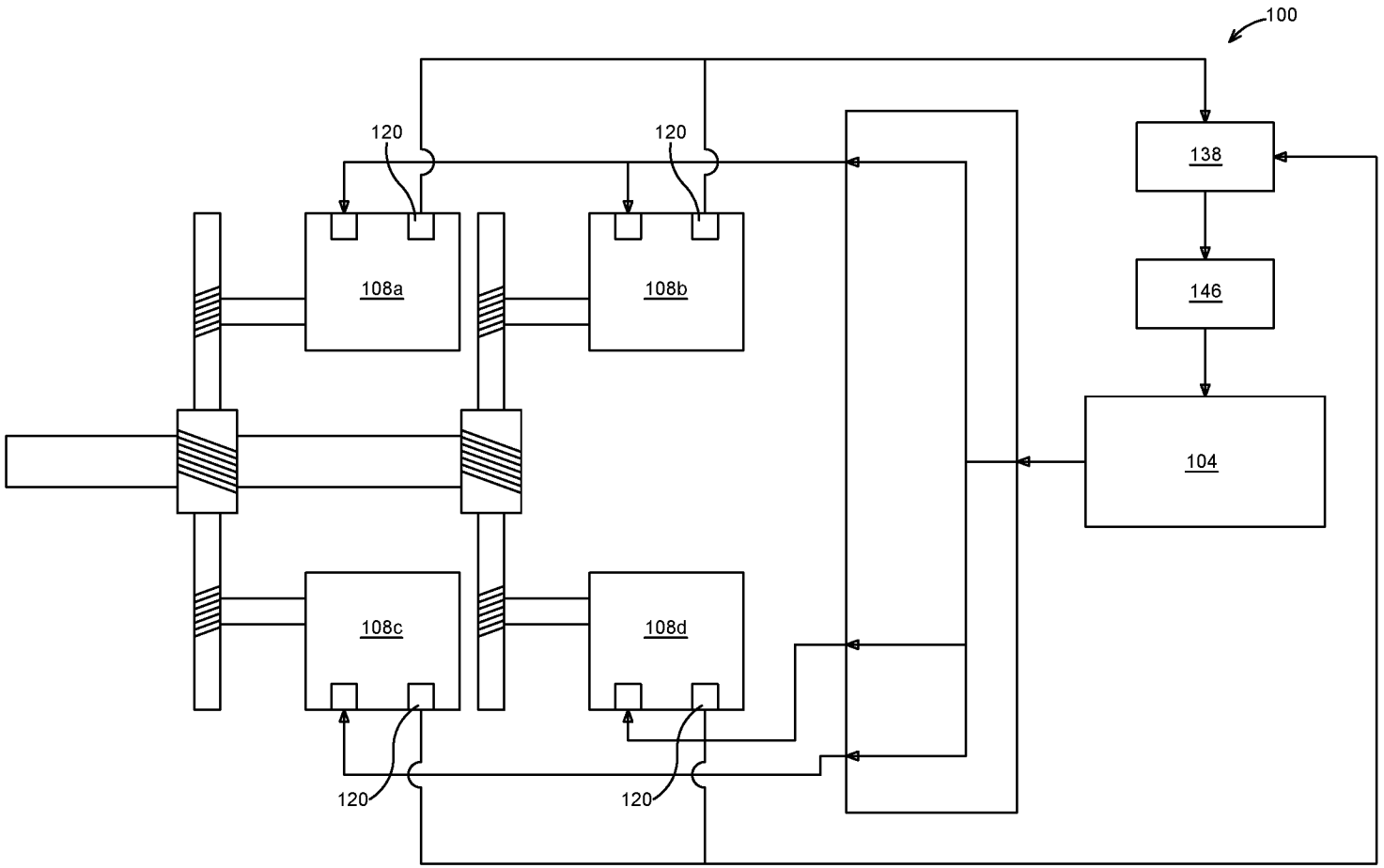
FIG. 1B is a schematic illustration of a pneumatic engine in accordance with at least one embodiment.

In each pneumatic motor 108, a motor gas outlet 120 is positioned downstream of motor gas inlet 116 to exhaust gas flow from the pneumatic motor 108. Motor gas outlets 120 may exhaust gas flow to the ambient environment, or to an inlet of another device (e.g. a downstream pneumatic motor 108 as described above, an outlet manifold, or another gas driven device). FIG. 1B shows an example including motor gas outlets 120 which exhaust gas back to the gas source 104 for recirculation. This can provide pneumatic engine 100 with a closed recirculating gas system with potentially enhanced efficiency. A closed system reduces the consumption of gas, which can be helpful where the gas is produced from a limited supply. For example, whereas air may be substantially unlimited in many environments, evaporated liquids such as steam may be in more limited supply or may be more costly to replenish. In some embodiments, pneumatic engine 100 may include a condenser 138 and a pump 146 positioned in the flow path downstream of motor gas outlets 120 between the motor gas outlets 120 and gas source 104. Condenser 138 receives gas discharged from motor gas outlets 120 and condenses that gas (e.g. steam) to liquid (e.g. water), which condenser 138 discharges to pump 146. Pump 146 pumps the liquid formed by condenser 138 back to gas source 104 (e.g. a boiler) for further gas production (e.g. steam production). Condenser 138 can be any device that can condense a gas flow to a liquid flow. For example, condenser 138 can be a water or air cooled condenser, or another known condenser design. Pump 146 can be any device that can move the fluid produced at condenser 138 to gas source 104. For example, pump 146 may be a centrifugal pump, a peristaltic pump, a positive displacement pump, or another known pump design.

Condenser 138 may operate at a power level that is automatically adjusted based on one or more of engine power demand, engine temperature, and ambient environment temperature. For example, when pneumatic engine 100 operates at high power, there may be greater gas flow discharged to condenser 138 and condenser 138 may operate at a higher power level to condense the gas flow to liquid (and vice versa). In another example, condenser 138 may operate at a higher power level to compensate for high engine temperature or high ambient environment temperature (and vice versa). For example, the gas flow may receive heat from the hot engine or hot ambient environment, and the condenser 138 may operate at a higher power level to remove this heat when condensing the gas flow.

Figure 1C:
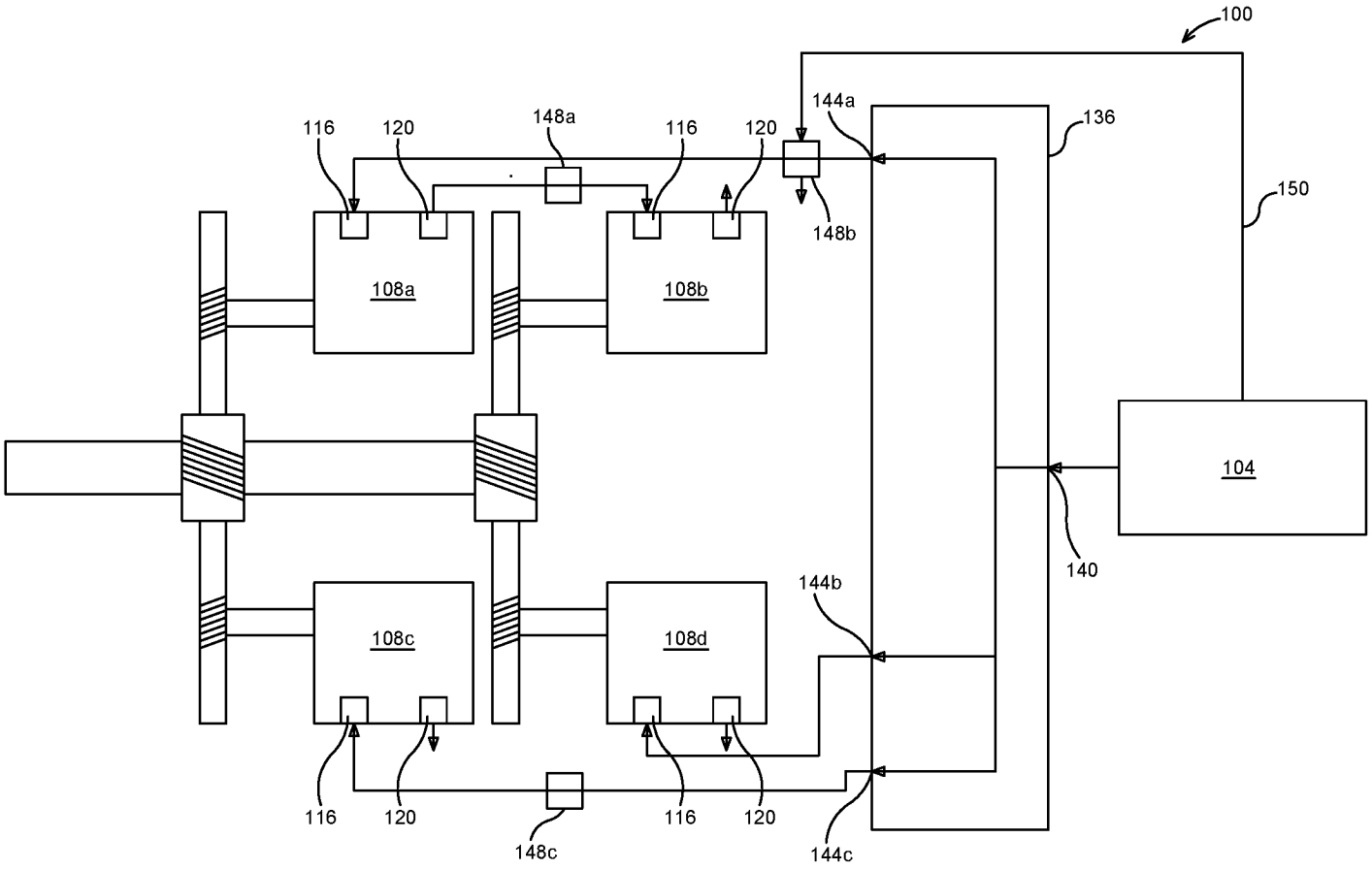
FIG. 1C is a schematic illustration of a pneumatic engine in accordance with at least one embodiment.

Reference is now made to FIG. 1C, which shows a schematic illustration of pneumatic engine 100 having one or more heaters 148. Pneumatic engine 100 can include any number of heaters 148 which may be positioned to heat the gas flow path upstream of one or more pneumatic motors 108. This can help to increase the pressure of the gas flow delivered to those pneumatic motor(s) 108. Maintaining sufficient gas pressure can be important for proper operation of pneumatic motors 108. Maintaining sufficient temperature can also help prevent the gas from condensing to liquid (e.g. in the case of steam) prior to passing through the pneumatic motor 108. In some embodiments, heater 148 can help prevent pneumatic engine 100 from freezing, such as when operating in cold environments.

Heaters 148 can be positioned to heat the gas flow anywhere upstream of one or more pneumatic motors 108. For example, heater 148*a* is positioned to heat the gas flow downstream of pneumatic motor 108*a* and upstream of pneumatic motor 108*b*. Heater 148*b* is shown positioned to heat the gas flow downstream of manifold 136 and upstream of pneumatic motor 108*a*. Similarly, heater 148*c* is shown positioned to heat the gas flow downstream of manifold 136 and upstream of pneumatic motor 108*c*.

A heater 148 can be any device suitable for heating a flow of gas. Heater 148 may include any source of heat, such as electrical heat, flame-derived heat (e.g. from burning fuel), and gas exchanged heat (e.g. heat exchanged between gas flows) for example. In the illustrated embodiment, heater 148*b* is thermally coupled to gas source 104 for transferring heat conducting, radiating, or exhausted from gas source 104 (e.g. a boiler) to the gas flow. For example, heater 148*b* may be in close proximity to gas source 104 to transfer heat radiating from gas source 104 to the gas flow. Alternatively or in addition, heater 148*b* may be in contact with gas source 104 to transfer heat conducting from gas source 104 to the gas flow. Alternatively or in addition, heater 148*b* may be fluidly connected to a flow of hot gas 150 (e.g. hot air) exhausting from gas source 104 to transfer heat from the hot gas 150 to the gas flow upstream of pneumatic motor 108*a*. This can help improve the efficiency of pneumatic engine 100 by recovering heat otherwise expelled to the atmosphere. For example, heater 148*b* may be formed as a gas heat exchanger (e.g. parallel flow, counter-flow, or cross-flow heat type heat exchanger).

Figure 2:
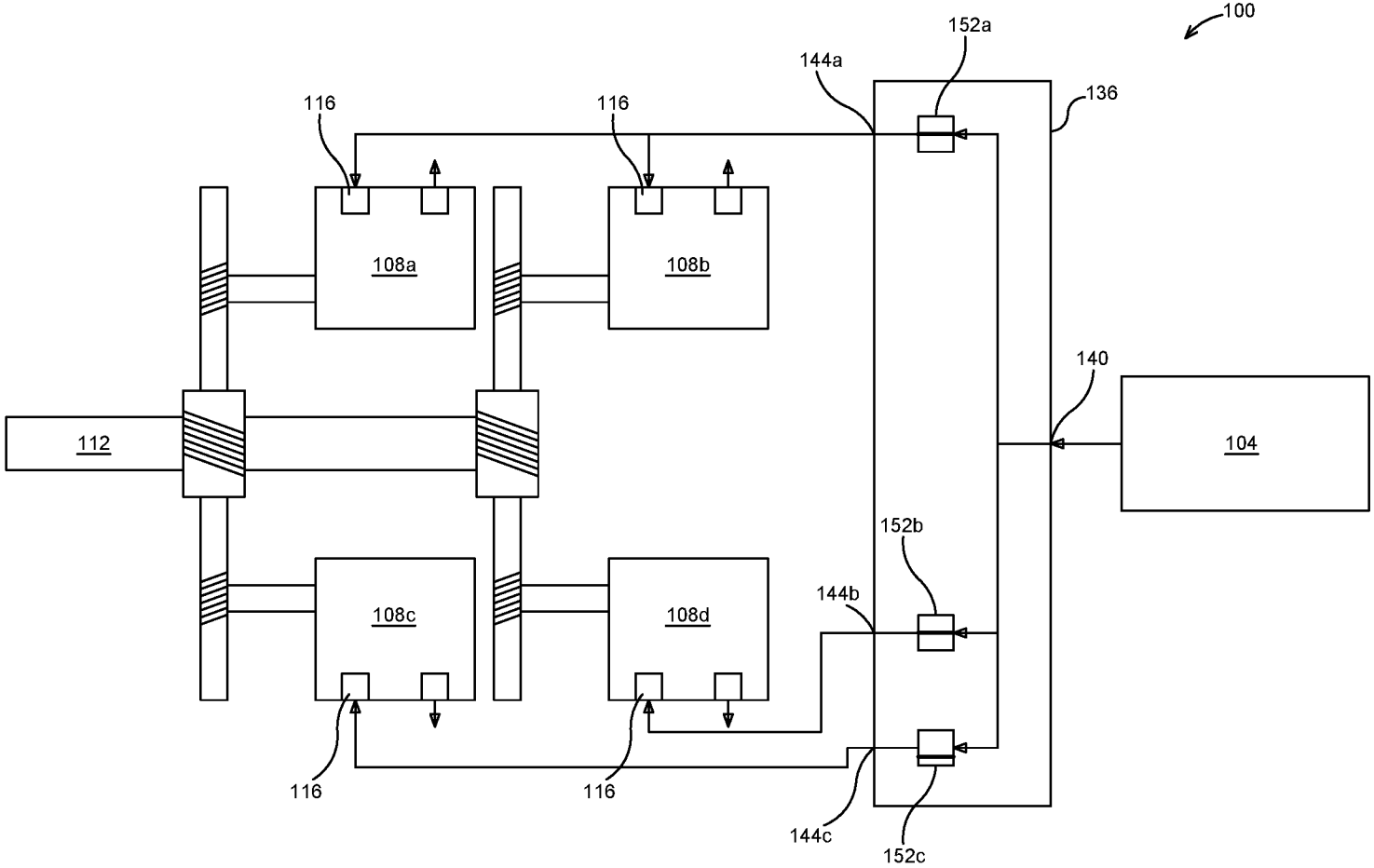
FIG. 2 is a schematic illustration of a pneumatic engine in accordance with another embodiment.

Reference is now made to FIG. 2, which shows a schematic illustration of pneumatic engine 100 connected to a gas source 104. In some embodiments, pneumatic engine 100 may include one or more gas valves 152 operable to selectively allow, inhibit and/or restrict gas flow through one or more (or all) of pneumatic motors 108. This can allow pneumatic engine 100 to operate using a selected subset of pneumatic motors 108. For example, gas flow through select pneumatic motors 108 may be enabled, disabled, or restricted to provide an output at engine drive shaft 112 having the power, torque, or RPM required by the circumstances. In another example, valves 152 may be operable to inhibit gas flow to a pneumatic motor 108 that has failed or been removed, pending repair or replacement, while allowing gas through to the remaining pneumatic motors 108 for continued operation of pneumatic engine 100.

Pneumatic engine 100 may include flow control valves 152 of any type that can selectively allow or inhibit gas flow through a pneumatic motor 108. In some cases, a valve 152 may allow for a partial reduction of gas flow to a pneumatic motor 108. Each valve 152 may include at least an open position in which gas flow is permitted, and a closed position in which gas flow is inhibited. Alternatively or in addition to the open or closed position, the valve 152 may include a partially open position in which gas flow is partially restricted. Exemplary flow control valves include a ball valve, butterfly valve, diaphragm valve, spool valve, and rotary valve.

One or more (or all) of valves 152 may be manually user operable (i.e. by hand). For example, such valves 152 may include a lever, handle, switch, or other mechanically connected control for selecting the position of the valve 152. This can allow convenient user determination over the position of each of valves 152. Alternatively or in addition, one or more (or all) of valves 152 may be controllable by electrical or pneumatic means. For example, such valves 152 may include an electrical and/or pneumatic connection.

Valves 152 may be positioned anywhere in the gas flow path downstream of gas source 104. For example, a valve 152 may be positioned upstream of a motor gas inlet 116 and downstream of gas source 104. In the illustrated embodiment, valves 152 are positioned within inlet manifold 136 between manifold gas inlet 140 and a manifold gas outlet 144. Pneumatic engine 100 can include any number of valves 152. Preferably, at least one valve 152 can allow, inhibit, and/or restrict flow through a subset (i.e. one or more, but not all) of pneumatic motors 108. This allows for differential control over the gas flow between different pneumatic motors 108.

In the illustrated embodiment, pneumatic engine 100 includes three valves 152*a-c*. Each of valves 152*b* and 152*c* is positioned upstream of a single respective pneumatic motor 108*d* or 108*c* and is operable to allow, inhibit, or restrict gas flow across that respective pneumatic motor 108*d* or 108*c*. As exemplified, valve 152*b* is in an open position, whereby gas flow through valve 152*b* to pneumatic motor 108*d* is unrestricted, and valve 152*c* is in a closed position where by gas flow through valve 152*c* to pneumatic motor 108*c* is inhibited. Accordingly, pneumatic motor 108*c* does not contribute power to engine drive shaft 112. Instead, pneumatic motor 108*c* may free-wheel with little or no resistive torque on engine drive shaft 112. Valve 152*a* is shown positioned upstream of two pneumatic motors 108*a* and 108*b*, and is operable to allow, inhibit, or restrict gas flow across both of pneumatic motor 108*a* and 108*b*. As shown, pneumatic motors 108*a* and 108*b* are arranged in parallel.

Figure 3:
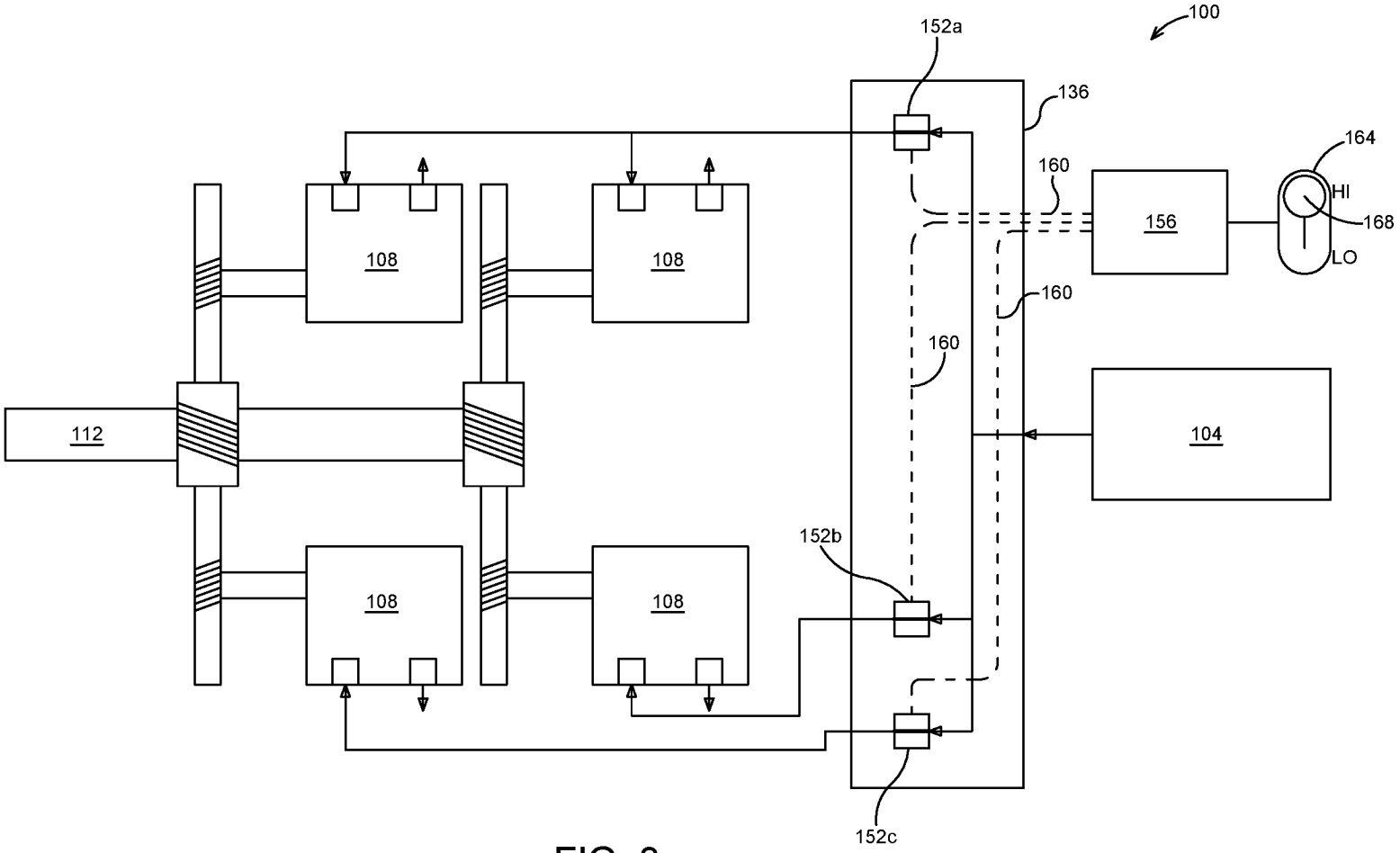
FIG. 3 is a schematic illustration of a pneumatic engine in accordance with another embodiment.

FIG. 3 shows a schematic illustration of pneumatic engine 100 including gas flow control valves 152 that are controlled by a flow controller 156. Flow controller 156 is a device that is operable to selectively direct the position of flow control valves 152, whereby flow controller 156 is able to selectively allow, inhibit, or restrict gas flow through one or more of pneumatic motors 108. It will be appreciated that flow controller 156 may be a component of inlet manifold 136 or a discrete component therefrom. Also, flow control valves 152 may be positioned anywhere downstream of gas source 104. For example, one or more or all of flow control valves 152 may be positioned outside of inlet manifold 136.

Flow controller 156 can be connected to gas flow control valves 152 in any manner that allows flow controller 156 to direct the position of those gas flow control valves 152. In some embodiments, flow controller 156 is connected to gas flow control valves 152 by control lines 160. Control lines 160 may include electrical conductors for transmitting power or control signals to valves 152, or gas hoses for example. For example, one or more of gas flow control valves 152 may include an electrically controllable solenoid, or a gas controllable louvre.

Figure 4:
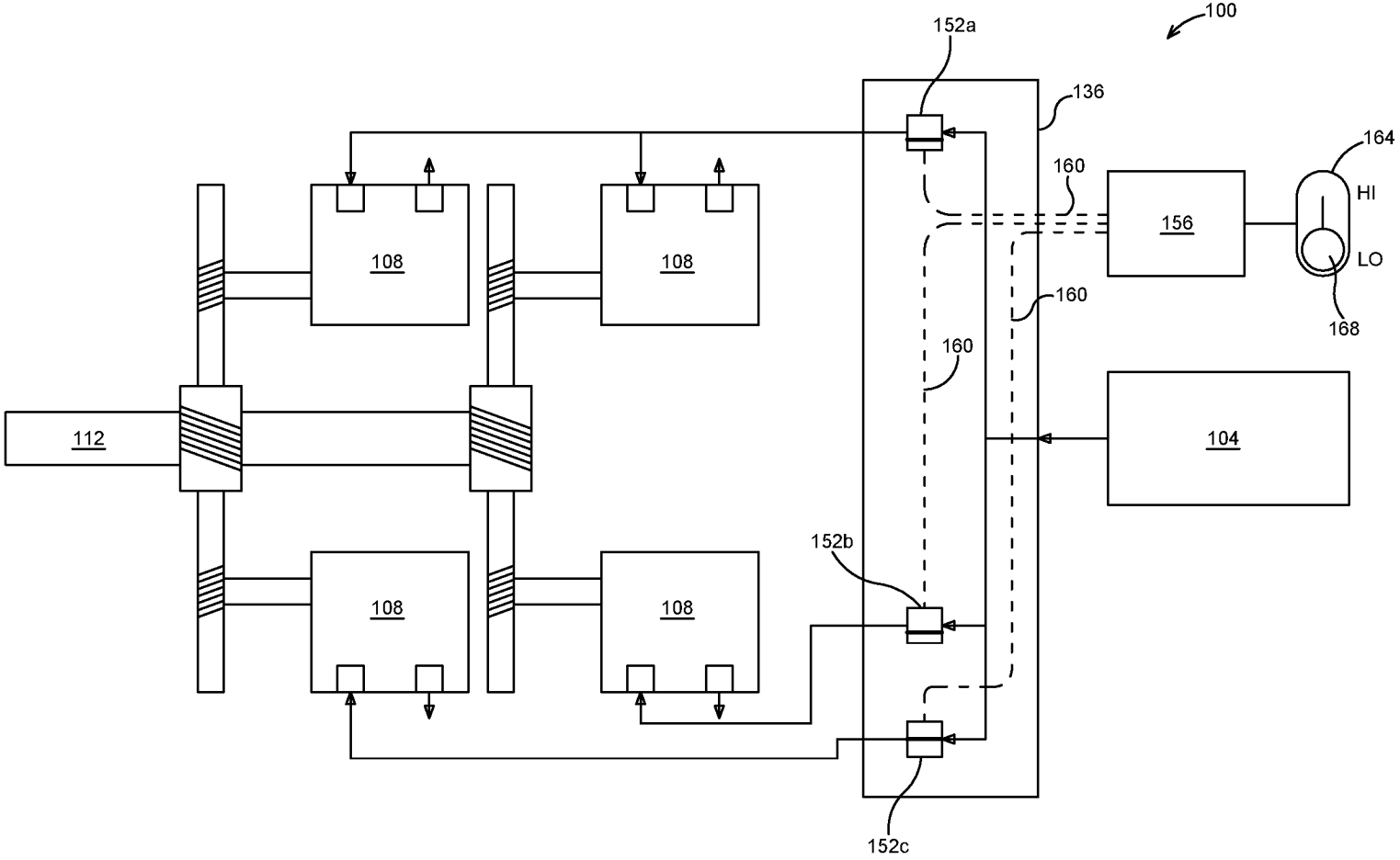
FIG. 4 is a schematic illustration of a pneumatic engine in accordance with another embodiment.

In the illustrated example, flow controller 156 includes or is communicatively connected to a controller interface 164. Controller interface 164 includes one or more manually operable controls 168, such as switches, dials, buttons, levers, touch screens, and sliders. A user can manipulate controls 168 to select various settings and/or operating modes, where the selection of a mode or setting with control 168 may cause or influence flow controller 156 to change the position of one or more of gas valves 152. For example, controller interface 164 may allow user selection of one or more of a high power mode, low power mode, high torque mode, low torque mode, high speed (RPM) mode, low speed (RPM) mode, and everything in between such highs and lows. In each mode, the flow controller 156 may direct one or more of valves 152 to move to a different position than the position of that valve 152 in one of the other modes. As an example, control 168 is shown in the form of a slider having at least a first position (FIG. 3) and second position (FIG. 4). In the example shown, the first position corresponds to a high power mode, and the second position corresponds to a low power mode. In this example, movement of control 168 to the first position (FIG. 3) causes flow controller 156 to move valves 152*a-c* to the open position for maximum power output at engine drive shaft 112. Turning to FIG. 4, movement of control 168 to the second position causes flow controller 156 to move valves 152*a-b* to the closed position while keeping valve 152*c* in the open position, whereby the output power at engine drive shaft 112 is reduced.

In some embodiments, controller interface 164 allows user entry identifying one or more of valves 152, and a position for each of those valves 152, whereby controller interface 164 will direct those valves 152 to move to those positions. This can provide a user with fine customization over the operation of pneumatic motors 108 in pneumatic engine 100. This can also allow a user to disable one or more of pneumatic motors 108, such as for repair or replacement in the event of motor failure.

Figure 5:
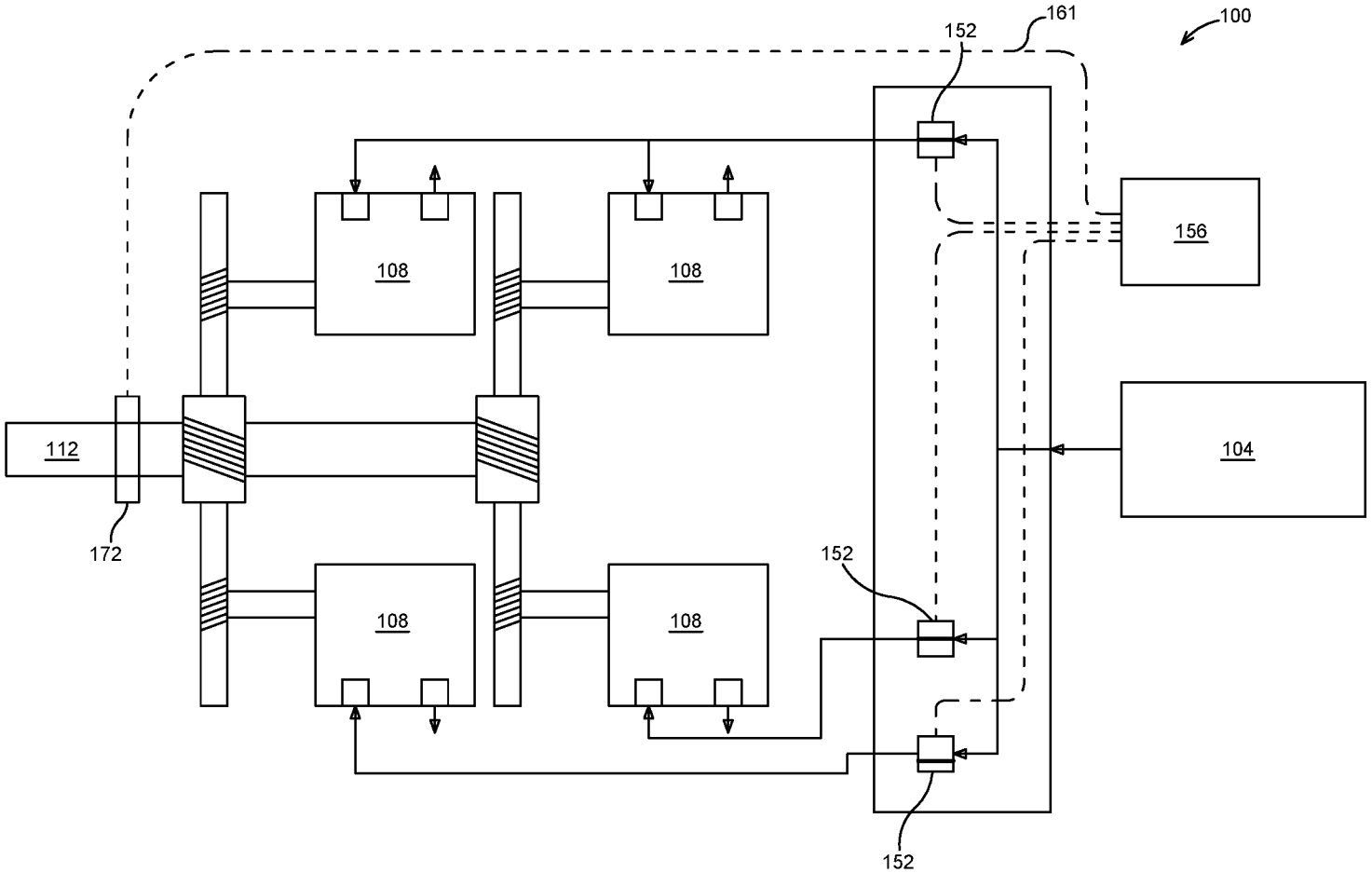
FIG. 5 is a schematic illustration of a pneumatic engine in accordance with another embodiment.

Reference is now made to FIG. 5. Alternatively or in addition to controller interface 164 (FIGS. 3-4), pneumatic engine 100 may include one or more sensors 172 for measuring an operating characteristic of pneumatic engine 100, such as output torque, output power, output speed (e.g. RPM), or temperature. As shown, a sensor 172 may be communicatively coupled to flow controller 156 (e.g. by control line 161) whereby flow controller 156 receives sensor data from the sensor(s) 172. In some embodiments, flow controller 156 may respond to the sensor data by directing one or more of gas valves 152 to change position.

For example, flow controller 156 may direct one or more of gas valves 152 to restrict gas flow (e.g. move to or towards a closed position) in response to receiving sensor data from sensor(s) 172 indicating that the power, speed, torque, temperature, or another operational characteristic at engine drive shaft 112 or another component of pneumatic engine 100 exceeds a predetermined threshold value. Conversely, flow controller 156 may direct one or more of gas valves 152 to increase gas flow (e.g. move to or towards an open position) in response to receiving sensor data from sensor(s) 172 indicating that the power, speed, torque, temperature, or another operational characteristic at engine drive shaft 112 or another component of pneumatic engine 100 falls below a predetermined threshold value.

Figure 6:
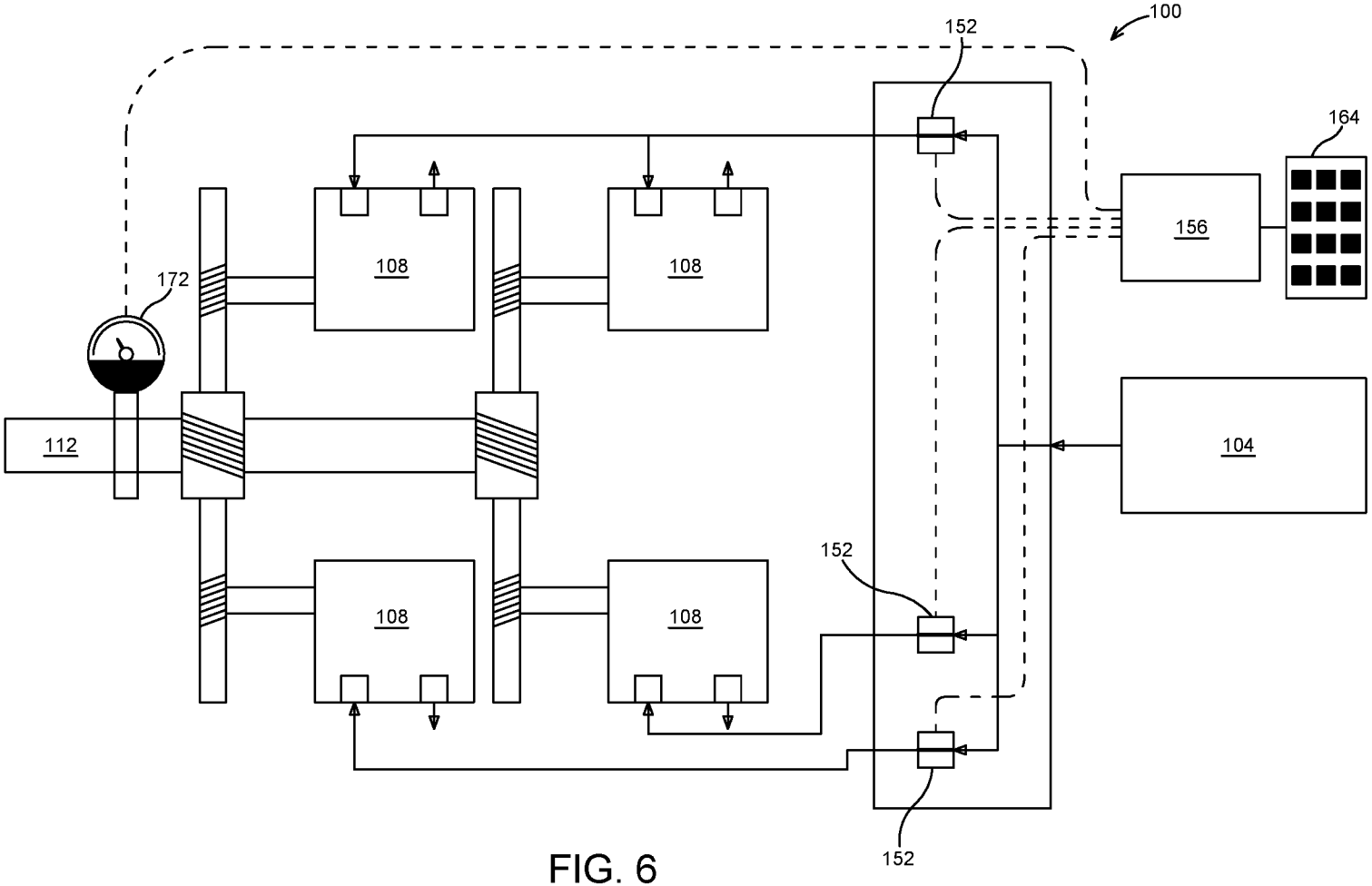
FIG. 6 is a schematic illustration of a pneumatic engine in accordance with another embodiment.

Referring to FIG. 6, in some embodiments, pneumatic engine 100 may further include a controller interface 164 which provides for user entry of the threshold value(s) (power, speed, torque, temperature, or another operational characteristic of pneumatic engine 100) that guide the operation of flow controller 156 in response to readouts from sensor(s) 172. Alternatively or in addition, the operational modes that are user-selectable with controller interface 164 (e.g. high power, lower power, high torque, low torque, etc.) may include such threshold values or value ranges. A value range may include an upper threshold value and a lower threshold value, whereby flow controller 156 may direct one or more gas valves 152 to change position in response to receiving sensor data from one or more sensors 172 indicating that a the corresponding operational characteristic value is below the lower threshold value or above the upper threshold value.

Figure 7:
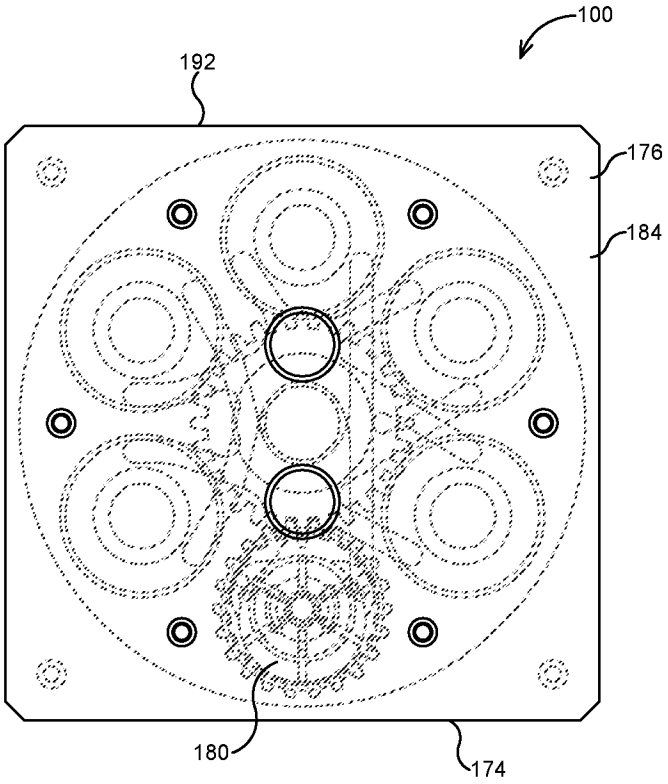
FIG. 7 is a rear elevation view of a pneumatic engine in accordance with at least one embodiment.
Figure 8:
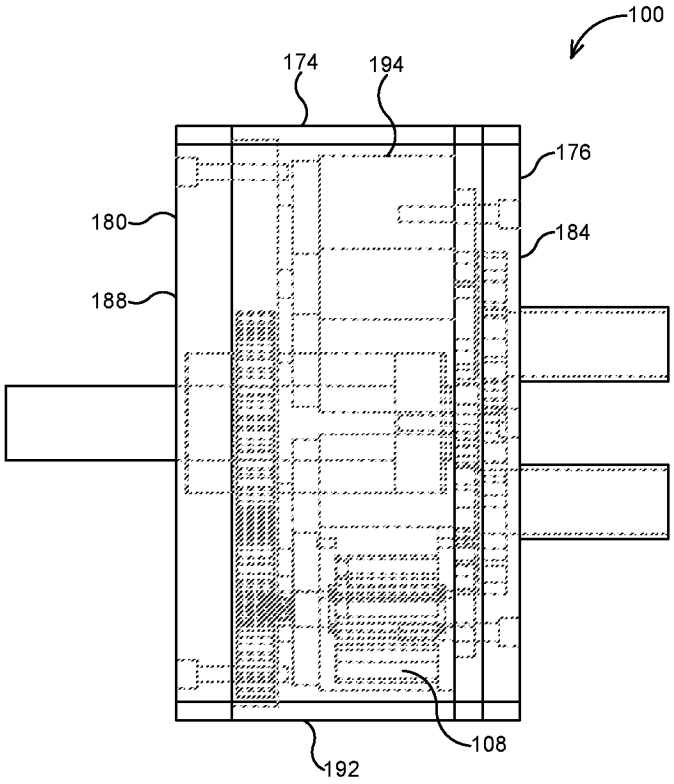
FIG. 8 is a side elevation view of the pneumatic engine of FIG. 7.

FIGS. 7-11 illustrate an embodiment of pneumatic engine 100. Referring to FIGS. 7-8, pneumatic engine 100 is shown including a body (i.e. housing) 174 having a rear end 176, a front end 180, a rear wall 184 at rear end 176, a front wall 188 at front end 180, and one or more sidewalls 192 extending between the front and rear walls 184 and 188. As shown, body walls 184, 188, and 192 define an internal body cavity 194 that houses at least some components of pneumatic engine 100, such as pneumatic motors 108.

In the example illustrated in FIGS. 7-11, only one pneumatic motor 108 is shown so as not to clutter the drawings. However, it will be appreciated that embodiments of pneumatic engine 100 can have any number of pneumatic motors 108 and in the illustrated example pneumatic engine 100 can accommodate six pneumatic motors 108.

Figure 9:
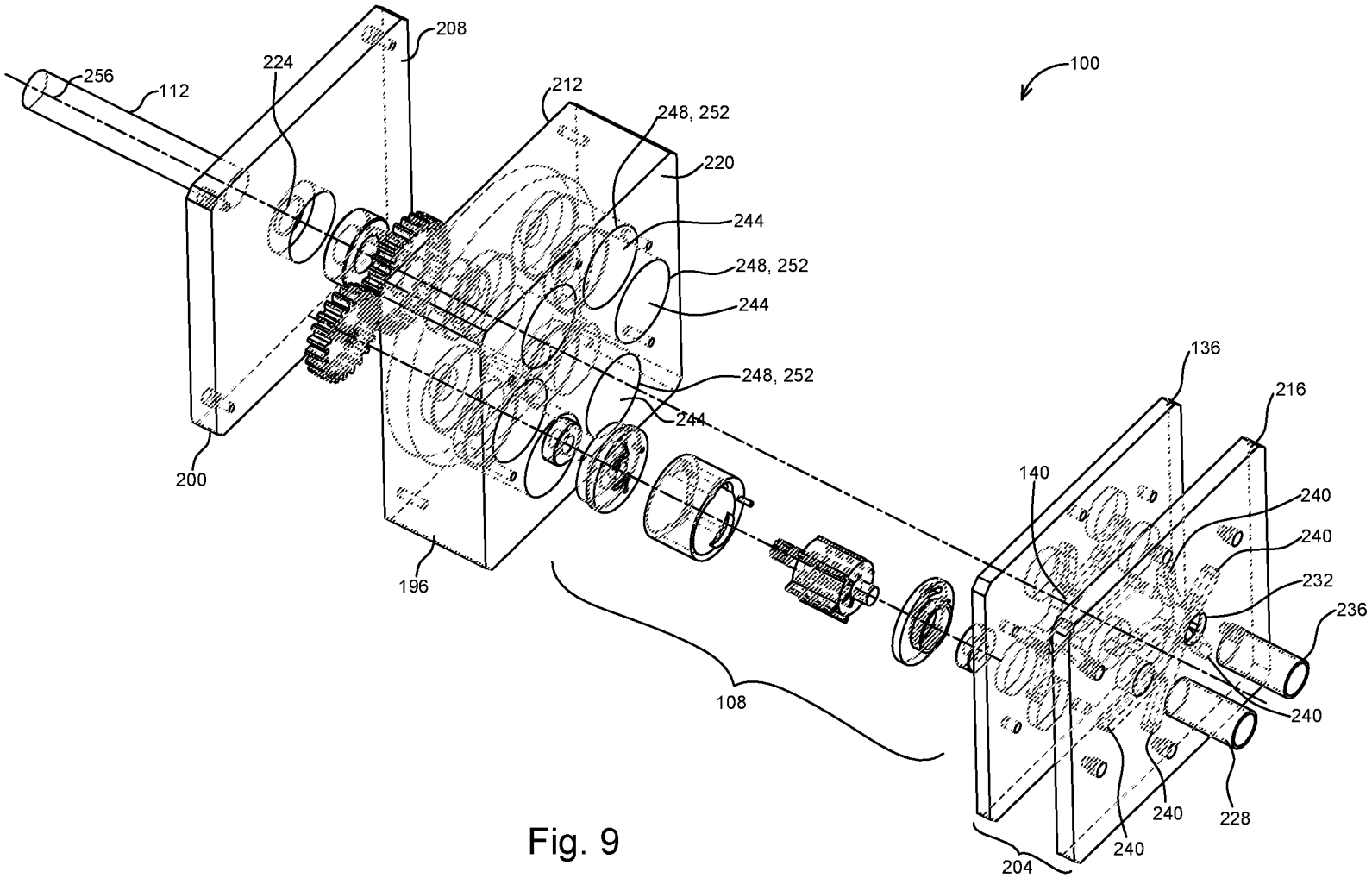
FIG. 9 is an exploded rear perspective view of the pneumatic engine of FIG. 7.
Figure 10:
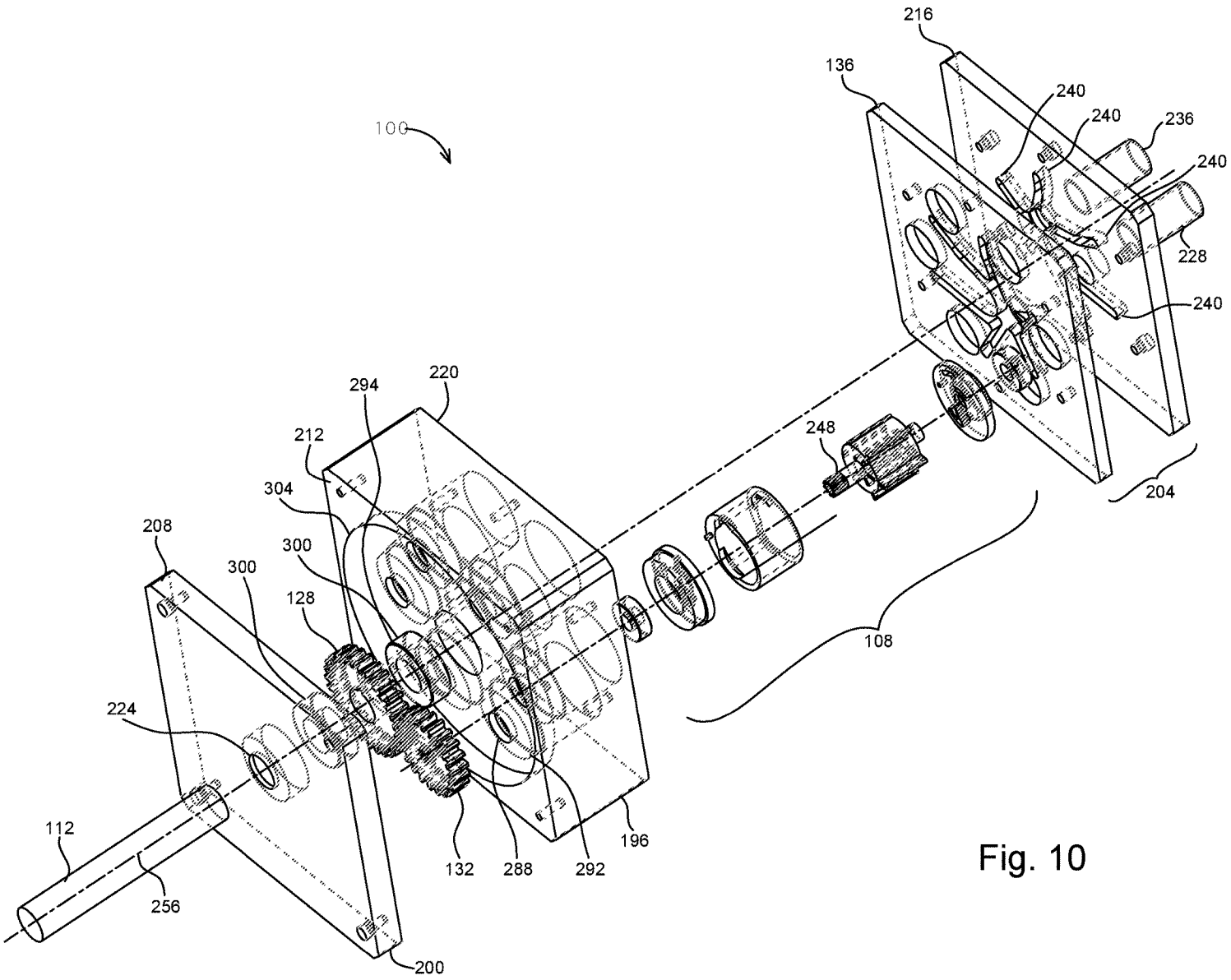
FIG. 10 is an exploded front perspective view of the pneumatic engine of FIG. 7.
Figure 11:
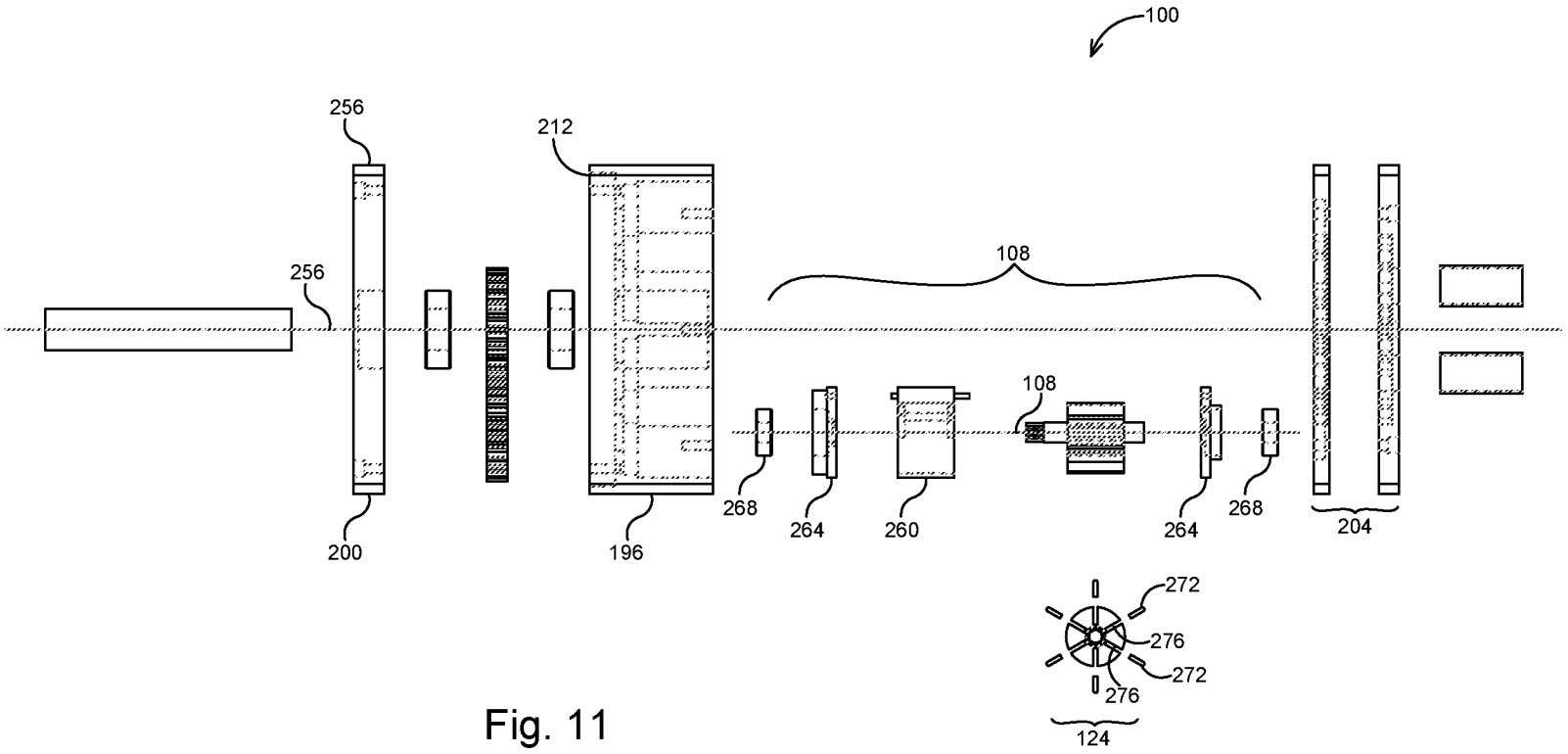
FIG. 11 is an exploded side elevation view of the pneumatic engine of FIG. 7.

Reference is now made to FIGS. 9-11. As shown, body 174 includes an intermediate portion 196 positioned between a front portion 200 and a rear portion 204. Body front portion 200 includes a front plate 208 that is connected to a front end 212 of intermediate portion 196, and body rear portion 204 includes inlet manifold 136 and outlet manifold 216 which are connected to rear end 220 of intermediate portion 196.

Referring to FIGS. 9-10, front plate 208 is shown including a shaft opening 224 through which engine drive shaft 112 extends. Inlet manifold 136 includes a manifold gas inlet 140 fluidly connected to a gas source, such as by an inlet gas conduit 228. Outlet manifold 216 includes a manifold gas outlet 232 which may exhaust gas flow from pneumatic motors 108 directly to the ambient atmosphere or a fluidly connected outlet gas conduit 236. As shown, outlet manifold 216 includes a plurality of manifold gas inlets 240 positioned upstream of manifold gas outlet 232. Each manifold gas inlet 240 is fluidly connected to at least one pneumatic motor 108 to receive gas flow that has passed through that at least one pneumatic motor 108.

Referring to FIG. 9, body intermediate portion 196 may include a plurality of motor cavities 244, where each motor cavity 244 is sized to receive a pneumatic motor 108. In the illustrated example, body intermediate portion 196 includes six motor cavities 244 for collectively receiving six pneumatic motors 108. Motor cavities 244 may be positioned in any arrangement. In the illustrated example, motor cavities 244 are distributed in spaced apart relation surrounding engine drive shaft axis 256. For example, motor cavities 244 may be arranged circularly concentric with drive shaft axis 256 as shown. In other embodiments, pneumatic engine 100 can include any number of pneumatic motors 108, which can be arranged in parallel, in series, or both according to the configuration of inlet and outlet manifolds 136 and 216.

In some embodiments, pneumatic motors 108 are removably receivable in motor cavities 244. This can allow pneumatic motors 108 to be removed from pneumatic engine 100 for repair or replacement. In the illustrated example, each motor cavity 244 includes a motor cavity opening 248 size to allow insertion and removal of the pneumatic motor 108. The motor cavity opening 248 may be positioned anywhere in motor cavity 244. In the illustrated embodiment, motor cavity opening 248 is positioned at rear end 252 of motor cavity 244, which may coincide with intermediate portion rear end 220. As shown, body rear portion 204 may overlie motor cavity openings 248 when connected to body intermediate portion 196 to retain pneumatic motors 108 within the motor cavities 244. Body rear portion 204 may be removably connected to intermediate portion 196 to allow access to motor cavity openings 248 for removal and replacement of pneumatic motors 108.

Reference is now made to FIG. 11. Pneumatic engine 100 can include any one or more types of pneumatic motors 108. In the illustrated example, pneumatic motor 108 is a rotary vane type pneumatic motor including a rotor 124 and a stator 260. As shown, motor rotor 124 may be rotatably mounted within motor stator 260 by end seals 264 and bearings 268. Consistent with known rotary vane type pneumatic motor designs, motor rotor 124 and motor stator 260 define a gas flow path through pneumatic motor 108 in conjunction with motor vanes 272 which are radially slidable in vane slots 276 of motor rotor 124. In operation, the gas flow acts on motor vanes 272 to rotate motor rotor 124 about motor axis 280. Motor axis 280 may be spaced apart from engine drive shaft axis 256. In the example shown, motor axis 280 is spaced apart and parallel to engine drive shaft axis 256.

Referring to FIG. 10, a motor rotor 124 may be connected to a rotor gear 132 that engages a drive gear 128 connected to engine drive shaft 112. In the illustrated example, motor rotor 124 includes a rotor shaft 284 connected to rotor gear 132. As shown, rotor shaft 284 may extend forwardly through a rotor shaft opening 288 formed in motor cavity front wall 292. Rotor gear 132 is positioned outside of motor cavity 244, forward of motor cavity front wall 292. Drive gear 128 is shown connected to drive shaft 112, and connected to body 174 by drive shaft bearings 300.

As shown, body intermediate portion 196 may include a transmission cavity 294 formed in intermediate portion front end 212. The transmission cavity 294 may house mechanical components that transmit rotary power from pneumatic motors 108 to engine drive shaft 112. In the illustrated embodiment, transmission cavity 294 is sized to house rotor gears 132 and drive gear 128. In the illustrated example, body front portion 200 overlies transmission cavity front opening 304 when connected to body intermediate portion 196. In some embodiments, transmission cavity 294 is openable to provide access to repair or replace the power transmission components. For example, body front portion 200 may be removably connected to intermediate portion 196 to provide access to transmission cavity 294 through transmission cavity front opening 304.

Figure 12:
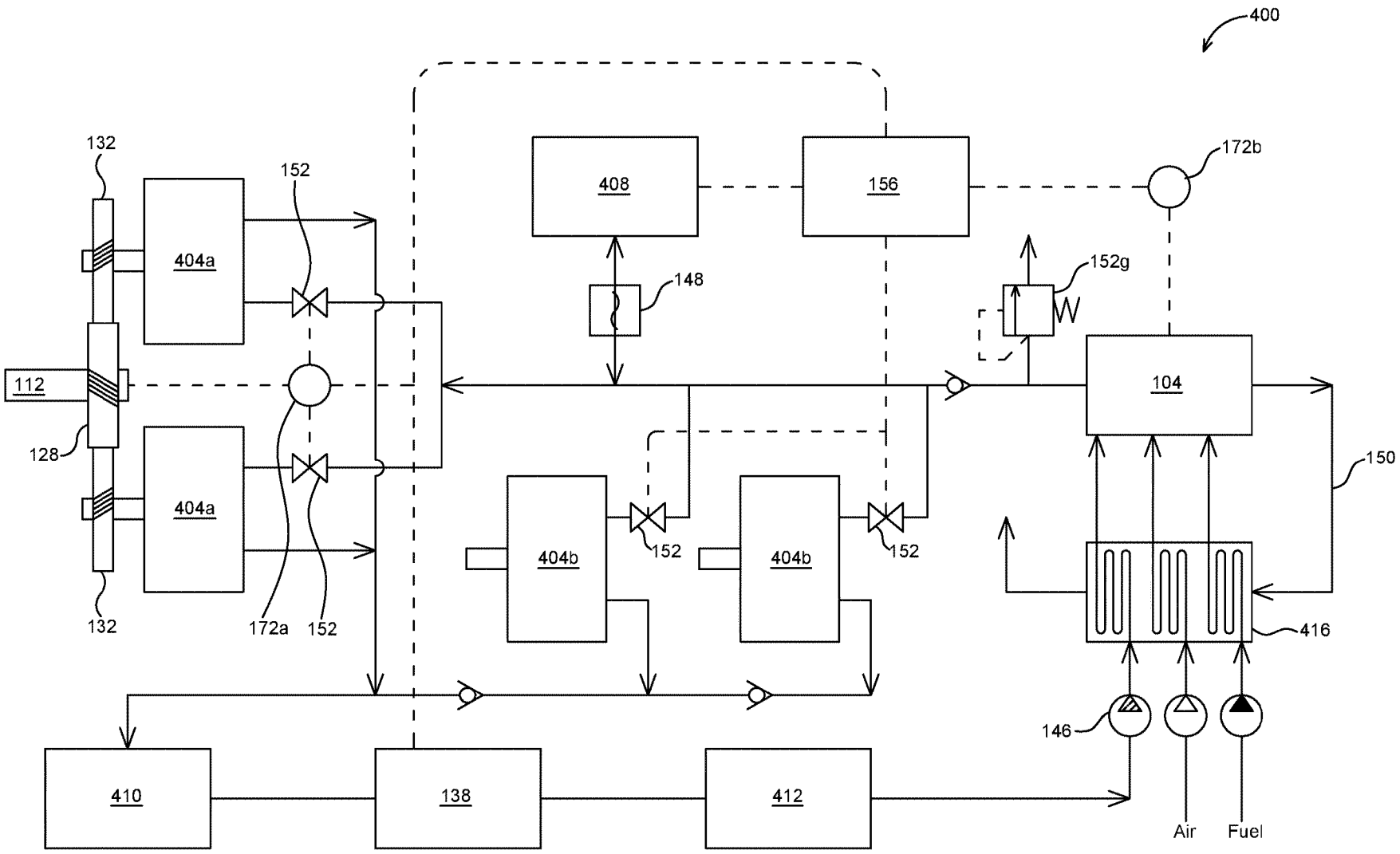
FIG. 12 is a schematic view of a pneumatic engine in accordance with another embodiment.

Reference is now made to FIG. 12, which shows a pneumatic engine 400 fluidly connected with a gas source 104 in accordance with another embodiment, and where like part numbers refer to like parts in the previous figures. As shown, pneumatic engine 400 includes one or more pneumatic motor assemblies 404, which are drivingly coupled to engine drive shaft 112 to provide the motive force for rotating engine drive shaft 112. Each pneumatic motor assembly 404 includes one or more pneumatic motors. Gas source 104 is fluidly connected to pneumatic motor assemblies 404 to supply pneumatic motor assemblies 404 with a flow of pressurized gas (e.g. air or steam), which the pneumatic motor assemblies 404 utilize to produce mechanical output (e.g. rotation or reciprocation).

Pneumatic engine 400 can include any number of pneumatic motor assemblies 404. For example, pneumatic engine 400 can include a plurality of pneumatic motor assemblies 404 fluidly connected to gas source 104 in parallel as shown, or in series. In other embodiments, pneumatic engine 400 can include just one pneumatic motor assembly 404. As exemplified, the one or more pneumatic motor assemblies 404*a* may collectively include one or more motor rotors 124 which is/are drivingly coupled to engine drive shaft 112, such as by way of meshed rotor and drive gears 132 and 128 for example.

Figure 21:
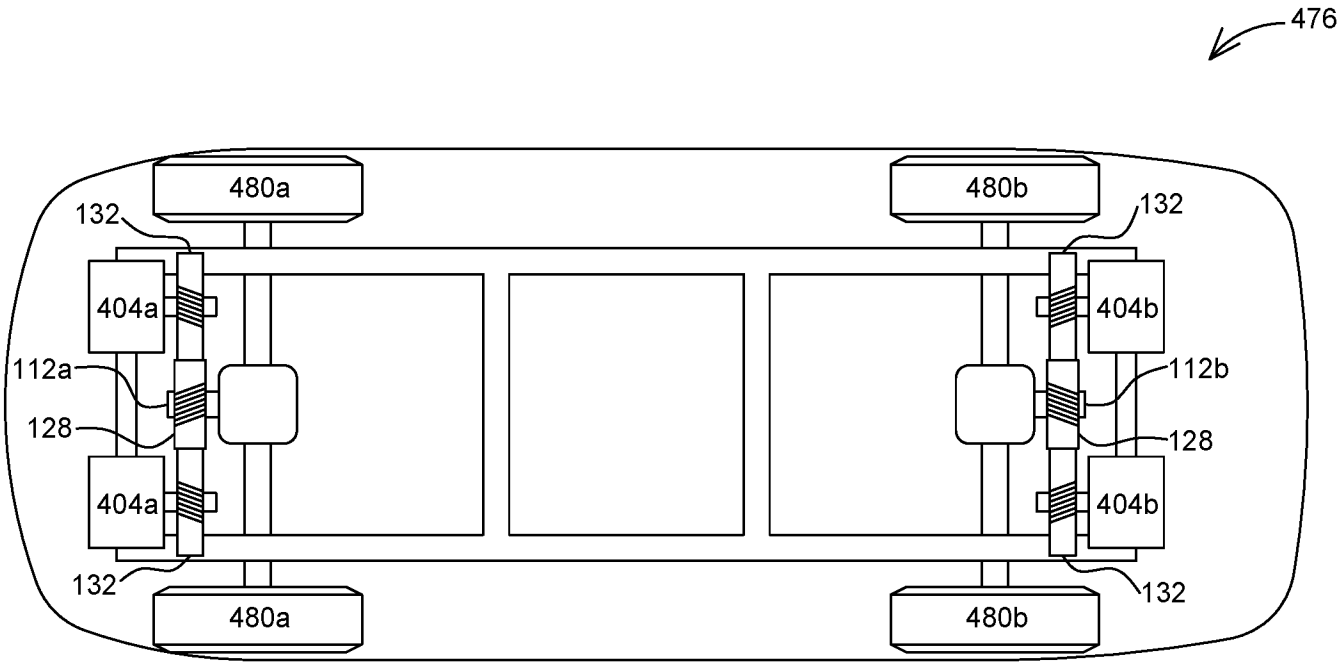
FIG. 21 is a schematic view of a vehicle including a pneumatic engine in accordance with at least one embodiment.

In the illustrated example, all of the pneumatic motor assemblies 404*a* are drivingly connected to engine drive shaft 112. In other embodiments, pneumatic motor assemblies 404 may be drivingly connected to different engine drive shafts 112. For example, FIG. 21 shows a vehicle 476 having an engine drive shaft 112*a* for the front wheels 480*a* driven by one of more first pneumatic motor assemblies 404*a*, and an engine drive shaft 112*b* for the rear wheels 480*b* driven by one or more second pneumatic motor assemblies 404*b*. Returning FIG. 12, in some embodiments, pneumatic engine 400 further comprises pneumatic motor assemblies 404*b*, such as to generate electricity, or operate an air conditioner.

In some embodiments, a high-pressure reservoir 408 is located downstream of gas source 104 and upstream of the pneumatic motor assemblies 404. High-pressure reservoir 408 can be any device suitable for storing a volume of pressurized gas and to selectively supplement or substitute the supply of pressurized gas from gas source 104 to pneumatic motor assemblies 404. For example, if pneumatic engine 400 was incorporated into a vehicle (e.g. automobile or aerial vehicle), high-pressure reservoir 408 may supply pressurized gas to pneumatic motor assemblies 404 to enhance acceleration performance, or to facilitate a cold start. This may allow gas source 104 to be sized based on normal operating conditions, with a view to relying on high-pressure reservoir 408 to supplement gas source 104 for temporary high load conditions. In the context of a vehicle, this may allow for a smaller (and therefore lighter) gas source 104 to be used, which can lead to better fuel efficiency.

In the illustrated example, flow controller 156 is communicatively coupled to drive shaft sensor 172*a* to determine load and/or operating characteristics (e.g. speed, torque, etc.) of engine drive shaft 112, communicatively coupled to gas source 104 (and/or gas source sensor 172*b*) to control activation and/or other operating parameters (e.g. operating speed) of gas source 104, and communicatively coupled to high pressure reservoir 408 to control discharge of pressurized gas and/or determine operating characteristics (e.g. fill level). In some cases, flow controller 156 may determine that the load demanded at engine drive shaft 112 requires less pressurized gas flow than gas source 104 produces at its efficient operating speed. In response, flow controller 156 can operate gas source 104 at efficiency and store excess pressurized gas in high-pressure reservoir 408, or may deactivate gas source 104 and supply pneumatic motor assemblies 404 using high-pressure reservoir 408. Thus, high-pressure reservoir 408 allows gas source 104 to be operated at efficiency by storing excess generated pressurized gas, and substituting (or supplementing) pressurized gas supply by gas source 104. This can be helpful to accommodate fluctuating loads (e.g. heating or electricity demand) that may be seen in some residential, commercial, or industrial facilities (e.g. factory, industrial laundry, industrial bakery, building, hotel, farm, or house) for example. In some embodiments, high-pressure reservoir 408 may also be operable to heat the contained pressurized gas to mitigate the loss of energy (e.g. heat) during gas residency.

In alternative embodiments, pneumatic engine 400 may not include high-pressure reservoir 408. Instead, gas source 104 may be sized to provide a sufficient supply of pressurized gas for all expected operating conditions. For example, in a residential, commercial, or industrial facility the load on pneumatic engine 400 may be relatively consistent so that a high-pressure reservoir 408 to accommodate sudden high-load conditions and to store excess pressurized gas is not required. In some embodiments, excess pressurized gas may be employed to generate electricity that is supplied to a public electricity network (e.g. municipal power grid).

Still referring to FIG. 12, one or more gas valves 152 may be collectively positioned upstream of pneumatic motor assemblies 404 to selectively allow, inhibit and/or restrict gas flow through one or more (or all) of pneumatic motors assemblies 404. This can allow pneumatic engine 400 to operate using a selected subset of pneumatic motor assemblies 404. Gas valves 152 may be communicatively coupled to flow controller 156, which can direct gas valves 152 to allow, inhibit, and/or restrict gas flow. For example, gas flow through select pneumatic motor assemblies 404 may be enabled, disabled, or restricted (e.g. reduced) to provide an output at engine drive shaft 112 having the power, torque, or RPM required by the circumstances. In another example, flow controller 156 may direct gas valves 152 to inhibit (e.g. stop) gas flow to a pneumatic motor 108 that has failed or been removed, pending repair or replacement, while allowing gas through to the remaining pneumatic motor assemblies 404 for continued operation of pneumatic engine 400. It will be appreciated that flow controller 156 may operate automatically (e.g. similar to an automatic transmission in a vehicle) or according to manual user inputs (e.g. similar to a manual transmission in a vehicle).

Pneumatic engine 400 can have any number of gas valves 152. In the illustrated example, pneumatic engine 400 has two gas valves 152. As shown, one gas valve 152 positioned upstream of each pneumatic motor assembly 404. In alternative embodiments, pneumatic engine 400 may have fewer or a greater number of gas valves 152 than the number of pneumatic motor assemblies 404. For example, pneumatic engine 400 may have one gas valve 152 positioned upstream of all of the pneumatic motor assemblies 404, or positioned upstream of only a subset of pneumatic motor assemblies 404. In the illustrated example, a third gas valve 152*g* is provided upstream of pneumatic motor assemblies 404. Gas valve 152*g* may be a safety valve, openable in response to elevated gas pressure, to relieve gas pressure by exhausting gas to atmosphere.

Still referring to FIG. 12, a condenser 138 may be positioned downstream of pneumatic motor assemblies 404. Condenser 138 receives gas discharged from pneumatic motor assemblies 404 and condenses that gas (e.g. steam) to liquid (e.g. water). Condenser 138 discharges the liquid to pump 146, which pumps the liquid back to gas source 104 (e.g. a boiler) for further gas production (e.g. steam production). Condenser 138 can be any device that can condense a gas flow to a liquid flow. For example, condenser 138 can be a water or air cooled condenser, or another known condenser design. In some examples, condenser 138 includes one or more tubes, of any cross-sectional shape (e.g. circular, round, rectangular, or other) which shrink in cross-sectional area in the downstream direction.

In some embodiments, condenser 138 has a plurality of operating speeds. Flow controller 156 may be communicatively coupled to condenser 138 to direct the operating speed of condenser 138 according to demand. For example, during a high load event (e.g. vehicle acceleration), flow controller 156 may direct condenser 138 to operate on 'high' so that sufficient liquid is generated for gas source 104 to produce sufficient pressurized gas flow. In some embodiments, condenser 138 includes a plurality of condensing stages that can be selectively activated according to the operating speed. Condenser 138 may provide high speed condensing by opening all condensing stages, and may provide lower speed condensing by closing a subset of the condensing stages.

In alternative embodiments, gas discharged from pneumatic motor assemblies 404 does not recirculate to gas source 104, and pneumatic engine 400 may not include condenser 138. For example, where pneumatic engine 400 operates on air (e.g. as opposed to steam), the pneumatic motor assemblies 404 may vent discharged gas to the environment. In this case, gas source 104 may be, for example a compressed air cylinder or an air compressor, which draws in and compresses ambient air from the environment.

Still referring to FIG. 12, in some embodiments a buffer 410 is positioned in the gas flow path downstream of pneumatic motor assemblies 404 and upstream of condenser 138. Buffer 410 may provide a reservoir, such as a tank or bundle of conduits, that provides interim storage for exhaust gas. This allows gas from buffer 410 to be metered into condenser 138 according to the flow capacity of condenser 138. In turn, this can avoid feeding condenser 138 with more gas than condenser 138 is designed to condense at its current operating speed. In some embodiments, buffer 410 also provides some cooling to the exhaust gas it contains, which can help reduce the workload on condenser 138. In alternative embodiment, pneumatic engine 400 does not include buffer 410. For example, pneumatic engine 400 may operate continuously under stable conditions to drive an electric generator.

With continuing reference to FIG. 12, in some embodiments a low pressure reservoir 412 is positioned downstream of condenser 138 and upstream of gas source 104. Low pressure reservoir 412 provides low pressure fluid storage for supply to gas source 104 to generate pressurized gas as required. For example, low pressure reservoir 412 may provide storage of liquid (e.g. water) and/or low-pressure gas (e.g. steam) to supply to gas source 104 for generating pressurized gas to operate pneumatic engine 400. Low pressure reservoir 412 may be the sole supply of liquid and/or gas to gas source 104, or may provide a supplemental supply of liquid and/or gas to gas source 104. In some embodiments, pneumatic engine 400 employs lubricating oil, and low pressure reservoir 412 includes a filter or oil separator to remove impurities or lubricating oil that may become entrained in the fluid as it circulates through pneumatic engine 400. In other embodiments, pneumatic engine 400 does not include a low pressure reservoir 412. For example, pneumatic engine 400 may operate on air and draw air from the ambient environment. In some embodiments, the flow path to gas source 104 (e.g. from condenser 138) is configurable to bypass low pressure reservoir 412 during high-load events.

Gas source 104 can be any device that can supply a pressurized flow of gas. In some embodiments, gas source 104 includes a boiler that generates high pressure steam from liquid (e.g. water), or a gas compressor that compresses gas (e.g. air) to generate a pressurized gas flow (e.g. compressed air). Gas source 104 may be powered by any power source. For example, gas source 104 may be electrically powered (e.g. from an electric power grid, or a generator), or combustion powered (e.g. using carbon-based fuels, such as gasoline, natural gas, biogas, wood, etc.). In some embodiments, gas source 104 is thermally connected to an external heat source, such as waste heat from a residential, commercial, or industrial process (e.g. hot exhaust gases, or waste heat from an industrial facility such as a power plant). For example, gas source 104 may include a heat exchanger to transfer heat from an external heat source to the gas flow.

In some embodiments, a heat exchanger 416 is positioned upstream of gas source 104, such as downstream of condenser 138, for example. As shown, heat exchanger 416 may transfer heat from exhaust gases 150 discharged by gas source 104 (e.g. hot combustion gases) to inputs into gas source 104, such as working fluid (e.g. liquid or low-pressure gas for conversion to pressurized gas), and/or combustion materials (e.g. fuel and air). The pre-heated inputs into gas source 104 can help improve the efficiency of gas source 104 (e.g. reduce fuel consumption) in generating pressurized gas to operate pneumatic engine 400.

Pneumatic engine 400 can include any number of heaters 148 in the gas flow path to add energy to (e.g. increase pressure of) the pressurized gas flow. In some cases, heaters 148 may help to promote gas flow characteristics (e.g. pressure, flow rate, gaseous state) for optimum engine performance. For example, in the case of a vapor-based pressurized gas flow, heaters 148 may help to prevent premature condensation (e.g. prevent condensation before discharging from pneumatic motor assemblies 404). Heaters 148 may also help to mitigate the loss of energy in pressurized gas flow during fluid transmission between fluidly connected elements of pneumatic engine 400 (e.g. during travel between gas source 104 and pneumatic motor assemblies 404). In some embodiments, heaters 148 may help prevent pneumatic engine 400 from freezing, such as when operating in cold environments. In the illustrated example, pneumatic engine 400 includes a heater 148 downstream of gas source 104 and upstream of pneumatic motor assemblies 404. Where pneumatic motor assemblies 404 are fluidly connected in series, pneumatic engine 400 may include a heater between the series connected pneumatic motor assemblies.

It will be appreciated that pneumatic engine 400 may drive engine drive shaft 112 to drive a machine (e.g. residential, commercial, or industrial equipment, or a vehicle), or to drive an electric generator. In some embodiments in which pneumatic engine 400 operates to drive an electric generator, condenser 138 may be supplemented or substituted by a heat exchanger that transfers heat into the flow path. The high-pressure reservoir 408 may operate to accommodate the load demanded for electrical generation and the gas flow heating system.

Figure 13:
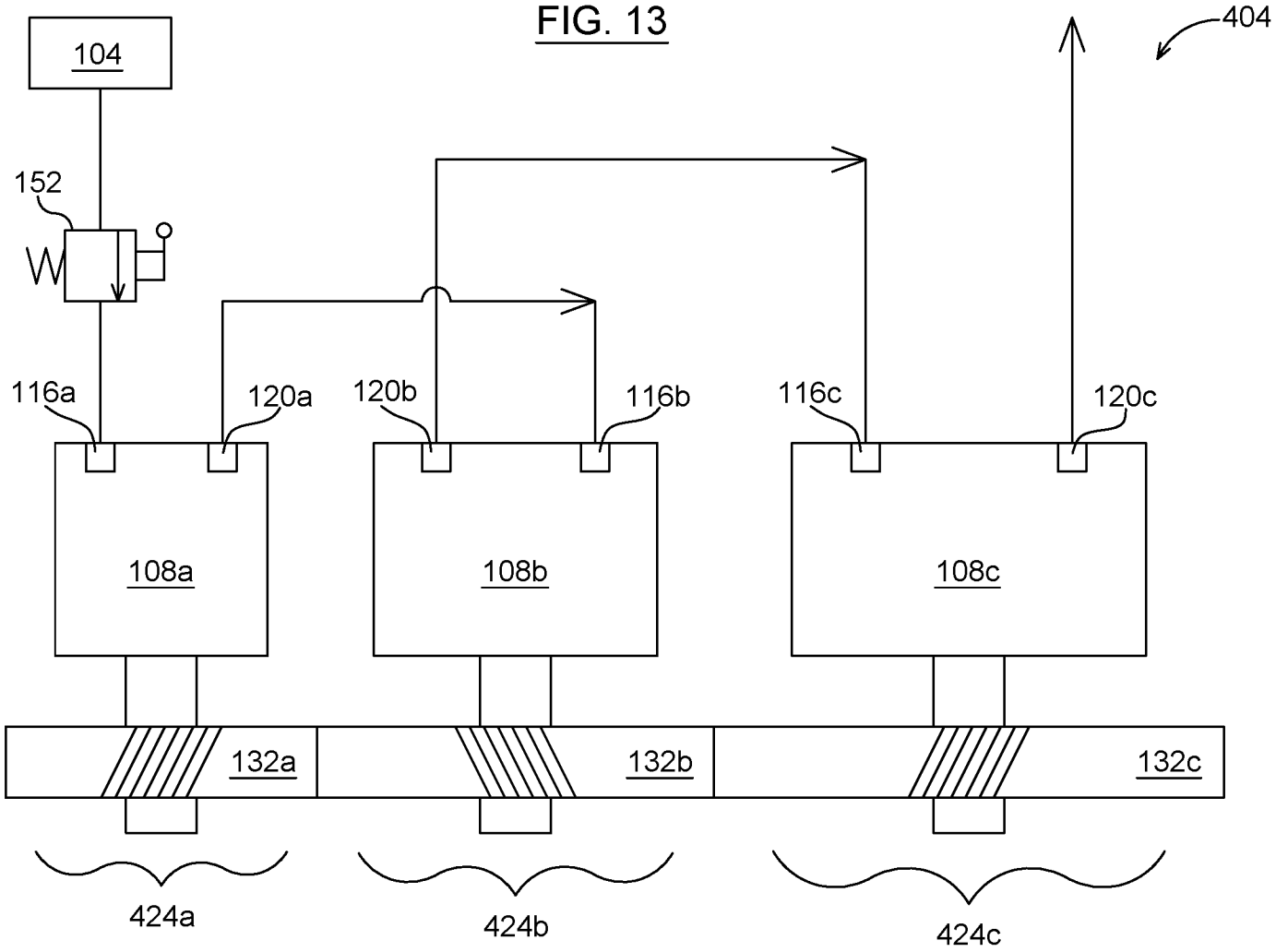
FIG. 13 is a schematic view of a pneumatic motor assembly in accordance with at least one embodiment.

FIG. 13 shows a pneumatic motor assembly 404 in accordance with an embodiment. As shown, pneumatic motor assembly 404 includes a plurality of series motor stages 424 fluidly connected in series. Each series motor stage 424 may include one pneumatic motor 108, or a plurality of pneumatic motors 108 fluidly connected in parallel. Pneumatic motor assembly 404 can include any number of series motor stages 424, and each series motor stage 424 can include any number of pneumatic motors 108. The output torque of pneumatic motor assembly 404 is the sum of the output torques of the series motor stages 424 it contains.

In the illustrated example, pneumatic motor assembly 404 includes three series motor stages 424*a*, 424*b*, and 424*c*. Series motor stage 424*b* is positioned downstream of series motor stage 424*a*, and series motor stage 424*c* is positioned downstream of series motor stage 424*b*. Each of series motor stage 424 is shown including one pneumatic motor 108. In other embodiments, pneumatic motor assembly may include just two series motors stages 424, or may include four or more series motor stages 424.

In the example shown, motor gas outlets 120*a* are upstream of motor gas inlets 116*b*, and motor gas outlets 120*b* are upstream of motor gas inlets 116*c*. Each pneumatic motor 108 expands the gas flow in order to convert a portion of the gas flow energy to mechanical power. As a result, each downstream series motor stage 424 receives a gas inflow with lower pressure and higher volumetric flow rate than the preceding upstream series motor stage 424. For example, the gas inflow to series motor stage 424*b* has lower pressure and greater volumetric flow rate than the gas inflow to series motor stage 424*a*, and the gas inflow to series motor stage 424*c* has lower pressure and greater volumetric flow rate than the gas inflow to series motor stage 424*b*.

Each pneumatic motor 108 has an expansion ratio ($r_{exp}$), which refers to the volumetric expansion of the gas between the motor gas outlet 120 and the motor gas inlet 116. For example, the expansion ratio of a rotary vane motor may be determined based on rotor center offset, stroke distance, and diameter. The expansion ratio for pneumatic motors 108 is typically greater than 1, which means that the gas flow undergoes volumetric expansion as it moves from the motor gas inlet 116 to the motor gas outlet 120.

Each pneumatic motor 108 also has an inflow volumetric displacement per revolution ($v_{rev}$), which is the volume of gas flow into the motor gas inlet 116 per revolution of the pneumatic motor 108. The outflow volumetric displacement from the motor gas outlet 120 per revolution is equal to the inflow volumetric displacement per revolution times the expansion ratio ($v_{rev} \times r_{exp}$). Accordingly, the inflow volumetric flow rate for each pneumatic motor 108 is the inflow volumetric displacement per revolution times the motor speed (e.g. RPM) ($v_{rev} \times s$), and the outflow volumetric flow rate discharged from each pneumatic motor 108 is the outflow volumetric displacement per revolution times the motor speed ($v_{rev} \times r_{exp} \times s$). The inflow volumetric rate for a series motor stage 424 is the sum of all the inflow volumetric flow rates of all pneumatic motors 108 in that stage ($\Sigma(v_{rev} \times s)$) and the outflow volumetric flow rate for a series motor stage 424 is the sum of all the outflow volumetric flow rates of all pneumatic motors 108 in that stage ($\Sigma(v_{rev} \times r_{exp} \times s)$).

Each pair of adjacent series motor stages 424 has a capacity ratio ($r_{cap}$). The capacity ratio is equal the inflow volumetric flow rate of the downstream series motor stage 424, divided by the outflow volumetric flow rate of the upstream series motor stage 424:

$$r_{cap} = \frac{\sum (v_{rev} \times s)_{downstream}}{\sum (v_{rev} \times r_{exp} \times s)_{upstream}}$$

Best efficiency may be obtained where the capacity ratio of all adjacent series motor stages 424 (e.g. $r_{cap}$ for series motor stages 424*a* and 424*b*, and $r_{cap}$ for series motor stages 424*b* and 424*c*) is equal to 1. This means that the volumetric output from the upstream series motor stage 424 is exactly equal to the volumetric input through the downstream series motor stage 424. At a theoretical capacity ratio of less than 1 (or close to 1), the upstream series motor stage 424 can deliver sufficient gas flow for the downstream motor stage 424 to operate at steady-state conditions. In practice, however, capacity ratio is affected by variables such as ambient temperature. Accordingly, the capacity ratio for a pair of fluidly adjacent series motor stages 424 may be estimated based on the expected operating environment.

A high capacity ratio (e.g. greater than 1) will result in the upstream series motor stage 424 being unable to deliver sufficient volumetric flow rate to allow the downstream series motor stage 424 to operate at its full potential. As a result, the downstream series motor stage 424 may remain available to receive greater volumetric gas flow and provide greater power output. In some embodiments, gas flow to the downstream series motor stage 424 may be supplemented by bypass gas flow supplied by a valve, such as directional control valve 436 described below in connection with FIGS. 17 and 18, in order to provide additional power output from the downstream series motor stage 424 as needed.

Figure 14:
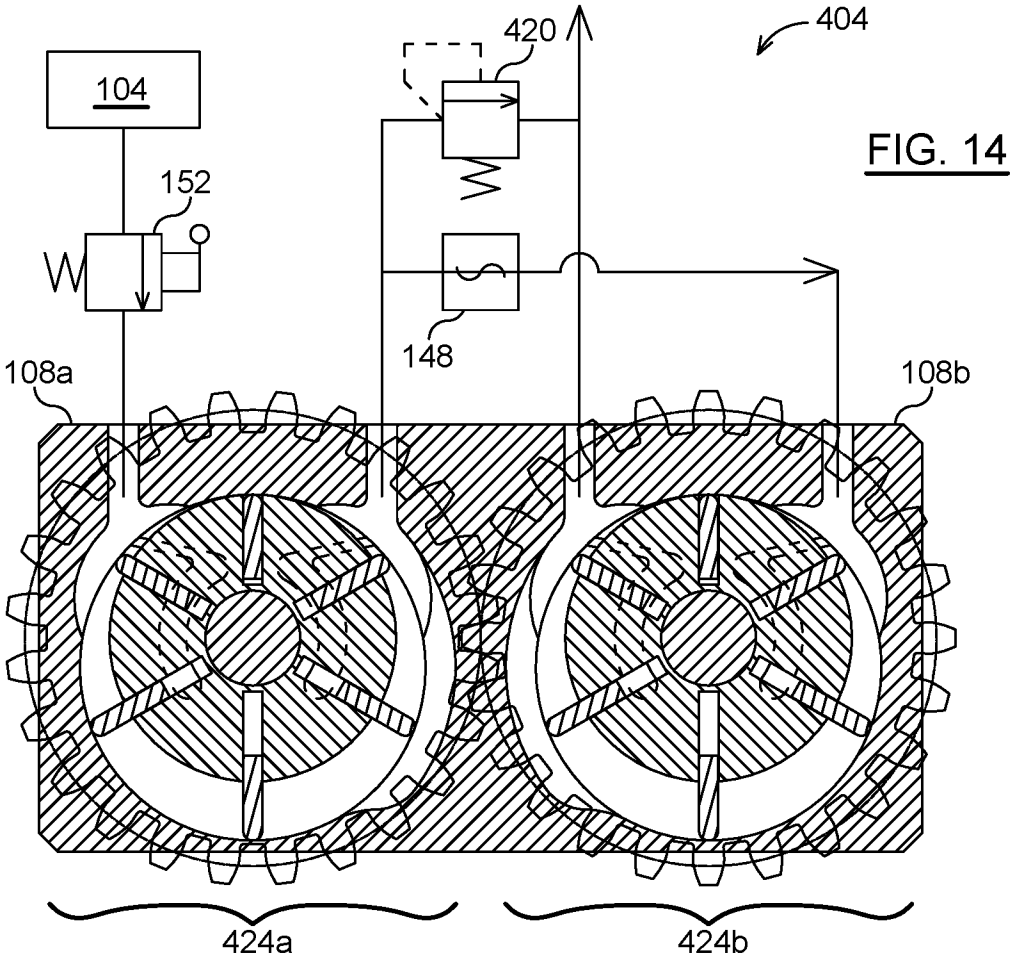
FIG. 14 is a schematic view of a pneumatic motor assembly in accordance with another embodiment.

A small capacity ratio (e.g. less than 1) will result in the downstream series motor stage 424 limiting or controlling the expansion ratio and volumetric gas flow rate through the upstream series motor stage 424. That is, the gas flow rate through the upstream motor stage 424 will be limited by the gas flow rate through the downstream motor stage 424, whereby the outflow volumetric flow rate of the upstream series motor stage 424 equals the inflow volumetric flow rate of the downstream volumetric motor stage 424. Referring to FIG. 14, expansion valve 420 can help to manage the situation. When expansion valve 420 opens, the expansion ratio of upstream series motor stage 424 can increase allowing the upstream series motor stage 424 to converts more gas flow energy to mechanical power.

It will be appreciated that each series motor stage 424 and each pneumatic motor 108 within pneumatic motor assembly 404 can have the same or different expansion ratios. Further, each pair of adjacent series motor stages 424 can have the same or different capacity ratio. In some embodiments, downstream pair(s) of adjacent series motor stages 424 may have a greater capacity ratio than upstream pair(s) of adjacent series motor stages 424. For example, the capacity ratio between series motor stages 424*a* and 424*b* may be less than the capacity ratio between series motor stages 424*b* and 424*c*, which may be about 1.

The relative speed (e.g. RPM) of pneumatic motors 108 contributes to the volumetric flow rate through the pneumatic motors 108, and therefore through series motor stages 424, and ultimately the capacity ratio of fluidly adjacent series motor stages 424. Accordingly, one way to influence the capacity ratio of adjacent series motor stages 424 is by selecting the relative speed of the pneumatic motors 108 they contain. In the illustrated example, the pneumatic motors 108 of series motor stages 424*a*, 424*b*, and 424*c* are mechanically connected by rotor gears 132*a*, 132*b*, and 132*c*. As shown, rotor gears 132*a*, 132*b*, 132*c* may have different diameters, which results in the meshed gears rotating at different speeds. In other embodiments, rotor gears 132 may not mesh with each other. For example, rotor gears 132 may mesh with drive gear 128, or there may be one or more idle gears between rotor gear 132 and drive gear 128.

FIG. 14 shows an example of a pneumatic motor assembly 404 including series motor stages 424. In the illustrated example, each series motor stage 424 includes one pneumatic motor 108, the pneumatic motors 108 are identical, and the pneumatic motors 108 are synchronized to rotate at the same speed by rotor gears 132 of the same size. Accordingly, an example of adjacent series motor stages 424 having a capacity ratio of less than 1 is shown. In fact, the capacity ratio in this example is the inverse of the expansion ratio ($1/r_{exp}$).

In the illustrated example, downstream motor stage 424*b* is shown including an expansion valve 420 in parallel with pneumatic motor 108*b*. Alternatively, expansion valve 420 may be described as positioned downstream of motor stage 424*a* in parallel with series motor stage 424*b* (depending on which components are identified as belonging to series motor stage 424*b*). Expansion valve 420 acts to expand gas discharged from pneumatic motor 108*a*. Thus, expansion valve 420 can improve the energy conversion efficiency of pneumatic motor assembly 404 when there is a capacity ratio of less than 1. Alternatively or in addition, expansion valve 420 may be operated to adjust gas flow through the adjacent series motor stages 424*a* and 424*b*, as a means of controlling the speed or power output of pneumatic motor assembly 404. In some embodiments, expansion valve 420 exhausts gas flow to a gas reservoir, such as to buffer 410 (FIG. 12), or to low-pressure reservoir 412 (FIG. 12). As noted above, expansion valve 420 may be considered to be an element of downstream series motor stage 424*b*. Motor 108*b* may exhibit a fixed expansion ratio while expansion valve 420 may operate to change the overall expansion ratio of the downstream series motors stage 424*b*. As a result, expansion valve 420 can be operated to change the capacity ratio between series motor stages 424*a* and 424*b*. Therefore, expansion valve 420 can configure pneumatic motor assembly 404 to provide a range of power outputs and energy conversion efficiencies.

In some embodiments, expansion valve 420 is configured to open in response to the pressure of gas exiting series motor stage 424*a*. This can allow expansion valve 420 to operate automatically to regulate (or compensate for) a capacity ratio between the series motor stages 424*a* and 424*b* that is less than 1. Alternatively, or in addition, expansion valve 420 may be communicatively coupled to controller 156, whereby flow controller 156 may direct the position of expansion valve 420 (e.g. between fully closed and fully open). In some cases, controller 156 may direct expansion valve 420 to a fully closed or partially closed position to reduce gas flow through the upstream series motor stage 424*a*. When expansion valve 420 is in the fully closed position, the gas flow through the upstream series motor stage 424*a* may be limited by the flow capacity of the downstream series motor stage 424*b*.

It will be appreciated that when there is little or no gas expansion through upstream series motor stage 424*a*, some high torque power output will result. Pneumatic motor assembly 404 can include additional series motor stages 424 (each of which can include any number of pneumatic motors 108 or any size (e.g. diameter and length)), and there can be an expansion valve 420 for each pair of fluidly adjacent series motor stages 424. Further, rotor gears 132 may have different diameters (e.g. pitch diameters) to allow the meshed gears to rotate at different speeds.

Still referring to FIG. 14, pneumatic motor assembly 404 may include a heater 148 positioned between series motor stage 424*a* and series motor stage 424*b*. Alternatively, series motor stage 424*b* may be described as including heater 148 upstream of pneumatic motor 108 (depending on which components are identified as belonging to series motor stage 424*b*). Heater 148 can be activated, such as by flow controller 156 (FIG. 12) to heat the gas flow to pneumatic motor 108*b* to increase the gas flow energy for pneumatic motor 108*b* to operate efficiently.

In an exemplary embodiment, the pneumatic motor assembly 404 of FIG. 13 may be fluidly connected in series with and downstream of the pneumatic motor assembly 404 of FIG. 14. In this example, the capacity ratio of the fluidly adjacent series motor stages 424*a* and 424*b* of FIG. 14 may be less than 1, and the capacity ratio of the downstream pairs of fluidly adjacent series motor stages 424 may increase sequentially. The capacity ratios may increase sequentially according to the number of series motor stages 424, gas expansion control in each adjacent series motor stage 424 (which may follow a curve or other pattern for energy efficiency), or the types of pneumatic motors 108 in each series motor stage 424 (e.g. one or more gerotor and/or piston type motors may be in one or more upstream series motor stages 424, and one or more screw rotor and/or turbine type motors may be in one or more downstream series motor stages 424).

It will be appreciated that an input gas flow (to the first of a series of series motor stages 424) having a high pressure (e.g. 500 psi or greater) may be capable of driving a relatively greater number of series motor stages 424. This may be suitable for relatively larger applications, such as in vehicles and high capacity electric generators for example. Similarly, an input gas flow (to the first of a series of series motor stages 424) having a low pressure (e.g. 100 psi or less) may be capable of driving a relatively fewer number of series motor stages 424. This may be suitable for relatively smaller applications, such as power tools, and applications that may require lower pressure gas for safety reasons (e.g. engines for residential heating systems and electricity generation).

Figure 14B:
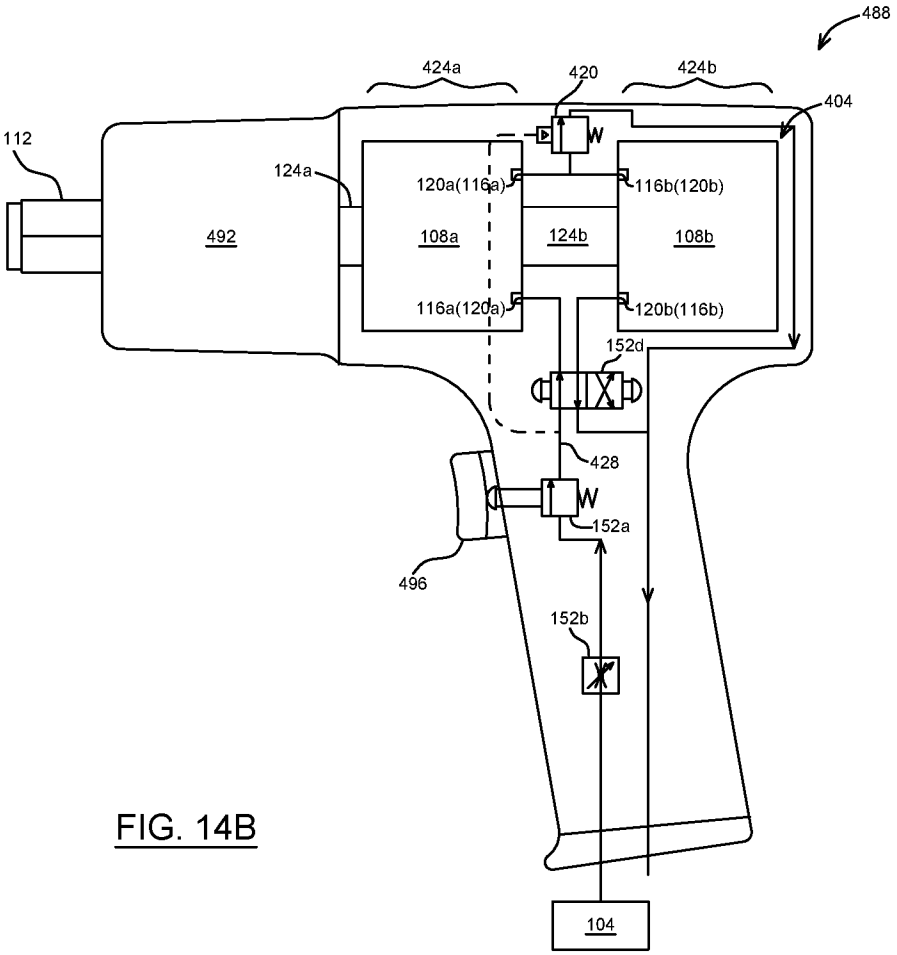
FIG. 14B is a schematic illustration of a pneumatic power tool in accordance with another embodiment.

Reference is now made to FIG. 14B, which shows a schematic illustration of a pneumatic power tool 488 in accordance with an embodiment. Pneumatic power tool 488 includes a pneumatic motor assembly 404, which may be similar to any pneumatic motor assembly 100 or 404 disclosed herein. In the illustrated example, pneumatic motor assembly 404 is similar to pneumatic motor assembly 404 of FIG. 14. As shown, pneumatic motor assembly 404 may receive an input gas flow from a gas source 104, which may be any gas source disclosed herein including, for example a shop air supply, a gas compressor, or a compressed gas cylinder. Depending on the function of pneumatic power tool 488, gas source 104 may supply relatively low pressure gas (e.g. 100 psi or less).

Still referring to FIG. 14B, pneumatic power tool 488 is shown including two pneumatic motors 108*a* and 108*b* which are fluidly connected in series. As shown, an expansion valve 420 may be positioned between pneumatic motors 108*a* and 108*b*. Expansion valve 420 may be manually operable (i.e. by hand) to selectively vent some or all of the gas flow between pneumatic motors 108*a* and 108*b*. For example, the user may operate expansion valve 420 to selectively operate pneumatic power tool 488 with greater power or greater efficiency. In other embodiments, expansion valve 420 may be automatically opened in response to gas pressure at motor gas inlet 116*a* or motor gas outlet 120*a*. For example, if pneumatic motor 108*a* is rotating slowly or stopped (e.g. due to a high torque situation), then the pressure at motor gas inlet 116*a* may increase and trigger expansion valve 420 to open, thereby allowing for greater gas expansion across pneumatic motor 108*a*.

In the illustrated example, pneumatic power tool 488 includes a valve 152*d* that is selectively operable (e.g. manually by hand) to reverse the flow of gas through pneumatic motors 108*a* and 108*b*, and thereby reverse the rotary direction of drive shaft 112. For this reason, the inlet and outlet ports of pneumatic motors 108 have been labelled with additional reference numbers in parenthesis due to the reversible nature of the gas flow. In the illustrated position of valve 152*d*, pneumatic motor 108*a* is upstream of pneumatic motor 108*b* and 'forward torque' is generated at drive shaft 112. In the other position of valve 152*d*, pneumatic motor 108*b* is upstream of pneumatic motor 108*a* and 'reverse torque' is generated at drive shaft 112. In some embodiments, the reverse torque may be greater than the forward torque. This may be the case where, for example pneumatic motor 108*b* has greater flow capacity (e.g. greater inflow volumetric displacement per revolution) than pneumatic motor 108*a*.

Pneumatic power tool 488 may include a gas valve 152*a* that is manually user operable (e.g. by squeezing trigger 496) to fluidly connect pneumatic motor assembly 404 to gas source 104 (and thereby activate pneumatic power tool 488). In the illustrated example, gas valve 152*a* is shown as having two positions: an off position in which gas flow is stopped and an on position in which gas flows through freely. Optionally, gas valve 152*a* may have intermediary positions in which gas is partially inhibited. This allows the user to selectively control the rate of gas flow to pneumatic motor assembly 404. Trigger 496 can be any device that allows for manual user operation of gas valve 152*a*.

In some embodiments, gas valve 152*a* has an off position, and a plurality of on positions. For example, gas valve 152*a* may be manually operated to select a first on position that supplies gas to pneumatic motors 108*a* and 108*b* in series, and a second on position that also supplies bypass gas to pneumatic motor 108*b* in parallel with pneumatic motor 108*a*. The first on position may provide greater gas efficiency, while the second on position may provide greater output power for the power tool 488.

Returning to FIG. 14B, pneumatic motors 108*a* and 108*b* are shown having motor rotors 124*a* and 124*b* that are connected in series. As shown, motor rotor 124*b* may be aligned in parallel with (e.g. collinear with) and connected to motor rotor 124*a*, which may be drivingly connected to output drive shaft 112. A transmission 492 (e.g. a gear box or impact mechanism) may connect motor rotor 124*a* to output drive shaft 112, depending on the configuration and type of pneumatic power tool 488. In some embodiments, pneumatic power tool 488 may include additional pneumatic motors 108, which may be arranged in series motor stages, such as is described herein in connection with other pneumatic motor assemblies 100 and 404.

Figure 15:
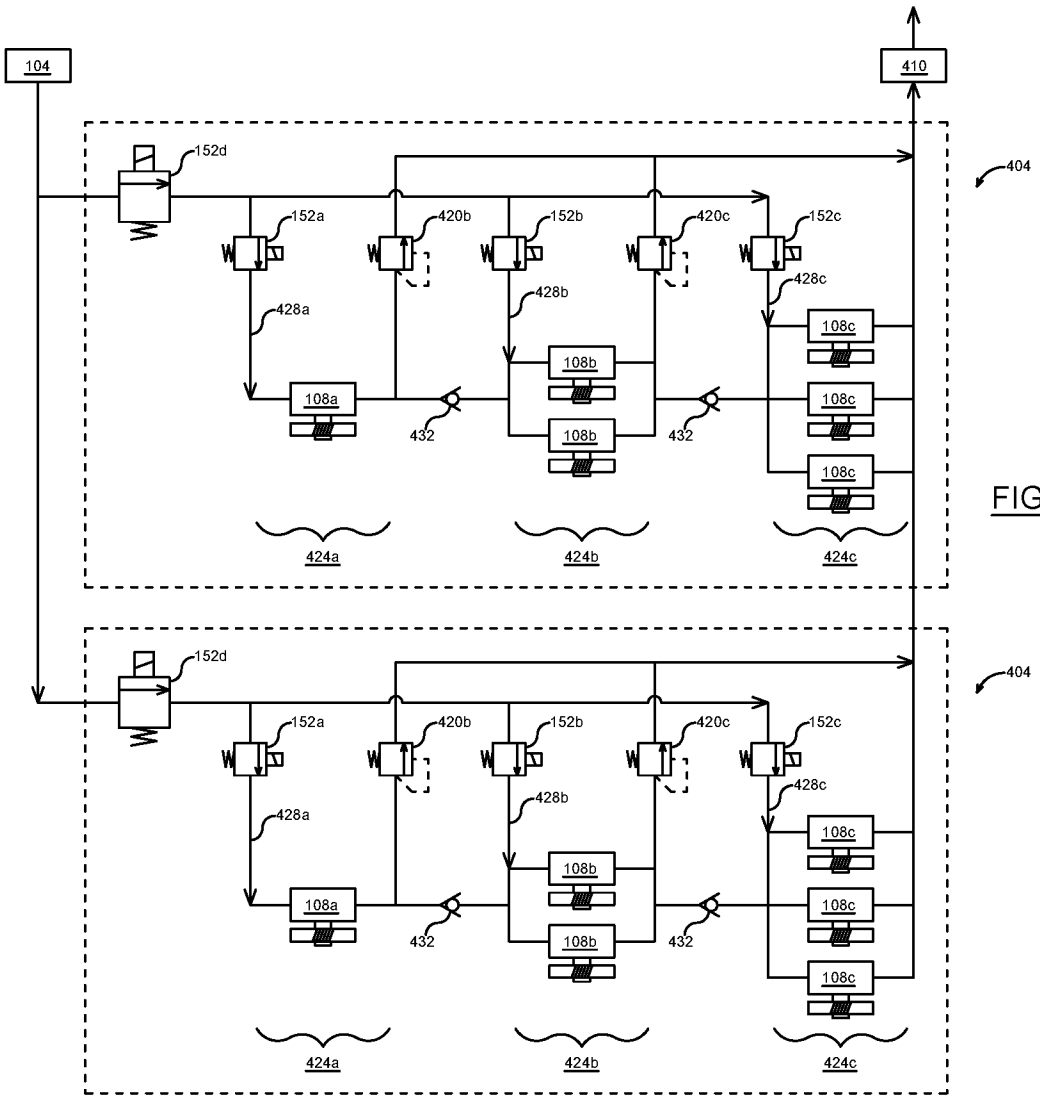
FIG. 15 is a schematic view of two pneumatic motor assemblies in accordance with another embodiment.

Reference is now made to FIG. 15, which shows two pneumatic motor assemblies 404 in accordance with another embodiment. Each pneumatic motor assembly 404 can include any number of series motor stages 424 (including just one series motor stage 424), and each series motor stage can include any number of pneumatic motors 108 (including just one pneumatic motor 108). In the illustrated example, each pneumatic motor assembly 404 (denoted by dashed-line rectangles) includes three series motor stages 424 fluidly connected in series. Each series motor stage 424*a* is shown including one pneumatic motor 108*a*, each series motor stage 424*b* is shown including two pneumatic motors 108*b* fluidly connected in parallel, and each series motor stage 424*c* is shown including three pneumatic motors 108*c* fluidly connected in parallel. In alternative embodiments, pneumatic engine 400 (FIG. 12) may include any number of pneumatic motor assemblies 404, such as three or more pneumatic motor assemblies 404.

In the illustrated embodiment, series motor stage 424*b* and an expansion valve 420*b* are fluidly positioned in parallel downstream of series motor stage 424*a*. Similarly, series motor stage 424*c* and an expansion valve 420*c* are fluidly positioned in parallel downstream of series motor stage 424*b*. As describe above with reference to FIG. 14, expansion valves 420 operate to provide pneumatic motor assembly 404 with better efficiency in converting gas flow energy to mechanical power. Alternatively or in addition, expansion valves 420 may be selectively operated to control the gas flow through the upstream series motor stage 424, as described above with reference to FIG. 14. Still referring to FIG. 15, the illustrated embodiment further includes check valves 432 between the series motor stages 424. When the check valve 432 is closed, the exhaust gas from an upstream series motor stage only flows through an expansion valve 420. In this circumstance, the expansion valve 420 has control over the gas flow through the upstream series motor stage 424.

Still referring to FIG. 15, in some embodiments pneumatic motor assembly 404 is controllable to deactivate (i.e. cease gas flow through) one or more of the series motor stages 424. As shown, pneumatic motor assembly 404 may include one or more gas valves 152 that are collectively operable to allow, inhibit or restrict gas flow to one or more of the series motor stages 424. For example, gas valves 152 may be communicatively coupled to flow controller 156 (FIG. 12), which can direct the position of gas valves 152 (e.g. open, closed, partially opened, or in continual movement) in accordance with the operating conditions of the pneumatic engine 400 (FIG. 12). In general, flow controller 156 (FIG. 12) may direct the position of gas valves 152 to allow gas flow through all series motor stages 424 where high power output is required (e.g. for vehicle acceleration). Also, flow controller 156 (FIG. 12) may direct the position of gas valves 152 to inhibit gas flow through one or more series motor stages 424 (i.e. to allow gas flow through a subset of series motor stages 424) where lesser power output is required.

Pneumatic motor assembly 404 may include any number and configuration of gas valves 152 that can collectively operate to inhibit or restrict gas flow to one or more of the series motor stages 424, while allowing gas flow to one or more other series motor stages 424. In the illustrated example, a gas valve 152 is positioned upstream of each series motor stage 424 on a series motor stage inlet line 428 that supplies pressurized gas to the respective series motor stage 424. As shown, a gas valve 152*a* is positioned upstream of series motor stage 424*a* on an inlet line 428*a*, a gas valve 152*b* is positioned upstream of series motor stage 424*b* on an inlet line 428*b* that connects to the gas flow path between series motor stages 424*a* and 424*b*, and a gas valve 152*c* is positioned upstream of series motor stage 424*c* on an inlet line 428*c* that connects to the gas flow path between series motor stages 424*b* and 424*c*. Each inlet line 428 may be fluidly connected downstream of gas source 104 (FIG. 12).

Still referring to FIG. 15, gas valves 152 may be opened, closed, or partially opened (e.g. by flow controller 156, FIG. 12) in various combinations to achieve different results, according to the operating conditions of pneumatic engine 400 (FIG. 12). For example, opening only gas valve 152*a* allows gas to flow through all three series motor stages 424, opening only gas valve 152*b* allows gas to flow through only series motor stages 424*b* and 424*c*, and opening only gas valve 152*c* allows gas to flow through only series motor stage 424*c*. As shown, check valves 432 may be provided between series motor stages 424, to prevent the gas flow from reversing towards an upstream series motor stage 424. When a check valve 432 between series motor stages 424 is closed, the downstream series motor stage 424 becomes fluidly connected to gas source 104 in parallel with the upstream series motor stage 424.

In the illustrated example, opening or partially opening two or more gas valves 152 allows gas flow through two or more series motor stages 424, and also adds supplemental gas flow through one or more downstream series motor stages 424. For example, opening gas valves 152*b* and 152*c* allows gas flow from inlet line 428*b* through series motor stages 424*b* and 424*c* and allows supplemental gas flow from inlet line 428*c* through series motor stage 424*c*. As shown, gas valves 152 may be positioned in parallel relative to gas source 104. Opening gas valve 152*b* will provide supplemental gas flow that enhances the gas flow energy through downstream series motor stage 424*b*. If gas valve 152*b* opens sufficiently, the gas pressure entering downstream series motor stage 424*b* may rise above the gas pressure of the gas flow exiting upstream series motor stage 424*a*, such that check valve 432 closes and stops upstream series motor stage 424*a* from exhausting to downstream series motor stage 424*b*. In this case, downstream series motor stage 424*b* may receive gas from gas source 104 only through gas valve 152*b*. The enhance gas flow energy allows pneumatic motor assembly 404 to output more power and acceleration. Series motor stage 424*a* exhausts gas to buffer 410 through expansion valve 420*b*, which also allows series motor stage 424*a* to output greater power. Gas valve 152*b* can operate to supply gas from gas source 104 to series motor stage 424*b* that bypasses series motor stage 424*a*. In some cases, series motor stage 424*a* is reduced (e.g. by closing gas valve 152*a*). Gas valve 152*c* operates similarly to gas valve 152*b*.

Figure 16:
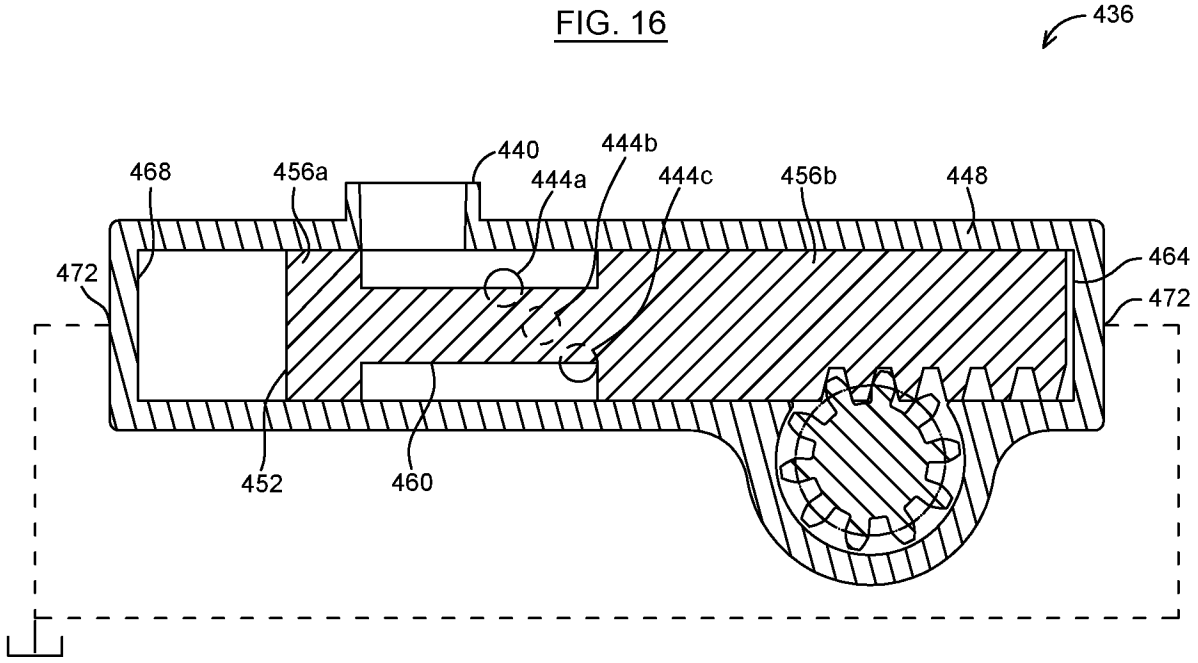
FIG. 16 is a schematic cross-sectional view of a directional control valve in accordance with at least one embodiment.

FIG. 16 shows an example of a directional control valve 436, which may be used to selectively direct gas flow to one or more of a plurality of series motor stages. Directional control valve 436 includes at least one gas inlet 440, and a plurality of gas outlets 444. In some embodiments, gas inlet 440 may be positioned downstream of gas source 104 (FIG. 12), and gas outlets 444 may be positioned upstream of different series motor stages 424 (FIG. 15).

Directional control valve 436 is operable to selectively direct gas from the one or more gas inlets 440 to none, one, or a plurality (or all) of the gas outlets 444. In the illustrated example, directional control valve 436 includes a hollow casing 448 that houses a spool 452. The casing 448 is shown including the gas inlet 440 and the plurality of gas outlets 444 which are fluidly connected by the hollow interior of the casing 448. The spool 452 includes one or more lands 456 and one or more grooves 460, which define gas flow paths between gas inlet 440 and gas outlet 444. In the illustrated example, spool 452 includes two lands 456*a* and 456*b* that act to block gas flow past spool 452, and one groove 460 that allows gas to flow around spool 452.

Spool 452 is movable within casing 448 to reposition lands 456 and spool 460 with respect to inlet 440 and outlet 444. A gas flow path is formed between gas inlet 440 and gas outlet 444 when spool 452 is moved so that the groove 460 aligns with the gas inlet 440 and the gas outlet 444. In the illustrated example, spool 452 has four positions. The fully open position is shown, in which spool 452 is moved to casing first end 464 such that groove 460 is aligned with inlet 440 and all three gas outlets 444. In this position, inlet 440 is fluidly connected upstream of all three gas outlets 444. Spool 452 can be moved all the way to second end 468 to the fully closed position, such that land 456*b* is aligned with all three gas outlets 444. In this position, inlet 440 is fluidly disconnected from all three gas outlets 444.

Spool 452 can also be moved between the first and second ends 464 and 468 to a first position in which groove 460 is aligned with inlet 440 and gas outlet 444*a*, and land 456*b* is aligned with gas outlet 444*b* and 444*c*. In this position, inlet 440 is fluid connected upstream of only gas outlet 444*a*. Spool 452 can also be moved to a second position in which groove 460 is aligned with inlet 440 and gas outlets 444*a* and 444*b*, and land 456*b* is aligned with gas outlet 444*c*. In this position, inlet 440 is fluidly connected upstream of only gas outlets 444*a* and 444*b*.

Directional control valve 436 can be configured to move spool 452 in any manner. For example, spool 452 may be movable between positions manually (e.g. by a user-actuated manual control), mechanically (e.g. by geared motor), hydraulically, or by solenoid. In some embodiments, directional control valve 436 may include leak gas outlets 472, which direct any gas that may leak from inside casing 448 to a downstream reservoir, such as buffer 410 (FIG. 12) or low pressure reservoir 412 (FIG. 12).

It will be appreciated that gas outlets 444 may be all of the same size, or they may have different sizes depending on the flow rate of gas flow to be moved through the particular gas outlet 444. For example, a large size (i.e. large cross-sectional area) gas outlet 444 may be used to supply a series motor stage with a large inflow volumetric flow rate.

Figure 17A:
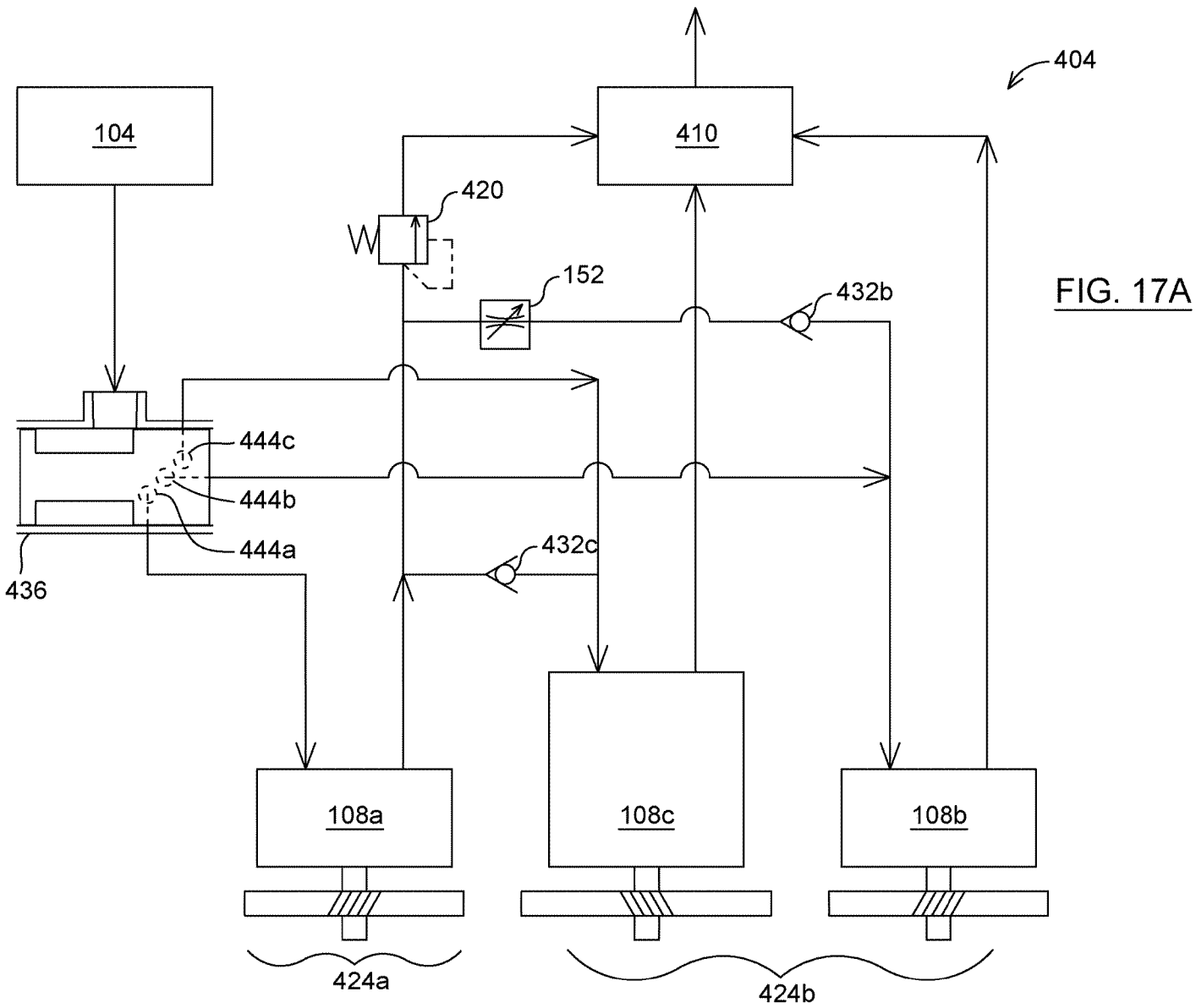
FIG. 17A is a schematic view of a pneumatic motor assembly in accordance with another embodiment.

Reference is now made to FIG. 17A, which shows a pneumatic motor assembly 404 in accordance with another embodiment. In the example shown, pneumatic motor assembly 404 includes a series motor stage 424*a* including pneumatic motor 108*a*, and a series motor stage 424*b* including pneumatic motors 108*b* and 108*c*. Pneumatic motors 108*b* and 108*c* are fluidly connected in parallel, and series motor stage 424*a* is fluidly connected upstream of series motor stage 424*b*.

Pneumatic motor assembly 404 may include a directional control valve 436 for selectively fluidly connecting one or more (or all) of pneumatic motors 108 to gas source 104. Directional control valve 436 may be communicatively coupled to flow controller 156 (FIG. 12), which directs the position of directional control valve 436.

The directional control valve 436 is shown in a fully closed position, in which case none of pneumatic motors 108 are operational (i.e. none is downstream of gas source 104). Directional control valve 436 is movable to a first position in which gas discharges from outlet 444*a*, a second position in which gas discharges from outlets 444*a* and 444*b*, and a third position in which gas discharges from outlet 444*a*, 444*b*, and 444*c*. As shown, outlet 444*a* directly supplies gas to pneumatic motor 108*a*, outlet 444*b* supplies gas to pneumatic motor 108*b* bypassing pneumatic motor 108*a*, and outlet 444*c* supplies gas to pneumatic motor 108*c* bypassing pneumatic motors 108*a* and 108*b*. Thus, pneumatic motor assembly 404 generates more mechanical power when more gas outlets 444 are all opened. In use, directional control valve 436 may be moved (e.g. manually or by direction of flow controller 156, FIG. 12) from the first position towards the third position in order to generate additional mechanical power (e.g. to accelerate a vehicle).

In the first position, directional control valve 436 discharges gas flow to series motor stage 424*a* (pneumatic motor 108*a*), and the gas exhaust from series motor stage 424*a* (pneumatic motor 108*a*) flows to series motor stage 424*b* where it is divided between pneumatic motors 108*b* and 108*c*. An expansion valve 420 is positioned downstream of series motor stage 424*a* in parallel with series motor stage 424*b*. When directional control valve 436 discharges gas flow to one or both of pneumatic motors 108*b* and 108*c*, one or both of check valves 432*b* and 432*c* may close, and expansion valve 420 may open to expand exhaust gas from pneumatic motor 108*a*, whereby pneumatic motor 108*a* may convert more gas flow energy to mechanical power. As noted above with reference to FIG. 14, expansion valve 420 can help improve efficiency by accommodating for a capacity ratio less than 1 between the adjacent series motor stages 424. It will be appreciated that when downstream series motor stage 424*b* receive bypass gas from gas source 104 by way of valve 436 (i.e. gas that bypasses series motor stage 424*a*), the situation is similar to where there is a capacity ratio of less than 1 between the series motor stages 424*a* and 424*b*. In this circumstance, expansion valve 420 may act to control the gas flow rate and expansion ratio through series motor stage 424*a*. Directional control valve 436, flow control valve 152, expansion valve 420, and check valve 432 can be operated to change the effective capacity ratio between the series motor stages 424.

In the illustrated example, series motor stage 424*b* includes a flow control valve 152 upstream of pneumatic motor 108*b*. Flow control valve 152 acts to influence the division of gas flow between pneumatic motors 108*b* and 108*c* in series motor stage 424. Flow control valve 152 may have a fixed configuration, or may be adjustable. For example, flow control valve 152 may be communicatively coupled to flow controller 156 (FIG. 12) whereby flow controller 156 may direct the position of flow control valve 152 (e.g. between fully closed and fully open) to control the division of gas flow between pneumatic motors 108*b* and 108*c*. Alternatively or in addition, series motor stage 424*b* can include a flow control valve 152 upstream of pneumatic motor 108*c* to provide additional control over the division of gas flow between pneumatic motors 108*b* and 108*c*.

Still referring to FIG. 17A, in the second position, directional control valve 436 discharges gas to series motor stage 424*a*, as well as to pneumatic motor 108*b* of series motor stage 424*b*. This provides pneumatic motor 108*b* with greater fluid pressure, whereby pneumatic motor 108*b* can output greater mechanical power. A check valve 432*b* is positioned between upstream of pneumatic motor 108*b* between pneumatic motor 108*b* and pneumatic motor 108*a* to prevent gas flow from reversing direction. When the check valve 432 between pneumatic motors 108*a* and 108*b* is closed, pneumatic motors 108*b* may become fluidly connected to gas source 104 in parallel with pneumatic motor 108*a*.

In the third position, directional control valve 436 discharges gas to series motor stage 424*a*, as well as to each of pneumatic motors 108*b* and 108*c* of series motor stage 424*b*. This provides pneumatic motors 108*b* and 108*c* with greater fluid pressure, whereby pneumatic motors 108*b* and 108*c* can output greater mechanical power. A check valve 432*c* is positioned between upstream of pneumatic motor 108*c* between pneumatic motor 108*c* and pneumatic motor 108*a* to prevent gas flow from reversing direction. When the check valve 432 between series motor stages 424*a* and 424*b* is closed, series motor stage 424*b* may become fluidly connected to gas source 104 in parallel with series motor stage 424*a*.

As shown, pneumatic motors 108*b* and 108*c* may discharge gas to a downstream gas receptacle, such as buffer 410 (FIG. 12) or low pressure reservoir 412 (FIG. 12).

Figure 17B:
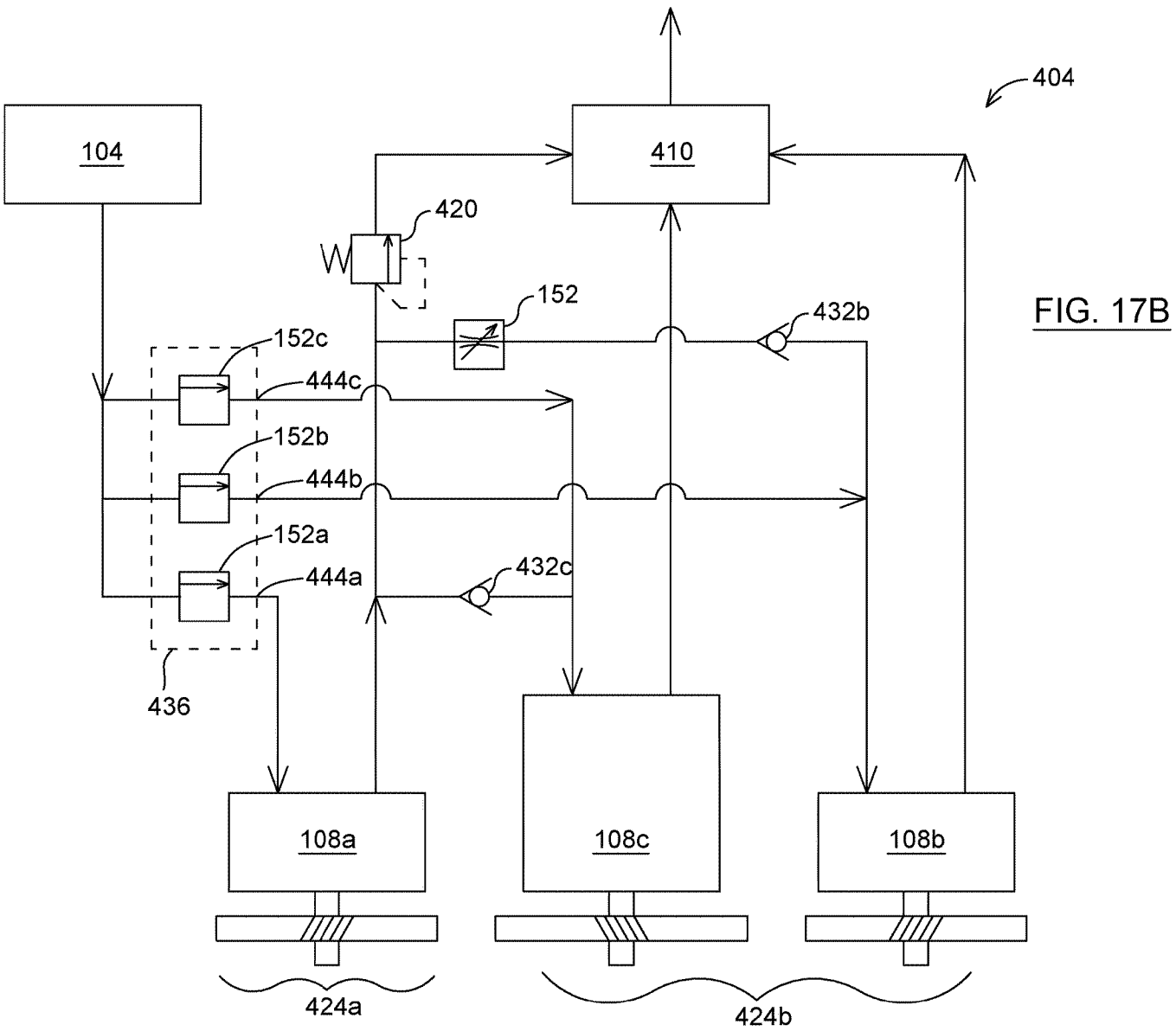
FIG. 17B is a schematic view of a pneumatic motor assembly in accordance with another embodiment.

It will be appreciated that directional control valve 436 may include any number of individual valves of any kind in any configuration that can allow for selective control over the discharge of gas to pneumatic motors 108. For example, FIG. 17B shows a directional control valve 436 including three individually operable valves 152*a*-152*c*, one for each of the gas outlets 444, such that none, all, or any sub-combination of the gas outlets 444 can be selectively opened according to the current operating condition (e.g. speed and torque requirements) of the pneumatic engine 400 (FIG. 12). In some embodiments, directional control valve 436 may be operable to partially restrict flow to individual pneumatic motors 108.

Pneumatic motor assembly 404 can include pneumatic motors 108 of any size (e.g. inflow volumetric flow rate) or combination of sizes, and of any type or combination of types. In the illustrated example, pneumatic motor 108*a* and 108*b* are of the same size, and pneumatic motor 108*c* is larger (e.g. in diameter, length, or both) than pneumatic motors 108*a* and 108*b*. Also, pneumatic motor assembly 404 can include any number of series motor stages 424, and each series motor stage 424 can include any number of pneumatic motors 108. For example, any one of pneumatic motors 108*a*, 108*b*, and 108*c* may be replaced by two or more pneumatic motors 108 or removed altogether. In some embodiments, pneumatic motors 108 may include piston-type motors. When piston-type motors are connected in series, an idle cylinder can capture energy from exhaust gas of a working cylinder to contribute power to the drive shaft during deactivation.

Figure 18A:
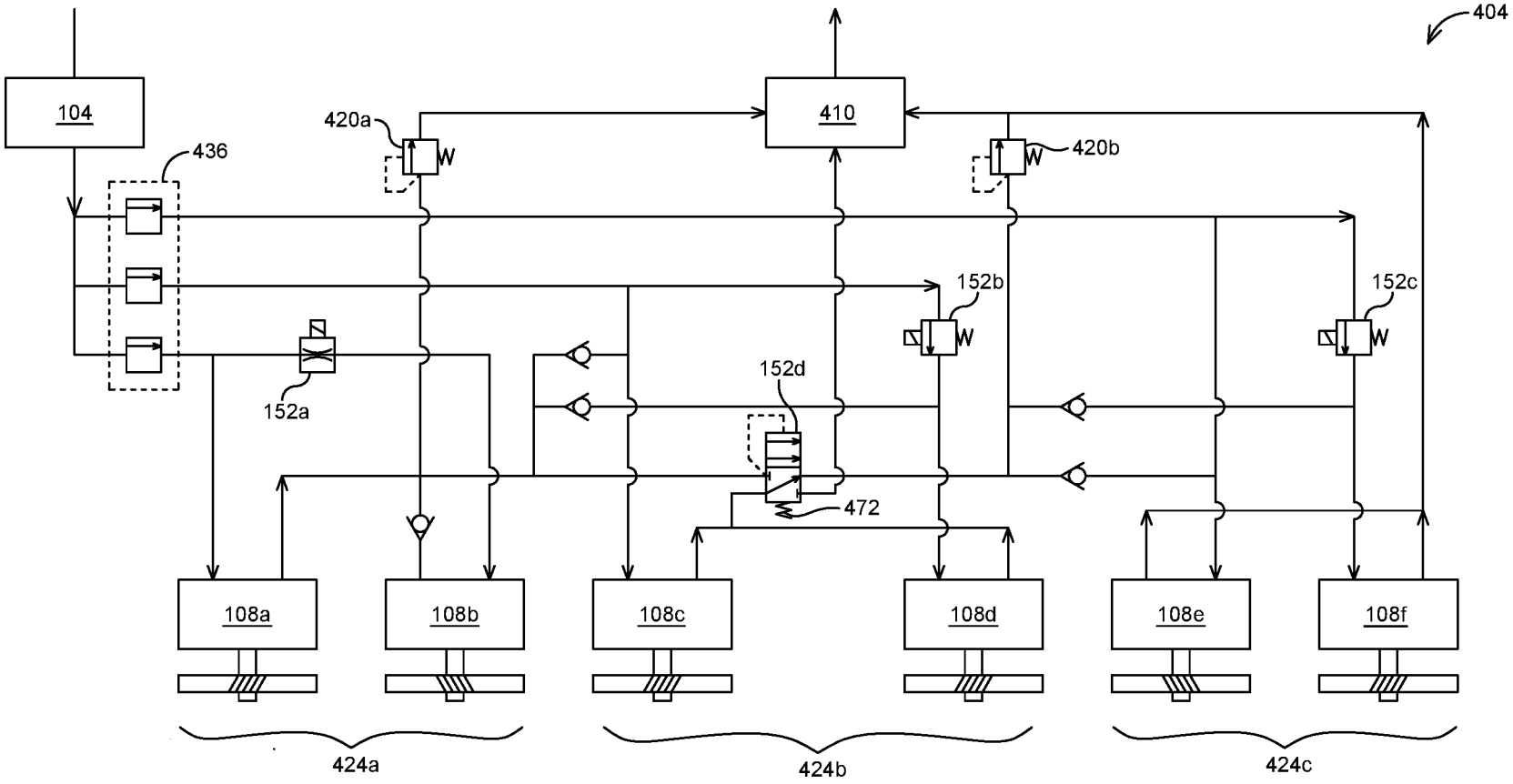
FIG. 18A is a schematic view of a pneumatic motor assembly in accordance with another embodiment, with a valve in a first position.

Reference is now made to FIG. 18A, which shows a pneumatic motor assembly 404 in accordance with another embodiment. In the illustrated example, pneumatic motor assembly 404 includes three series motor stages 424, each of which includes two parallel pneumatic motors 108. As with other examples of pneumatic motor assembly 404, there can be any number of series motor stages 424, each of which can include any number of pneumatic motors 108 of any type(s) and size(s).

Figure 18B:
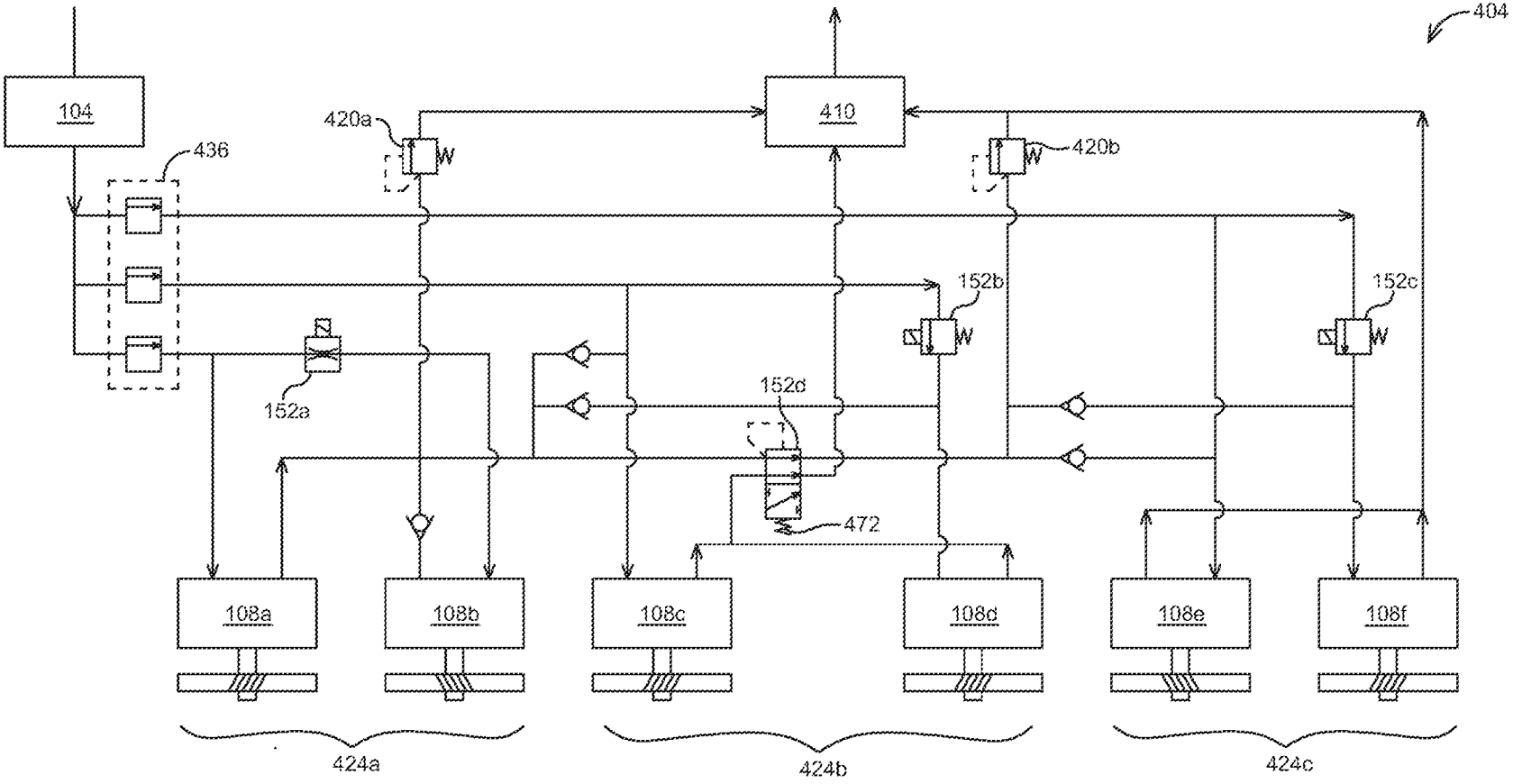
FIG. 18B is a schematic view of the pneumatic motor assembly of FIG. 18A with a valve in a second position.

As shown, series motor stage 424*a* is positioned upstream of series motor stages 424*b* and 424*c*. A valve 152*d* is provided that can be actuated (e.g. by fluid pressure as shown, or by flow controller 156, FIG. 12) to selectively fluidly connect series motor stages 424*b* and 424*c* in series or in parallel. FIG. 18A shows an example of valve 152*d* in a first position, in which motor stages 424*b* and 424*c* are connected in series. FIG. 18B shows an example of valve 152*d* in a second position, which motor stages 424*b* and 424*c* are connected in parallel.

Referring to FIG. 18A, series motor stage 424*a* is positioned upstream of series motor stage 424*b*, and series motor stage 424*b* is positioned upstream of series motor stage 424*c*. As shown, valve 152*d* directs exhaust gas from series motor stage 424*b* towards series motor stage 424*c* and prevents exhaust gas from series motor stage 424*a* from flowing to series motor stage 424*c* bypassing series motor stage 424*b*.

Referring to FIG. 18B, series motor stage 424*a* is positioned upstream of both series motor stages 424*b* and 424*c*, which are positioned in parallel. As shown, valve 152*d* directs a portion of exhaust gas from series motors stage 424*a* to series motor stage 424*b*, and directs another portion of exhaust gas from series motor stage 424*a* to series motor stage 424*c* bypassing series motor stage 424*b*. As shown, valve 152*d* also directs exhaust gas from series motor stage 424*b* to a downstream reservoir, such as buffer 410, instead of towards series motor stage 424*c*.

In some embodiments, valve 152*d* may be configured in its second position (whereby series motor stages 424*b* and 424*c* are positioned in parallel) where gas pressure between series motor stages 424*a* and 424*b* exceeds a predetermined pressure. For example, the pressure between series motor stages 424*a* and 424*b* may rise if series motor stage 424*b* cannot accommodate the volumetric gas flow exhausted by series motor stage 424*a* (e.g. the capacity ratio of series motor stages 424*a* and 424*b* is less than 1). In this case, valve 152*d* may move to the second position so that series motor stage 424*a* feeds exhaust gas to both series motor stages 424*b* and 424*c*, which may be together better able to accommodate the volumetric gas flow exhausted by series motor stage 424*a* (e.g. the capacity ratio of series motor stage 424*a* to series motor stages 424*b* and 424*c* combined is greater than the capacity ratio of series motor stage 424*a* to series motor stage 424*b* alone).

Valve 152*d* can be any number of passive or actively controlled devices that can be reconfigured between at least the first and second positions described above. For example, valve 152*d* may be a passive valve in which upstream fluid pressure acts against a first position bias 472 in order to move valve 152*d* to the second position. In other examples, valve 152*d* is an actively controlled valve (e.g. a solenoid valve) communicatively coupled to flow controller 156 (FIG. 12), which monitors the fluid pressure between series motor stages 424*a* and 424*b*, and directs valve 152*d* to move to the second position in response to a pressure reading above a predetermined value.

Still referring to FIG. 18A, pneumatic motor assembly 404 may include an expansion valve 420 between connected in parallel with downstream motor stages 424 which acts to expand exhaust gas discharged from upstream series motor stage 424, and as a result may provide pneumatic motor assembly 404 with better efficiency and ability in converting gas flow energy to mechanical power. In the illustrated example, an expansion valve 420*a* is positioned downstream of series motor stage 424*a* in parallel with series motor stage 424*b*, and an expansion valve 420*b* is positioned downstream of series motor stage 424*b* in parallel with series motor stage 424*c*.

In some embodiments, a series motor stage 424 may include one or more flow control valves 152 to control the gas flow to one or more pneumatic motors 108 within that series motor stage 424. In the illustrated embodiment, series motor stage 424*a* includes a flow control valve 152*a* positioned upstream of pneumatic motor 108*b* to control gas flow to pneumatic motor 108*b*. In the illustrated example, a flow control valve 152*a* is operable to control the gas flow to pneumatic motor 108*b*. It will be appreciated that pneumatic motor assembly 404 may include a plurality of pneumatic motors 108*b*, and flow control valve 152*a* may be operable to control gas flow to the plurality of pneumatic motors 108*b*.

Flow control valve 152*a* may have a fixed configuration, or may be adjustable. For example, flow control valve 152*a* may be communicatively coupled to flow controller 156 (FIG. 12) whereby flow controller 156 may direct the position of flow control valve 152*a* (e.g. between fully closed and fully open) to control the gas flow to pneumatic motor 108*b*.

In some embodiments, pneumatic motor assembly 404 may include a directional control valve 436 for selectively fluidly connecting one or more (or all) of pneumatic motors 108 to gas source 104 bypassing the upstream pneumatic motors 108. Directional control valve 436 may be communicatively coupled to flow controller 156, which directs the position of directional control valve 436. In the illustrated example, directional control valve 436 is selectively operable to direct gas from gas source 104 to series motor stage 424*a*, to series motor stage 424*b* bypassing series motor stage 424*a*, or to series motor stage 424*c* bypassing series motor stages 424*a* and 424*b*, and combinations thereof.

Gas directed by directional control valve 436 to a downstream series motor stage 424 bypassing upstream series motor stage(s) 424, may be directed to one or more (or all) of the pneumatic motors 108 within the downstream motor stage 424 in parallel. In the illustrated example, series motor stage 424*b* includes a valve 152*b* that is movable (e.g. by control of flow controller 156, FIG. 12) between an open position in which bypass gas from directional control valve 436 feeds pneumatic motors 108*c* and 108*d* in parallel, and a closed position in which bypass gas from directional control valve 436 feeds pneumatic motors 108*c* alone such that pneumatic motor 108*d* receives only exhaust from series motor stage 424*a*. Series motor stage 424*c* includes a similar valve 152*c*. It will be appreciated that when directional control valve 436 directs gas to a downstream series motor stage 424 bypassing an upstream series motor stage 424, that there will be reduced gas consumption by the upstream series motor stage 424. Thus, flow controller 156 can direct the position of valves 436 and 152 to regulate the gas consumption through series motor stages 424 for efficiency and according to demand.

Figure 19:
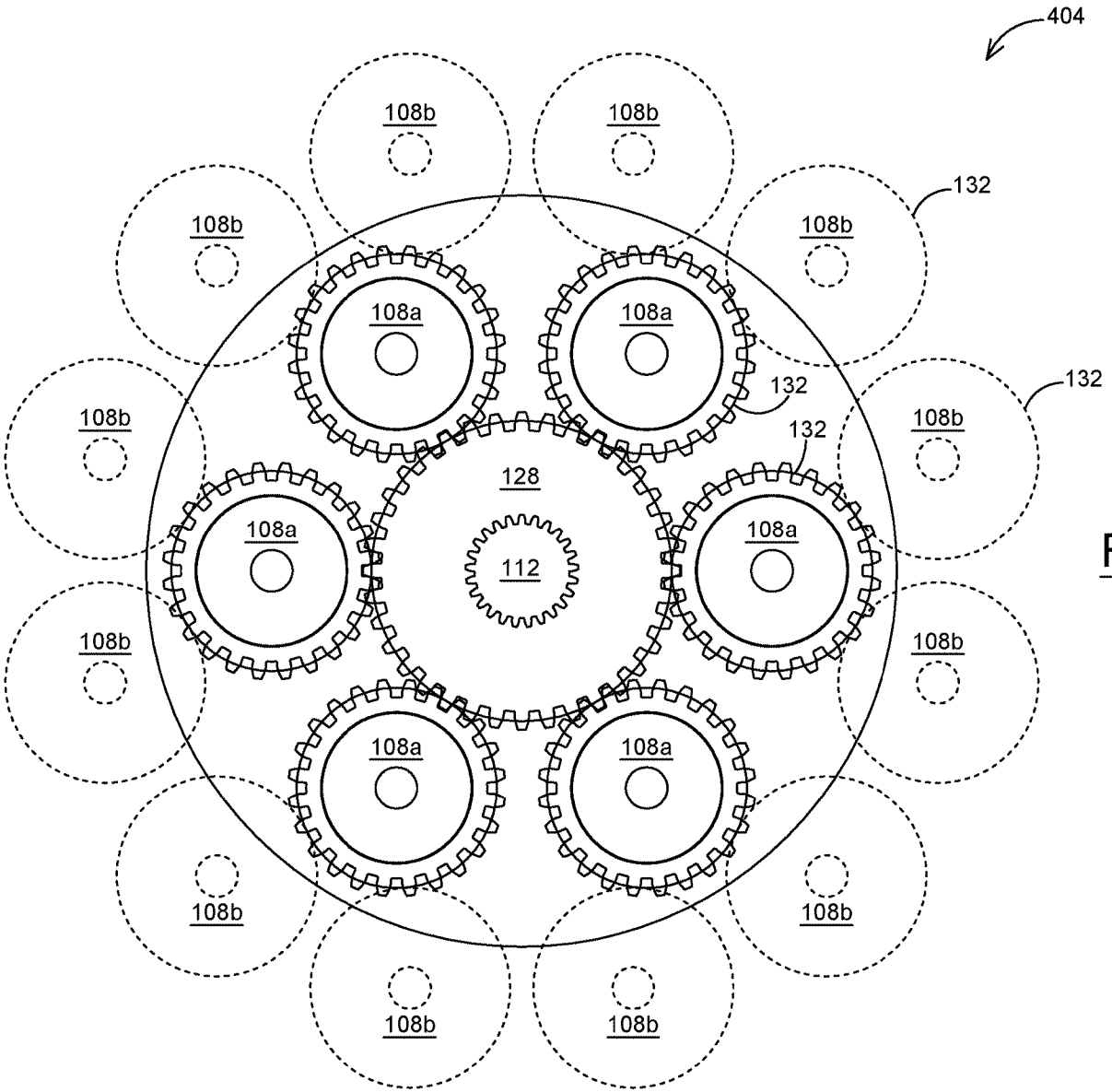
FIG. 19 is a schematic view of a pneumatic motor assembly in accordance with another embodiment.

Reference is now made to FIG. 19, which shows a pneumatic motor assembly 404 in accordance with another embodiment. As shown, pneumatic motor assembly 404 includes a plurality of pneumatic motors 108 that drive a drive shaft 112. In the illustrated example, pneumatic motors 108 are arranged in nested circular rows of mechanically connected pneumatic motors 108. As shown, pneumatic motors 108 may be drivingly coupled to drive shaft 112 by meshed gears 128 and 132.

Pneumatic motor assembly 404 can include any number of pneumatic motors 108, arranged into any number of nested circular rows. In the illustrated example, pneumatic motor assembly 404 includes an inner row of six pneumatic motors 108*a*, and an outer row of twelve pneumatic motors 108*b*. In the illustrated geared configuration, the rotor gear 132 of each pneumatic motor 108*a* meshes with drive gear 128, and two of the rotor gears 132 of pneumatic motors 108*b*. Rotor gears 132 of adjacent pneumatic motors 108 within a circular row are not meshed, which avoids locking the drive train.

Pneumatic motors 108 can be fluidly arranged into any number of series motor stages, which may be configured in any manner described herein. For example, the inner row of six pneumatic motors 108 may be fluidly connected similar to the six pneumatic motors 108 of FIG. 18. Similarly, the outer row of twelve pneumatic motors 108 may be fluidly connected similar to two instances of the six-pneumatic motor arrangement of FIG. 18.

Figure 20:
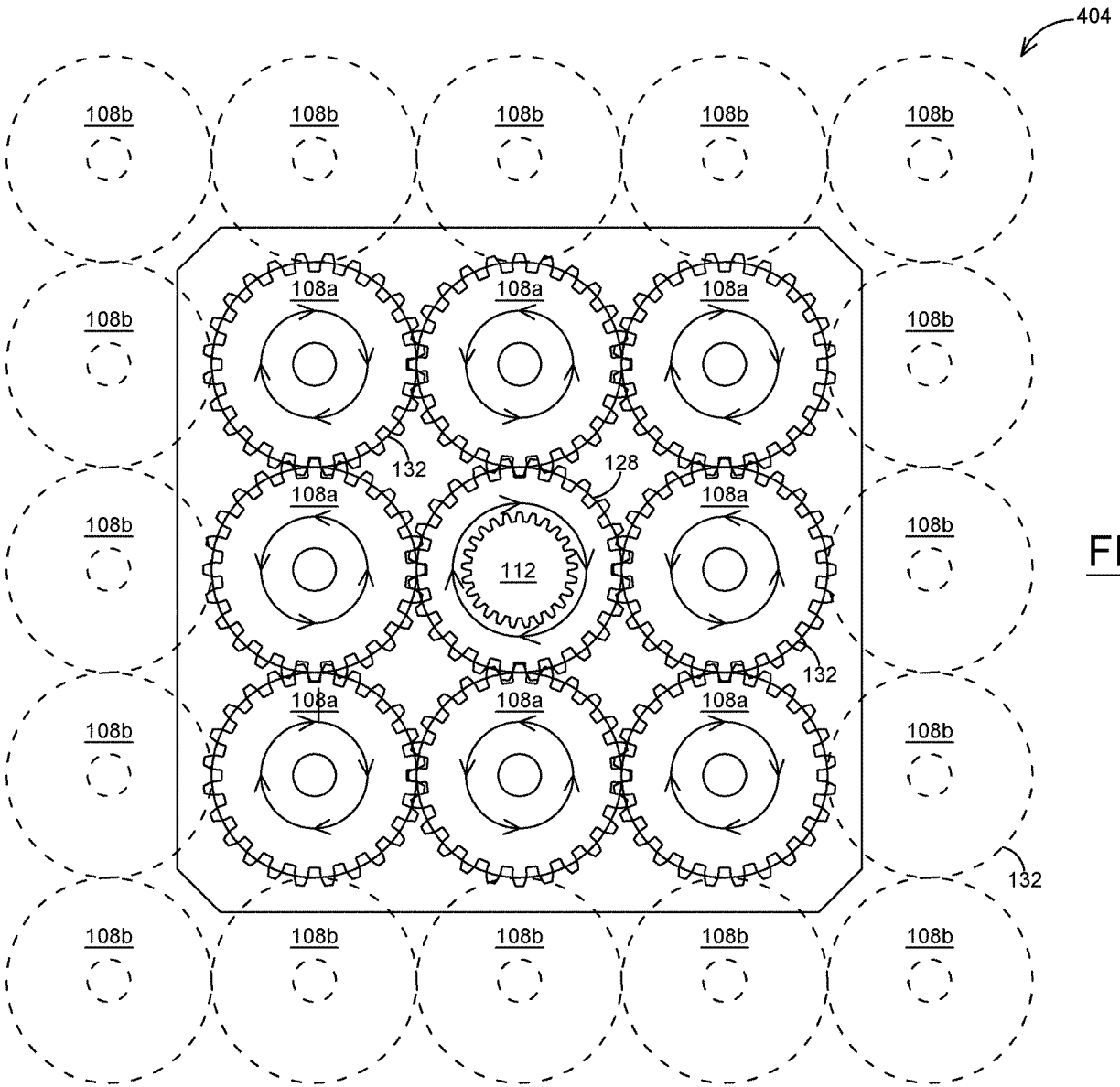
FIG. 20 is a schematic view of a pneumatic motor assembly in accordance with another embodiment.

Reference is now made to FIG. 20, which shows a pneumatic motor assembly 404 in accordance with another embodiment. As shown, pneumatic motor assembly 404 includes a plurality of pneumatic motors 108 that drive a drive shaft 112. In the illustrated example, pneumatic motors 108 are arranged in nested rectangular rows of mechanically connected pneumatic motors 108. As shown, pneumatic motors 108 may be drivingly coupled to drive shaft 112 by drive gear 128 and rotor gears 132.

Pneumatic motor assembly 404 can include any number of pneumatic motors 108, arranged into any number of nested rectangular rows. In the illustrated example, pneumatic motor assembly 404 includes an inner row of eight pneumatic motors 108*a*, and an outer row of 16 pneumatic motors 108*b*. As shown, the rotor gear 132 of each pneumatic motor 108 is connected with four orthogonally arranged gears 132 or 128. Collectively, the pneumatic motors 108 may be arranged in a grid-like pattern having perpendicular columns and rows as shown.

Pneumatic motors 108 can be fluidly arranged into any number of series motor stages, which may be configured in any manner described herein.

FIGS. 19 and 20 show pneumatic motor assemblies 404 including circular and rectangular patterned arrangements of pneumatic motors 108. It will be appreciated that in alternative embodiments, pneumatic motors 108 may be arranged in other regular or irregular patterns. Also, rotor gears 132 may all have the same size as shown, or may include a plurality of different rotor gear sizes.

It will be appreciated that the connection and positional arrangement of pneumatic motors 108 in a pneumatic motor assembly 404, which are shown and described herein in connection with FIGS. 19 and 20, can also be applied to the connection and positional arrangement of pneumatic motor assemblies 404. For example, a pneumatic engine may include a plurality of pneumatic motor assemblies 404 connected by meshed drive gears 128 arranged in nested circular or rectangular rows, or in any other regular or irregular pattern.

Referring to FIG. 12, flow controller 156 may be communicatively coupled to any number of sensors 172 which may collectively determine the load and/or other operating characteristics (e.g. speed, torque, gas flow, gas pressure, gas temperature, etc.) of pneumatic motor assemblies 404. This can allow flow controller 156 to detect failure or malfunction in or more pneumatic motor assemblies 404 and in response direct one or more flow control valves 152 to fluidly disconnect the failed or malfunctioning pneumatic motor assembly 404 for replacement or repair. In other embodiments, flow controller 156 may be manually or automatically operable to fluidly disconnect select pneumatic motor assemblies 404 according to a maintenance schedule (e.g. based on running time). As an example, FIG. 15 shows two pneumatic motor assemblies 404, each of which includes a valve 152*d* that can be selectively opened or closed to fluidly connect or disconnect that pneumatic motor assembly 404 from the gas source 104.

As noted above, pneumatic motors 108 can be any device that converts the energy of a pressurized flow of gaseous fluid ("gas") to mechanical (e.g. rotary or reciprocating) power. Examples of pneumatic motors 108 include rotary vane, axial piston, radial piston, gerotor, screw type, and turbine type pneumatic motors. Pneumatic engine 400 and individual pneumatic motor assemblies 404 can include any number of types and sizes of pneumatic motors to suit the application. For example, some pneumatic motor types may have greater starting torque, greater expansion ratios, run at higher speeds, or have better balance.

Figure 22:
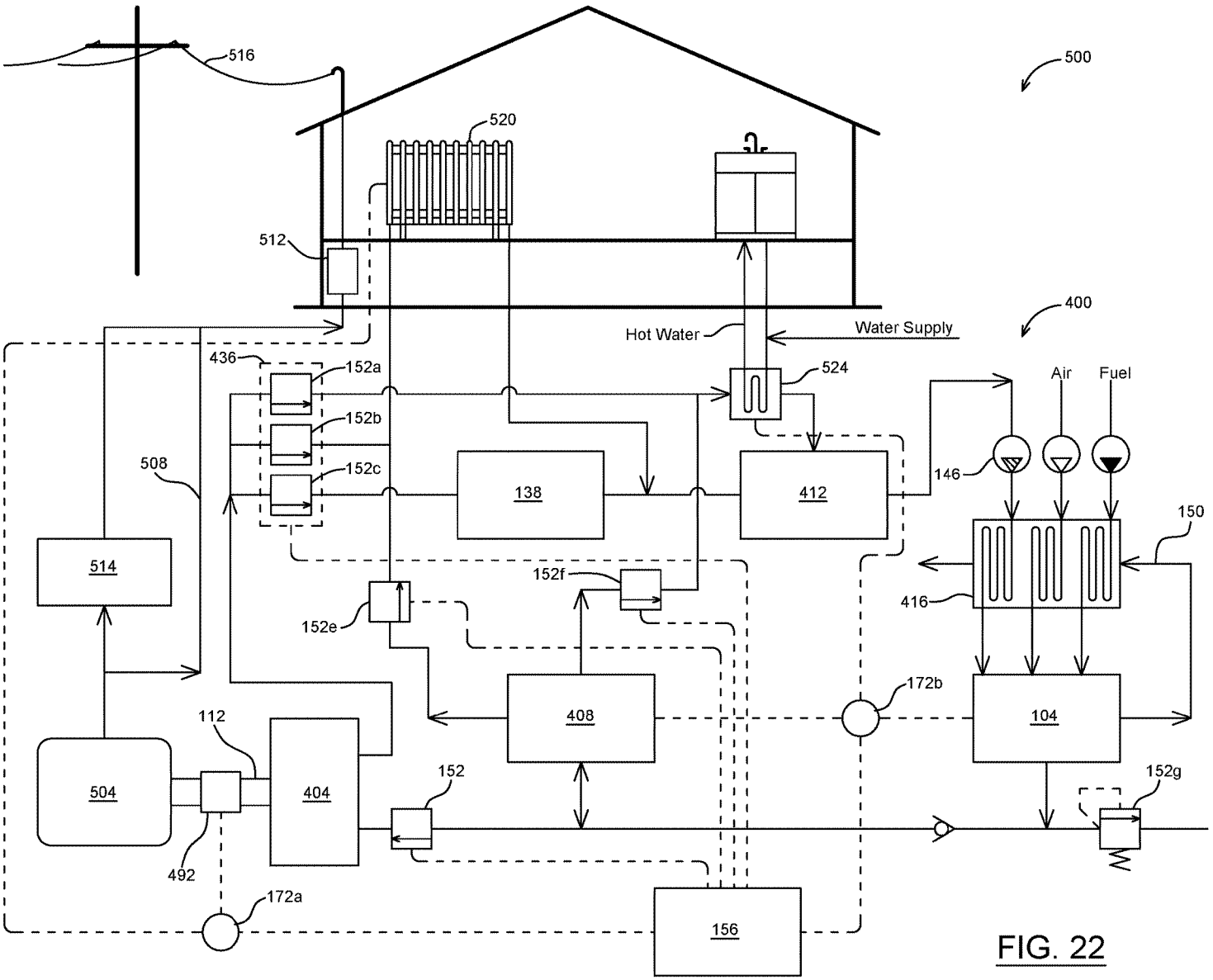
FIG. 22 is a schematic illustration of a facility including a pneumatic engine in accordance with at least one embodiment.

Reference is now made to FIG. 22, which shows a facility 500 (e.g. residential, commercial, or industrial building) including a pneumatic engine 400. As shown, pneumatic engine 400 includes a pneumatic motor assembly 404 having a drive shaft 112 that is drivingly coupled to an electric generator 504. Electric generator 504 generates and delivers electricity to facility 500, such as by an electrical connection (e.g. by electrical wire 508) to an electrical panel 512 of the facility 500. Electric generator 504 can be any device suitable for generating electricity for facility 500 from mechanical output by pneumatic motor assembly 404.

In some embodiments, electric generator 504 may continuously or intermittently generate electricity which exceeds demand by facility 500. The excess electricity may be stored in an energy storage member 514 (e.g. battery), or delivered (e.g. sold) to the power grid 516. As shown, energy storage member 514 and power grid 516 may be electrically connected to electric generator 504. During periods of energy demand by facility 500 which exceeds the electricity output of generator 504, facility 500 may draw power from battery 514 and/or power grid 516. This may permit pneumatic motor assembly 404 to run at efficient speed, with the excess or deficient electricity generation being accomodated by battery 514 and/or power grid 516.

It will be appreciated that motor assembly 404 may operate at steady speed so that electric generator 504 may output a certain electrical frequency (e.g. 50 Hz or 60 Hz). For example, controller 156 may direct the position of valve 152 in order to control gas flow to motor assembly 404 and thereby maintain motor assembly 404 operating at steady speed.

Alternatively, or in addition, controller 156 may direct pneumatic motor assembly 404 to operate at variable speed according to the electricity demand by facility 500. In some embodiments, facility 500 may further include a frequency changer (also referred to as a frequency converter) to maintain a certain electrical frequency. Facility 500 may include a voltage transformer to accommodate the voltage requirements of appliances and/or power grid 516.

In some embodiments, pneumatic engine 400 supplies hot gas to an air heater 520 (e.g. a radiator or ducted air system), and/or to a water heater 524. For example, air heater 520 and/or water heater 524 may be positioned downstream of one or both of high pressure reservoir 408 and pneumatic motor assembly 404. In the illustrated example, both of air heater 520 and water heater 524 are positioned downstream of both of high pressure reservoir 408 and pneumatic motor assembly 404. As shown, exhaust gas from pneumatic motor assembly 404 may be distributed by a directional control valve 436 under the control of flow controller 156 to one or more (or all) of air heater 520, water heater 524, and condenser 412 according to air/water heating demand and available gas supply. High pressure reservoir 408, under the control of flow controller 156 (e.g. via gas valves 152*e* and 152*f*), directs bypass gas flow (i.e. gas flow which bypasses pneumatic motor assembly 404) to one or both of air heater 520 and water heater 524. This can allow high pressure reservoir 408 to supplement or replace the gas flow to heaters 520 and 524 when pneumatic motor assembly 404 cannot supply sufficient exhaust gas to keep up with the demand by heaters 520 and 524. For example, exhaust gas from pneumatic motor assembly 404 may decrease below demand if pneumatic motor assembly 404 is operated in a low power mode during a period of low electricity demand by facility 500, and high pressure reservoir 408 may supplement the exhaust gas from pneumatic motor assembly 404 to satisfy the demand by heaters 520 and 524. In the illustrated example, pneumatic engine 400 includes a safety relief valve 152*g*.

It will be appreciated that pneumatic engine 400 can include any number of series or parallel connected pneumatic motor assemblies 404, such as discussed elsewhere in this application. For example, pneumatic motor 400 may include a greater number of pneumatic motor assemblies 404 to accommodate a greater electricity demand by facility 500. In some embodiments, flow controller 156 may selectively fluidly connect or disconnect any number of the plurality of pneumatic motor assemblies 404 according to the electricity demand at that time. For example, during periods of low electricity demand by facility 500, flow controller 156 may fluidly disconnect one or more of the pneumatic motor assemblies 404 (e.g. by closing a valve). Pneumatic motor assemblies 404 can include any type of pneumatic motors. For example, there may be one or more pneumatic motor assemblies 404 including pneumatic motor type(s) suitable for rapid changes in speed (e.g. vane type, gerotor type, and piston type pneumatic motors), and there may be one or more pneumatic motor assemblies 404 including pneumatic motor type(s) suitable for steady operation (e.g. screw rotor type and turbine motor type).

Figure 23:
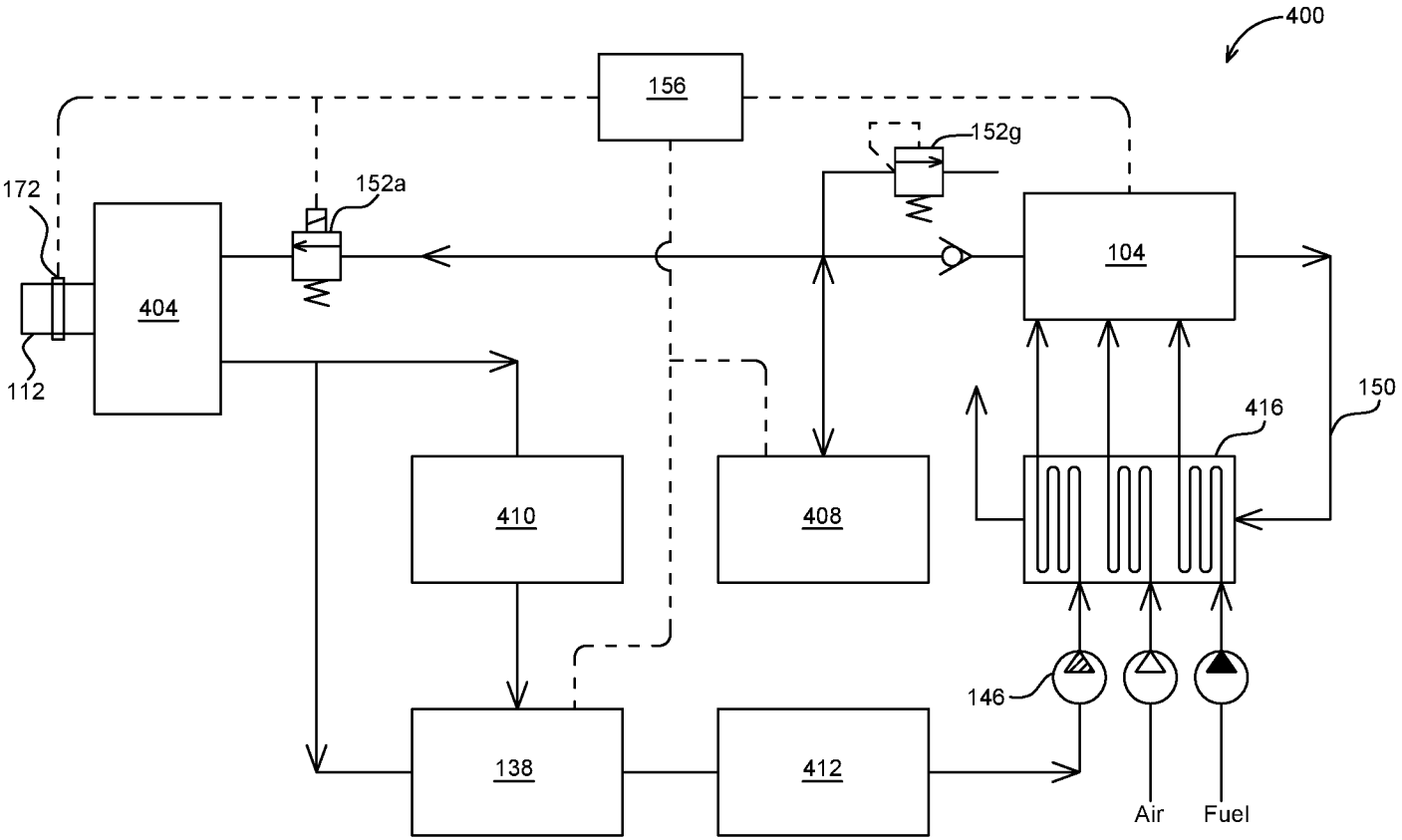
FIG. 23 is a schematic view of a pneumatic engine in accordance with another embodiment.

Reference is now made to FIG. 23, which shows a pneumatic engine 400 in accordance with another embodiment. Like part numbers refer to like parts in the previous figures.

As shown, pneumatic engine 400 may include a high-pressure reservoir 408 positioned downstream of gas source 104 and upstream of pneumatic motor assembly 404. Pneumatic engine 400 can have any number of pneumatic motor assemblies 404. Pneumatic motor assembly 404 may be drivingly coupled to engine drive shaft 112. A buffer 410 may be positioned downstream of pneumatic motor assembly 404 and upstream of condenser 138. As shown, buffer 410 and condenser 138 may also be positioned in parallel so that a portion of gas exhausted from pneumatic motor assembly 404 may bypass buffer 410 to condenser 138. A low pressure reservoir 412 may be positioned downstream of condenser 138 and upstream of pump 146. Pump 146 may move fluid from low pressure reservoir 412 through heat exchanger 416 into gas source 104 to generate additional gas. As shown, heat exchanger 416 may transfer heat from gas source exhaust gas 150 to fluid, air, and fuel that are delivered to gas source 104.

Pneumatic engine 400 may include a flow controller 156 to regulate the operation of pneumatic engine 400, such as in accordance with demand, performance, and/or efficiency parameters. In the illustrated example, flow controller 156 is communicatively coupled to a sensor 172 that is positioned to sense operating characteristic(s) of pneumatic engine 400, such as output torque, output power, output speed (e.g. RPM), or temperature for example. In response to readings received from sensor 172, flow controller 156 may direct the operation of valve 152 to open, restrict, or inhibit flow of gas from gas source 104 to pneumatic motor assembly 404; direct high-pressure reservoir 408 to collect gas from gas source 104 or supply gas to pneumatic motor assembly 404; and/or direct the operating power level of condenser 138. As shown, a safety valve 152*g* may be positioned in the gas flow path between gas source 104 and pneumatic motor assembly 404. Safety valve 152*g* may open in response to gas pressure exceeding a predetermined pressure value, which may occur when high-pressure reservoir 408 is filled to capacity.

Figure 24A:
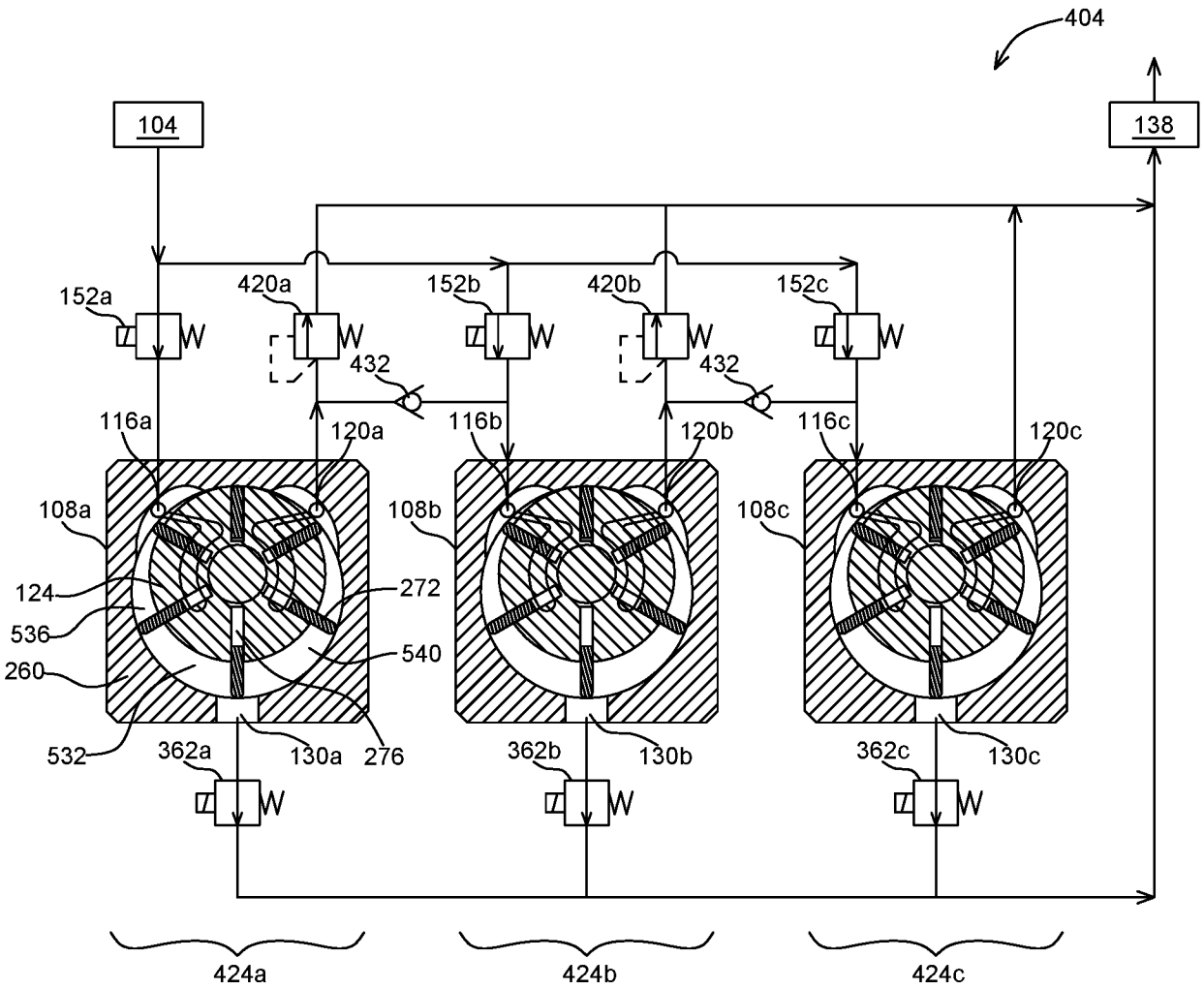
FIG. 24A is a schematic view of a pneumatic motor assembly in accordance with another embodiment.

Reference is now made to FIG. 24A, which shows a pneumatic motor assembly 404 in accordance with an embodiment. Like part numbers refer to like parts in the previous figures.

Pneumatic motor assembly 404 is shown including a plurality of pneumatic motors 108, any number of which can be arranged in parallel or as series motor stages 424. In some embodiments, one or more (or all) of pneumatic motors 108 may include a gas inlet 116, a terminal gas outlet 120, and an intermediate gas outlet 130. As shown, pneumatic motor 108 includes a gas flow path 532 which extends from gas inlet 116 to terminal gas outlet 120. Intermediate gas outlet 130 may be fluidly connected to gas flow path 532 downstream of gas inlet 116 and upstream of terminal gas outlet 120.

Motor gas flow path 532 may include an expansion portion 536 and a compression portion 540. Expansion portion 536 extends from gas inlet 116 to intermediate gas outlet 130, and compression portion 540 extends from intermediate gas outlet 130 to terminal gas outlet 120. Gas moving through motor gas flow path 532 from gas inlet 116 to intermediate gas outlet 130 expands to convert fluid energy to mechanical power output. Gas moving through gas flow path 532 from intermediate gas outlet 130 to terminal gas outlet 120 is compressed to add energy into the gas exiting terminal gas outlet 120.

Figure 24B:
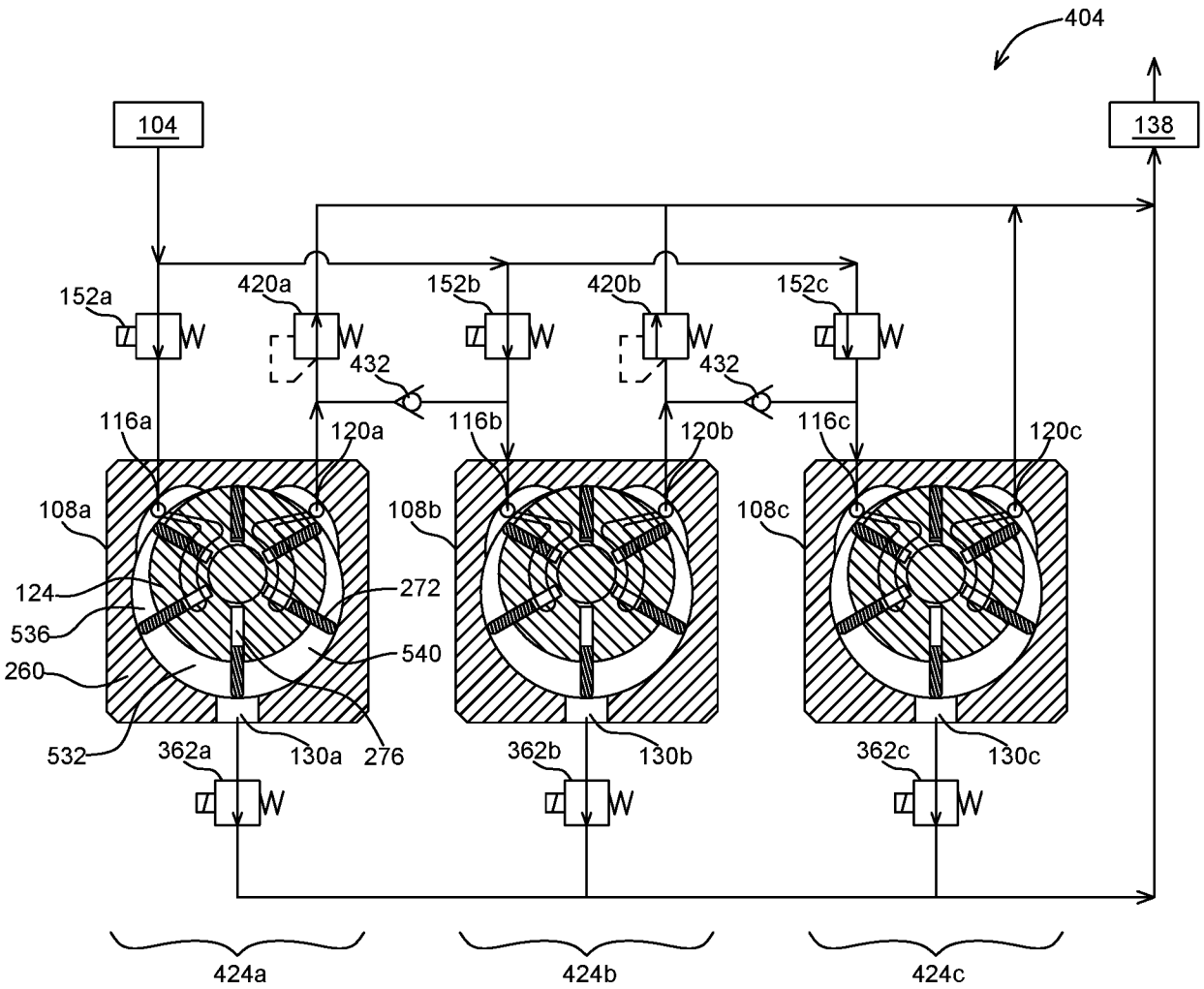
FIG. 24B is a schematic view of the pneumatic motor assembly of FIG. 24A with gas valves opened to fluidly connect pneumatic motors in parallel.

Still referring to FIG. 24A-24B, gas discharged from intermediate gas outlet 130 may flow downstream, bypassing the remainder of pneumatic motor assembly 404, to a condenser 138 as shown (e.g. in the case of steam), or vent to atmosphere (e.g. in the case of compressed air). Recompressed gas discharged from terminal gas outlet 120 may be directed to the gas inlet 116 of a downstream pneumatic motor 108. In the example shown, terminal gas outlet 120*a* is upstream of gas inlet 116*b*, and terminal gas outlet 120*b* is upstream of gas inlet 116*c*. Thus, each pneumatic motor 108 that is downstream of a terminal gas outlet 120 may operate to generate mechanical power from the recompressed gas discharged from that terminal gas outlet 120. This may lead pneumatic motor assembly 404 to covert fluid energy to mechanical power with greater conversion efficiency.

In some embodiments, a gas valve 362 may be positioned immediately downstream of each intermediate gas outlet 130. Gas valve 362 may be operable to selectively allow, inhibit, or restrict gas flow exiting gas outlet 130 to affect the speed, torque, and/or gas consumption of the pneumatic motor 108. For example, when gas valve 362*a* restricts gas flow exiting pneumatic motor 108*a*, pneumatic motor 108*a* may exhibit lower output speed, higher output torque, and lower gas consumption. Gas valve 362 may be communicatively coupled to flow controller 156 (FIG. 23), such that flow controller 156 can direct the position of gas valve 362, e.g. to achieve a speed, torque, and/or gas consumption that satisfies the demand.

In some embodiments, terminal gas outlet 120 may also be fluidly connected to an expansion valve 420. Expansion valve 420 may open in response to elevated gas pressure at terminal gas outlet 120. When opened, expansion valve 420 may direct gas from terminal gas outlet 120 to bypass the remainder to pneumatic motor assembly 404. For example, expansion valve 420 may fluidly connect terminal gas outlet 120 to a downstream condenser 138 (e.g. in the case of steam) or to vent to atmosphere (e.g. in the case of compressed gas).

It will be appreciated that the gas expansion and gas consumption of a pneumatic motor 108 may be controlled by the position of the respective gas valves 362 and 420. For example, when both gas valves 362 and 420 of a pneumatic motor 108 are closed to inhibit gas flow, all gas flow entering gas inlet 116 may discharge from gas outlet 120 without any net expansion. As noted above, the position of expansion valve 420 may be responsive to the gas pressure at terminal gas outlet 120. The position of gas valve 362 may be selectively controlled to control the gas consumption and speed of the pneumatic motor 108.

Still referring to FIG. 24A-24B, each motor gas inlet 116 may be fluidly connected to an upstream gas valve 152 that controls the provision of bypass gas from gas source 104 to the pneumatic motor 108, bypassing any upstream pneumatic motors 108. Where two or more gas valves 152 are open, the two associated pneumatic motors 108 receive gas from gas source 104 in parallel. As shown, a check valve 432 may be positioned between fluidly adjacent pneumatic motors 108 to prevent gas flowing upstream. When a check valve 432 is closed, gas exiting the terminal gas outlet 120 of the upstream pneumatic motor 108 may discharge to condenser 138 (or vent to atmosphere) through expansion valve 420, as shown in FIG. 24B.

Pneumatic motor assembly 404 may operate with greater efficiency when downstream gas valves 152 (e.g. 152*b* and 152*c*) are closed so that no two or more of the pneumatic motors 108 receives gas from gas source 104 in parallel. When greater power output is required (e.g. for vehicle acceleration), then two or more (or all) of gas valves 152 may be opened (e.g. 152*a* in addition to one or both of 152*b* and 152*c*) to configure two or more of pneumatic motors 108 to be fluidly connected to gas source 104 in parallel.

Figure 25A:
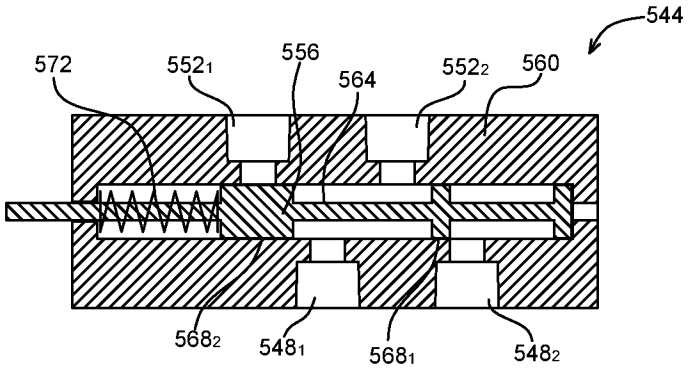
FIG. 25A is a cross-sectional view of a directional control valve in a first position, in accordance with an embodiment.
Figure 25B:
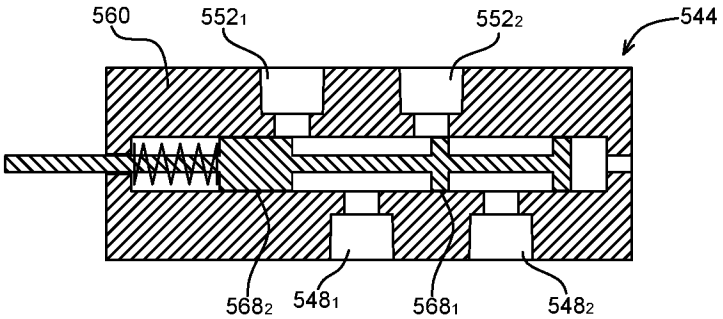
FIG. 25B is a cross-sectional view of the directional control valve of FIG. 25A in a second position.
Figure 25C:
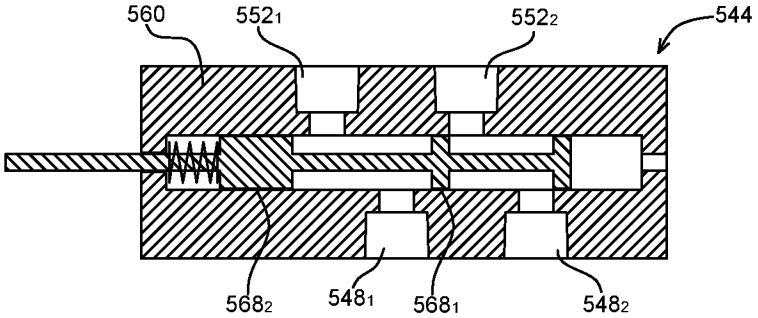
FIG. 25C is a cross-sectional view of the directional control valve of FIG. 26A in a third position.
Figure 26A:
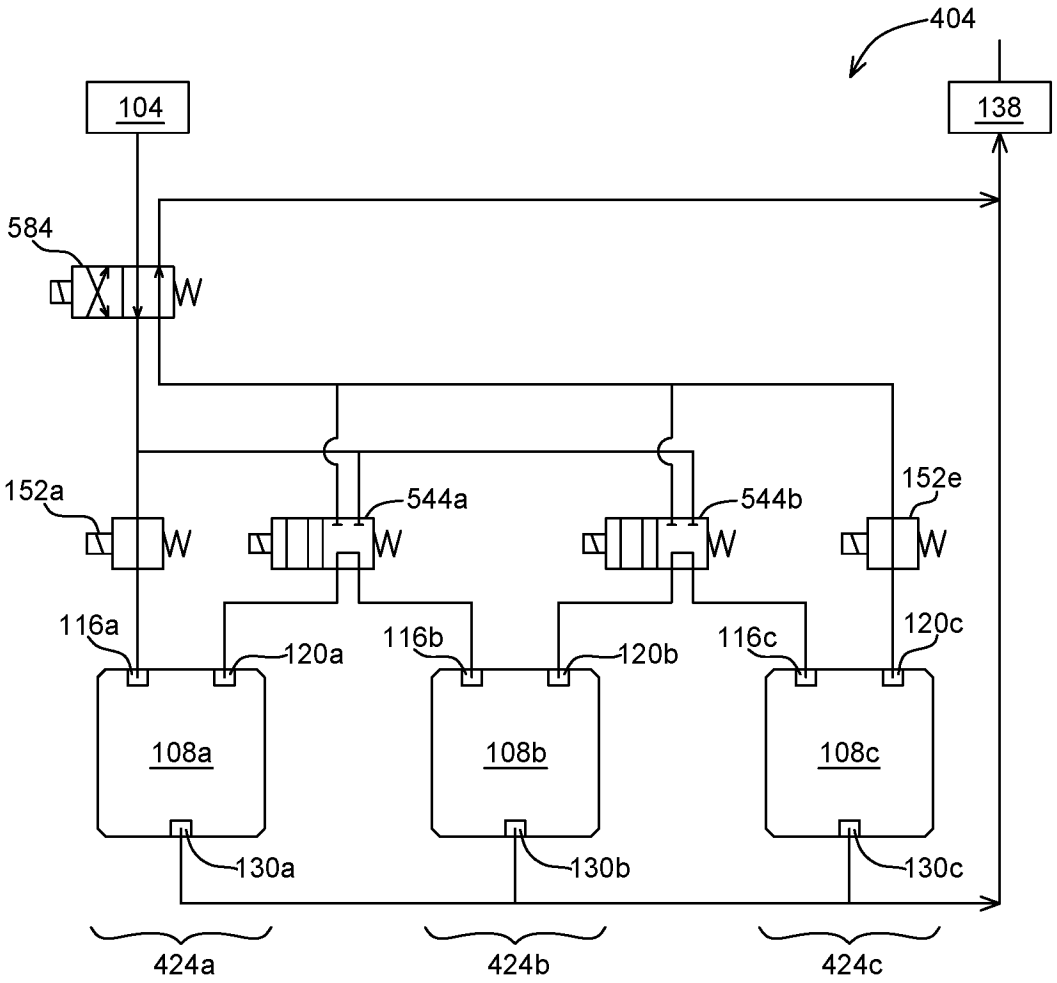
FIGS. 26A-26B are schematic views of a pneumatic motor assembly in accordance with an embodiment, configured with a forward gas direction through three pneumatic motors.
Figure 26B:
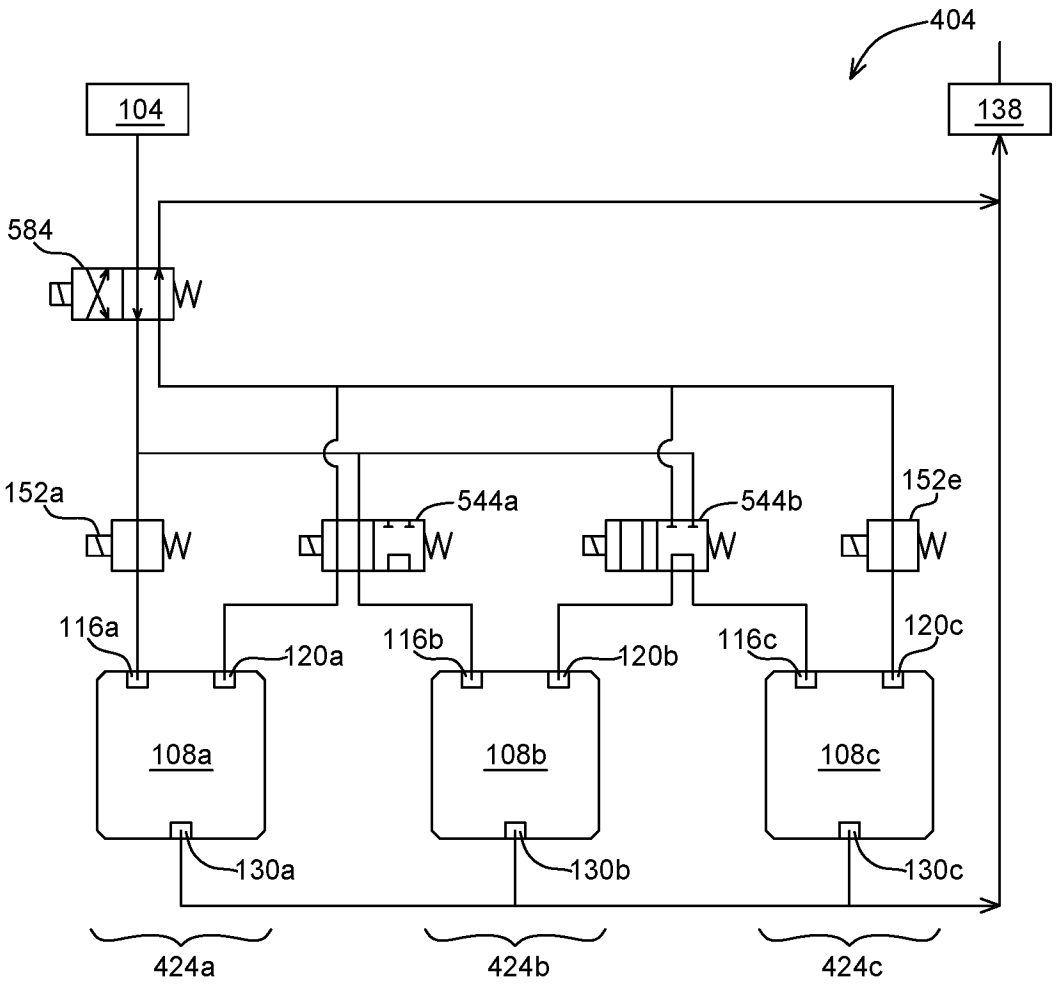

Reference is now made to FIGS. 25A-25C which illustrate a directional control valve 544 in accordance with an embodiment. FIGS. 26A and 26B illustrate an example of a pneumatic motor assembly 404 incorporating directional control valves 544. As shown, directional control valve 544 has gas inlets $\mathbf{548}_1$ and $\mathbf{548}_2$, and gas outlets $\mathbf{552}_1$ and $\mathbf{552}_2$. Taking directional control valve 544*a* as an example, gas inlet $\mathbf{548}_1$ may be connected to terminal gas outlet 120*a*, gas inlet $\mathbf{548}_2$ may be connected to receive bypass gas from gas source 104, gas outlet $\mathbf{552}_1$ may be connected to condenser 138 (or vent to atmosphere), and gas outlet $\mathbf{552}_2$ may be connected to gas inlet 116*b*.

As shown, directional control valve 544 may have a spool 556 movable within a casing 560 between a first position (FIGS. 25A and 26A), a second position (FIG. 25B), and a third position (FIGS. 25C and 26B). Spool 556 has grooves 564 between lands 568, which define gas flow passages for gas entering gas inlets $\mathbf{548}_1$ and $\mathbf{548}_2$. Spool 556 may be biased to the first position (FIGS. 25A and 26A) by a bias member 572 (e.g. spring). Directional control valve 544 may be communicatively coupled to flow controller 156 (FIG. 23) and selectively movable by control signals from flow controller 156 (FIG. 23).

In the first position (FIGS. 25A and 26A), spool groove 564 provides a gas flow passage from gas inlet $\mathbf{548}_1$ to gas outlet $\mathbf{552}_2$. Gas inlet $\mathbf{548}_2$ and gas outlet $\mathbf{552}_1$ are closed. Referring to directional control valve 544*a* in FIG. 26A as an example, gas flows from terminal gas outlet 120*a* to gas inlet 116*b*, and gas inlet 116*b* receives no bypass gas from gas source 104. In this first position, directional control valve 544*a* fluidly connects pneumatic motors 108*a* and 108*b* in series.

In the third position (FIGS. 25C and 26B), spool groove 564 provides a gas flow passage from gas inlet $\mathbf{548}_1$ to gas outlet $\mathbf{552}_1$. Gas inlet $\mathbf{548}_2$ is fluidly connected to gas outlet $\mathbf{552}_2$. In the third position, bypass gas moves through gas inlet $\mathbf{548}_2$ and gas outlet $\mathbf{552}_2$ to motor inlet 116*b*, and gas exiting terminal gas outlet 120*a* moves through gas inlet $\mathbf{548}_1$ and gas outlet $\mathbf{552}_1$ to condenser 138 (or vent to atmosphere). Thus, gas is prevented from moving between terminal gas outlet 120*a* and gas inlet 116*b*. In this third position, directional control valve 544*a* fluidly connects pneumatic motors 108*a* and 108*b* in parallel.

In the second position (FIG. 25B), spool grooves 564 provides a gas flow passage from gas inlet $\mathbf{548}_1$ to both of gas outlets $\mathbf{552}_1$ and $\mathbf{552}_2$. Gas inlet $\mathbf{548}_2$ is closed. Referring to directional control valve 544*a* in FIG. 26A as an example, the second position (not shown in FIG. 26A) provides a variant configuration in which gas flows from terminal gas outlet 120*a* to both of gas inlet 116*b* and condenser 138 (or vent to atmosphere). In this second position, directional control valve 544*a* fluidly connects pneumatic motors 108*a* and 108*b* in series, with some gas exhausted from pneumatic motor 108*a* bypassing pneumatic motor 108*b* to condenser 138 (or venting to atmosphere).

Figure 27A:
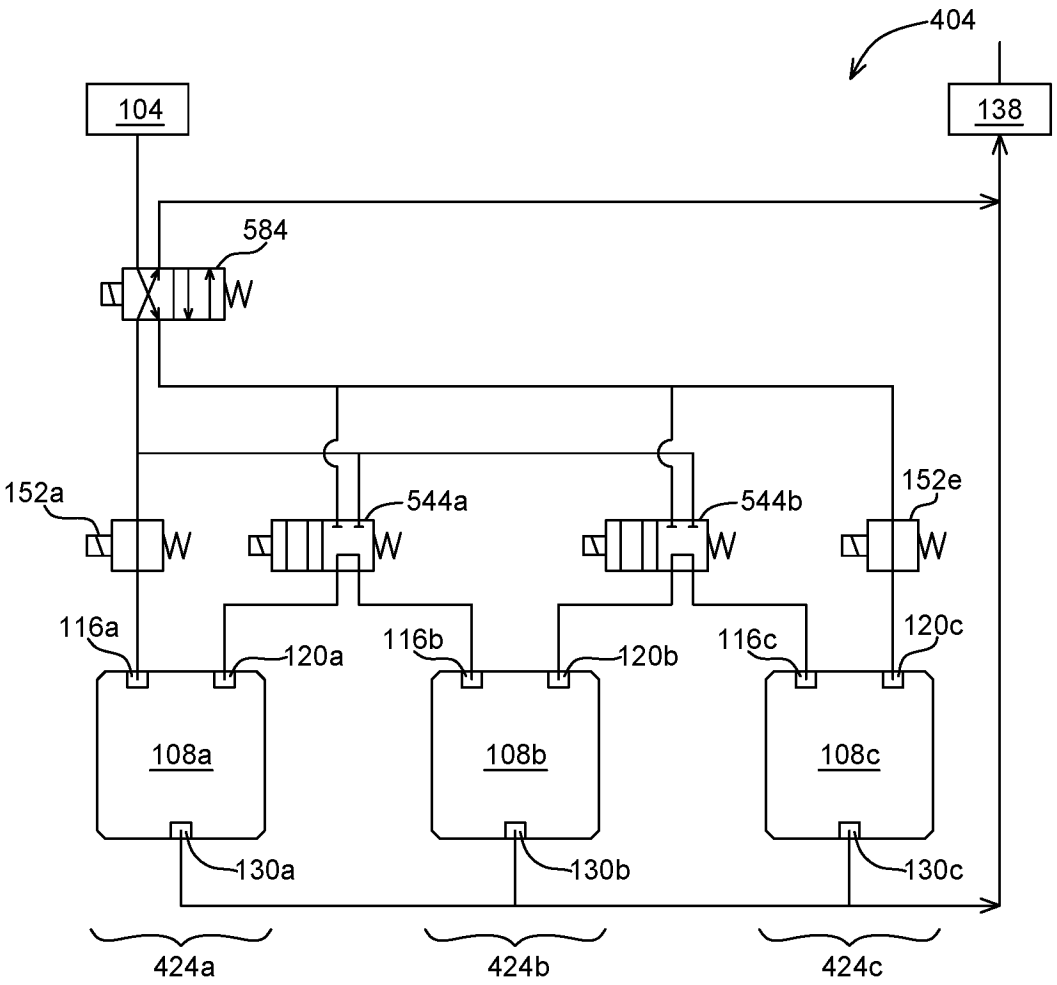
FIGS. 27A-27B are schematic views of the pneumatic engine of FIGS. 26A-26B, configured with a reverse gas direction through the three pneumatic motors.
Figure 27B:
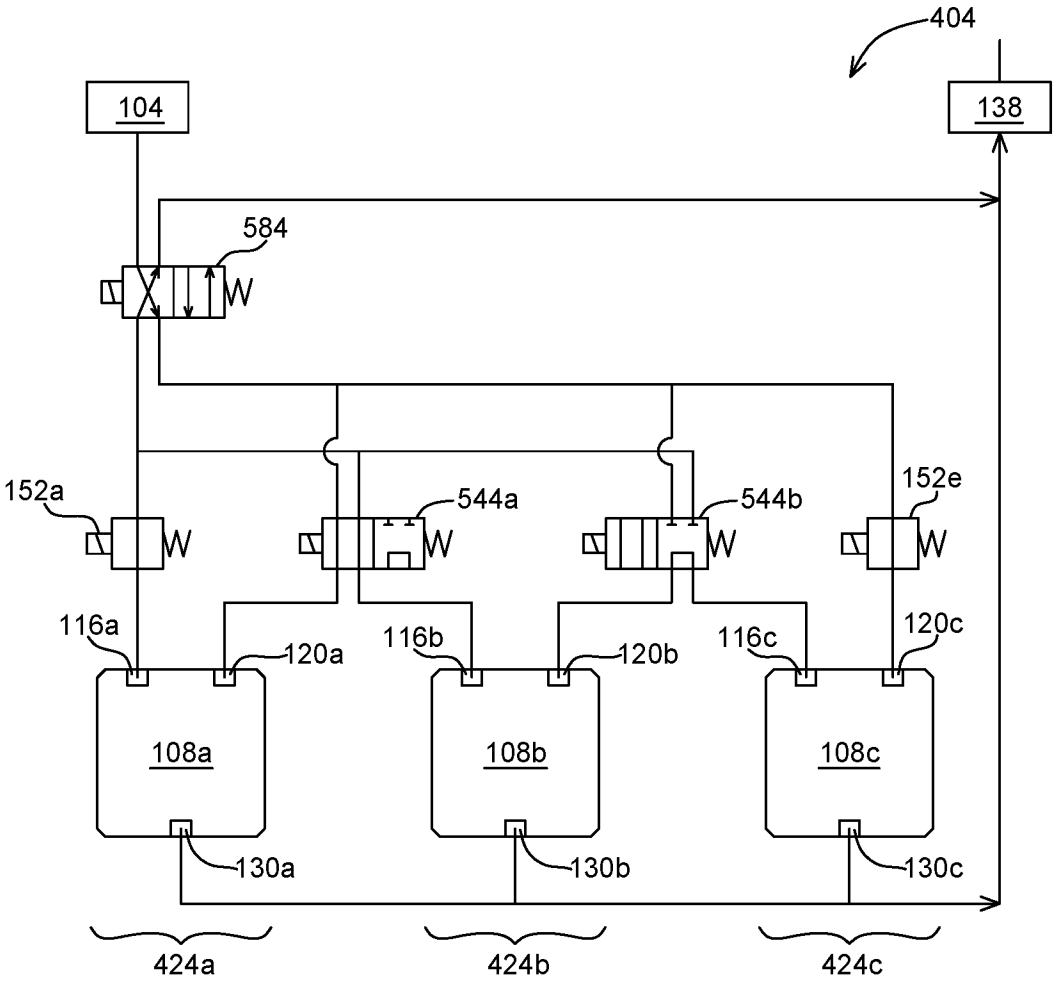

Referring to FIGS. 26A, 26B, 27A, and 27B pneumatic motor assembly 404 may include a directional control valve 584 that can reverse the direction of gas flow through series motor stages 424 (and thus pneumatic motors 108), and thereby reverse the output direction of pneumatic motor assembly 404 (e.g. reverse the output rotation direction). FIGS. 26A-26B show pneumatic engine 400 having directional control valve 584 in a first position that directs gas through pneumatic motors 108 in a 'forward direction' whereby ports 116 are gas inlets and ports 120 are gas outlets. FIGS. 27A-27B show pneumatic engine 400 having directional control valve 584 in a second position that directs gas through pneumatic motors 108 in a 'reverse direction' whereby ports 116 are gas outlets and ports 120 are gas inlets.

In FIGS. 26A-27B, a gas valve 152*e* is positioned downstream of gas port 120*c* (FIGS. 26A-26B—'forward direction' of flow) or upstream of gas port 120*c* (FIGS. 27A-27B—'reverse direction' of flow). Gas valve 152*e* may be communicatively coupled to flow controller 156 (FIG. 23) and selectively operable by control signals from flow controller 156 (FIG. 23). In the 'forward direction' of flow (FIGS. 26A-26B), gas valve 152*e* is operable to selectively allow, inhibit, or restrict gas flow discharging terminal gas port 120*c* to condenser 138 (or venting to atmosphere). In the 'reverse direction' of flow (FIGS. 27A-27B), gas valve 152*e* is operable to selectively allow, inhibit, or restrict gas flow from gas source 104 to gas port 120*c*. Pneumatic motors 108*b* and 108*c* may be supplied with bypass gas from gas source 104 depending on the position of directional control valves 544.

Figure 28A:
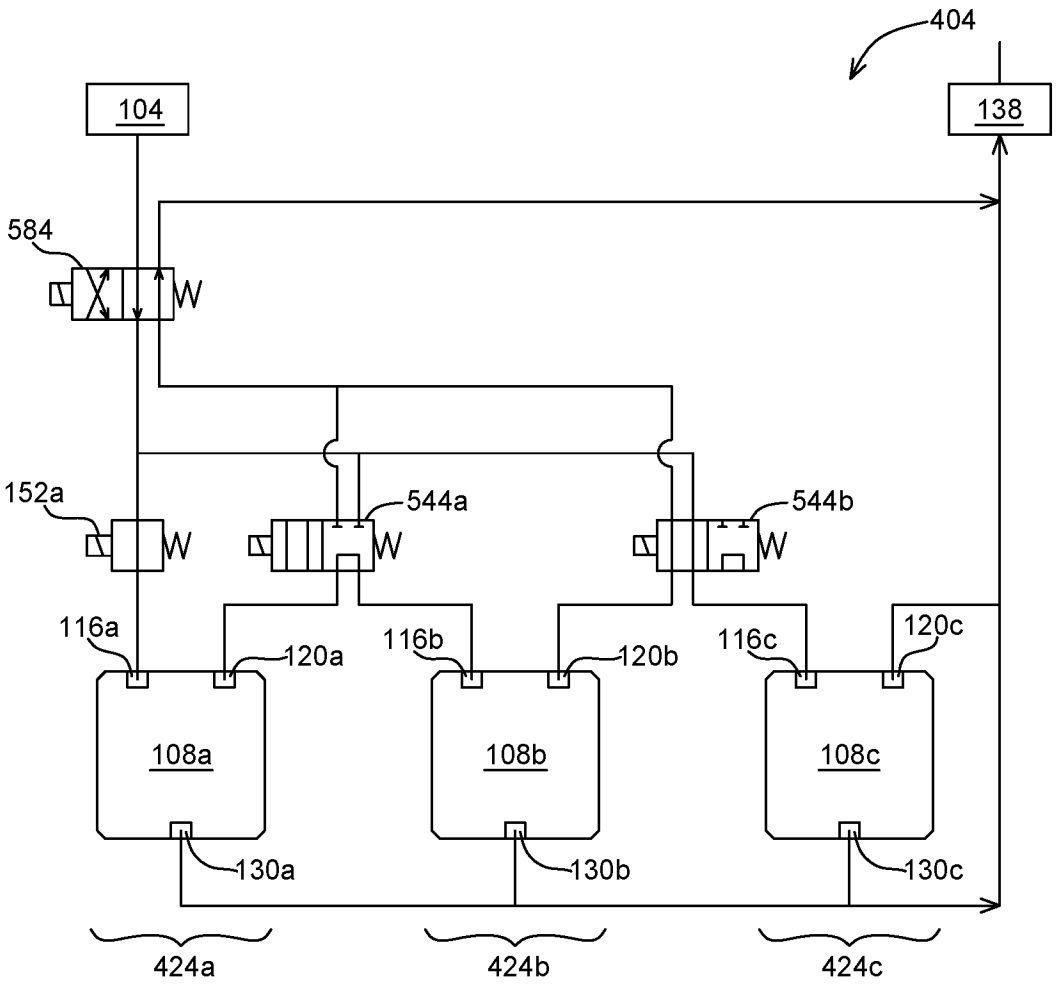
FIG. 28A is a schematic view of a pneumatic motor assembly in accordance with an embodiment, configured with a forward gas direction.
Figure 28B:
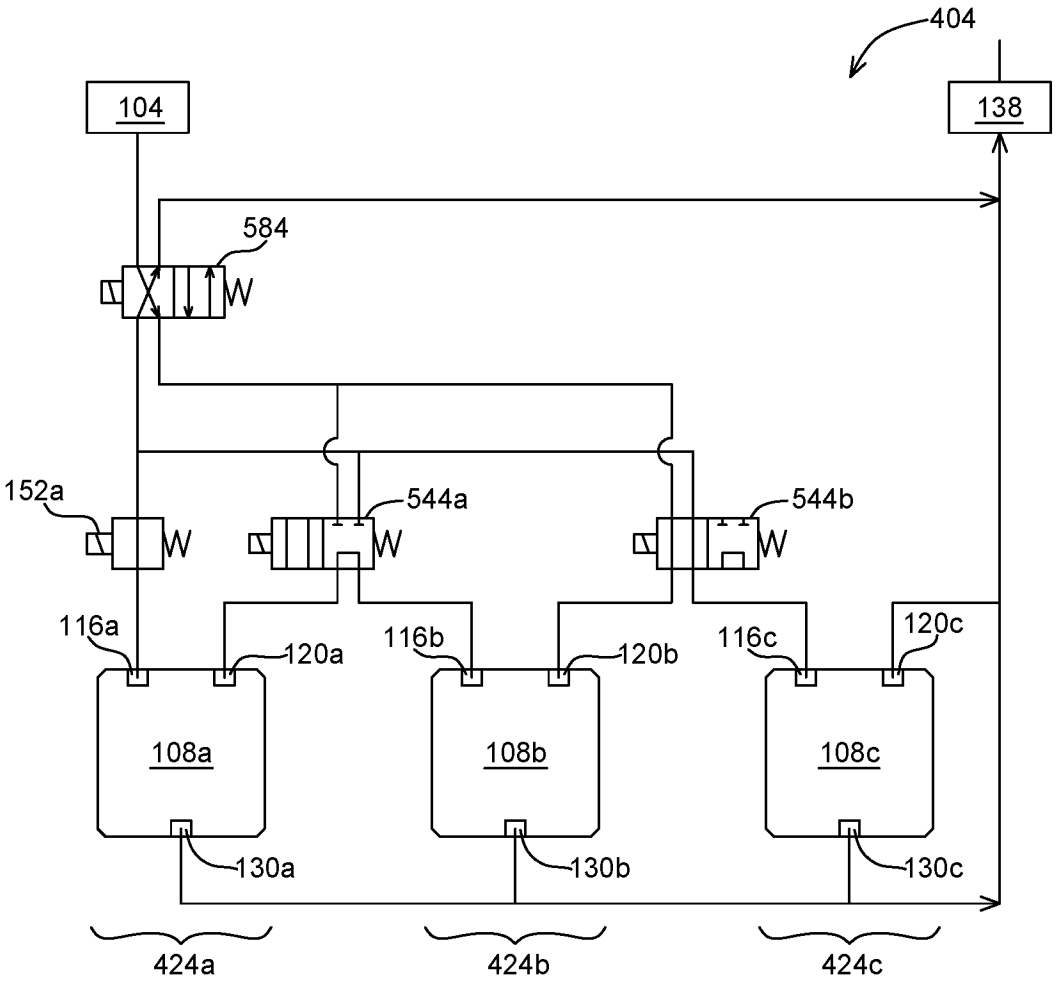
FIG. 28B is a schematic view of the pneumatic motor assembly of FIG. 28A, configured with a reverse gas direction.

FIGS. 28A-28B show a pneumatic motor assembly 404 similar to that of FIGS. 26A-27B, except that valve 152*e* is omitted and instead gas port 120*c* is directly fluidly connected to condenser 138 (or atmosphere). When directional control valve 584 is positioned to provide a 'forward direction' of flow (FIG. 28A), pneumatic motor 108*c* may be fluidly positioned in series or in parallel with pneumatic motor 108*b* depending on the position of directional control valve 544*b*. When directional control valve 584 is positioned to provide a 'reverse direction' of flow (FIG. 28B), pneumatic motor 108*c* is disabled (gas ports 116*c*, 120*c*, and 130*c* all connect to condenser 138 (or atmosphere)).

Figure 29A:
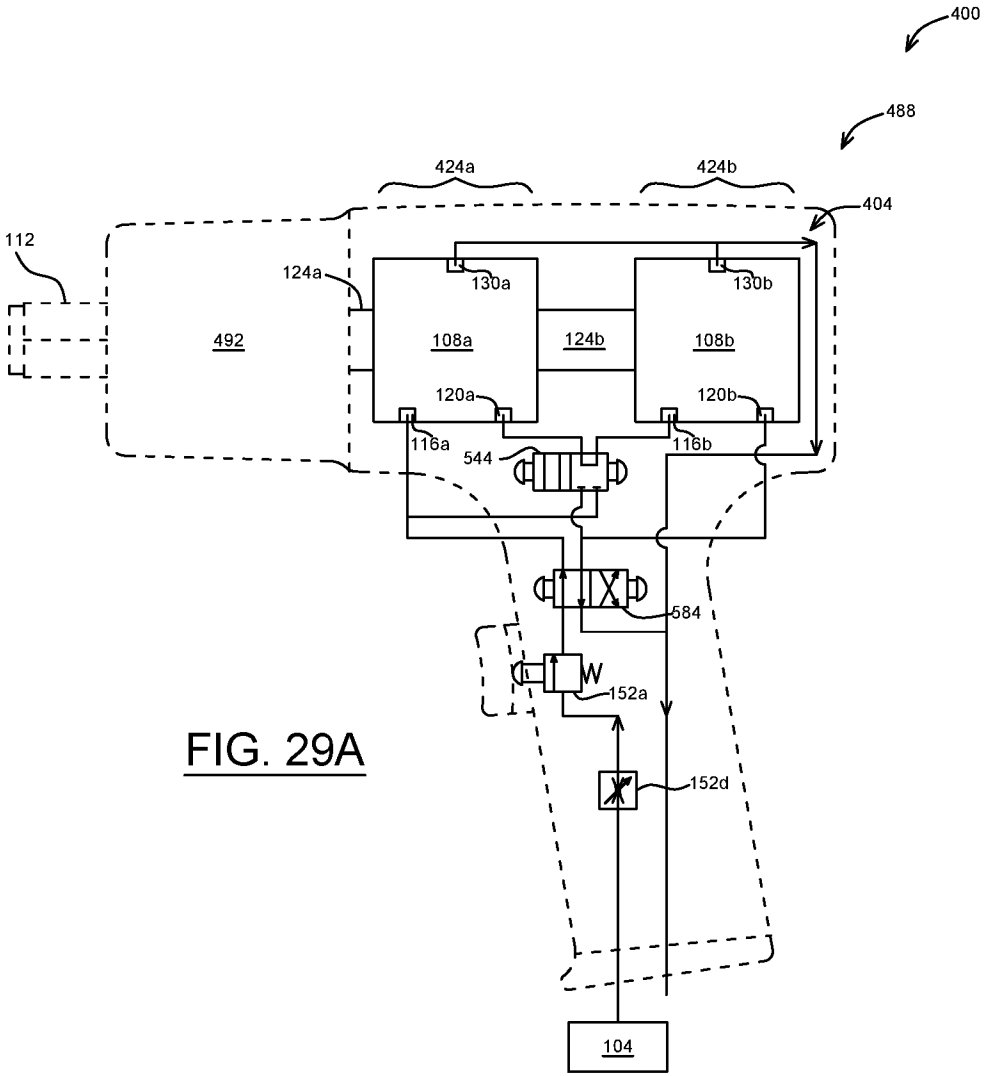
FIG. 29A is a schematic view of a pneumatic tool in accordance with an embodiment, having pneumatic motors fluidly connected in series.
Figure 29B:
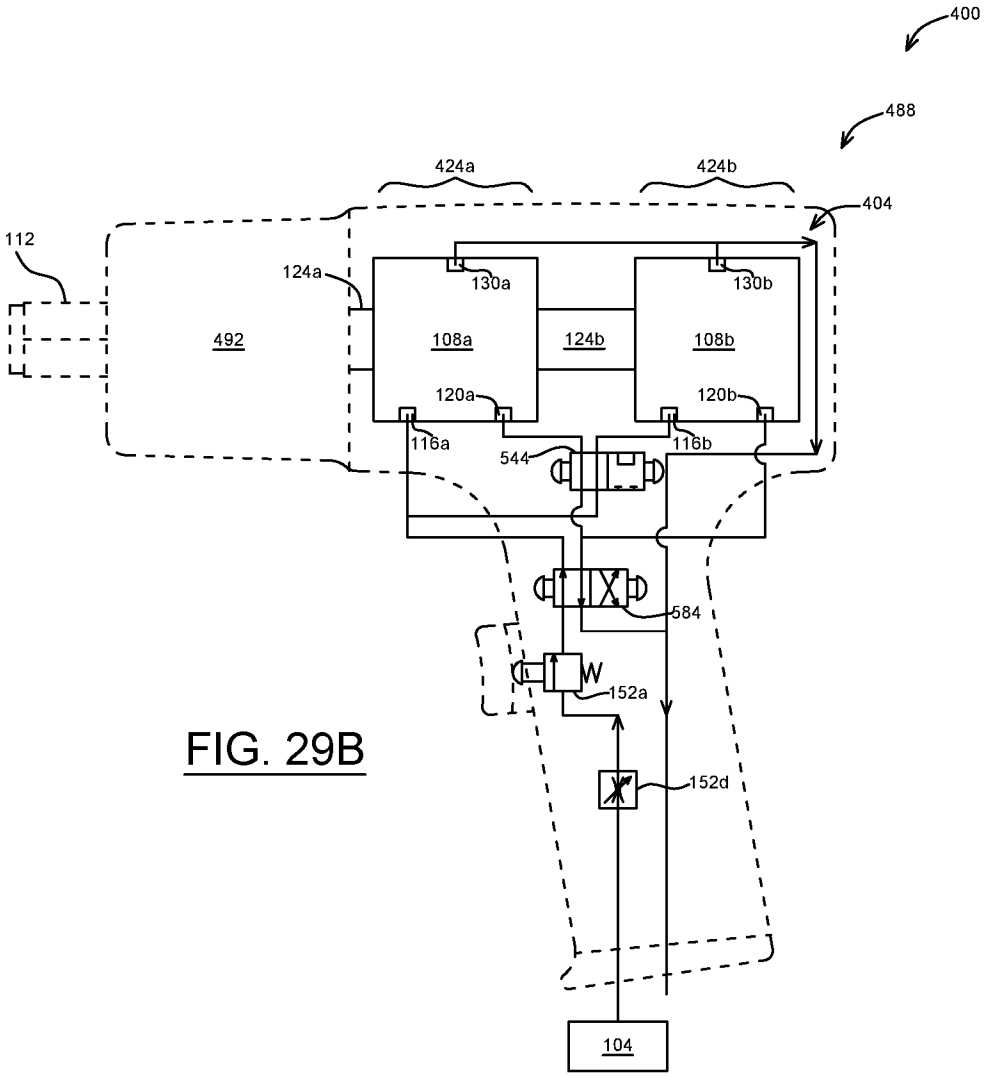
FIG. 29B is a schematic view of the pneumatic tool of FIG. 29A having the pneumatic motors fluidly connected in parallel.

Reference is now made to FIGS. 29A-29B, which show a pneumatic power tool 488 having a pneumatic engine 400 in accordance with an embodiment, in which like part numbers refer to like parts in the previous figures. As shown, pneumatic engine 400 may include a pneumatic motor assembly 404 having a plurality of pneumatic motors 108, a gas valve 152*a* operable to selectively supply gas from gas source 104 to pneumatic motor assembly 404, a first directional control valve 584 operable to selectively reverse the direction of gas flow through pneumatic motor assembly 404, and a second directional control valve 544 operable to selectively toggle pneumatic motors 108 between series and parallel fluid configurations.

FIG. 29A-29B show pneumatic engine 400 having a directional control valve 584 in a first position that directs gas through pneumatic motors 108 in a 'forward direction' whereby ports 116 are gas inlets and ports 120 are gas outlets. Directional control valve 584 may be moved to a second position that directs gas through pneumatic motors 108 in a 'reverse direction' whereby ports 116 are gas outlets and ports 120 are gas inlets. In FIG. 29A, directional control valve 544 is shown in a first position that fluidly connects pneumatic motors 108 in series. In the example shown, gas inlet 116*b* is positioned downstream of gas outlet 120*a*. In FIG. 29B, directional control valve 544 is shown in a second position that fluidly connects pneumatic motors 108 in parallel whereby gas inlets 116*a* and 116*b* receive gas from gas source 104 in parallel; and gas outlets 120*a* and 120*b* discharge gas in parallel (e.g. to a condenser or vent to atmosphere).

In some embodiments, directional control valve 584 is manually operable (e.g. by hand). This can allow the user to toggle directional control valve 584 to toggle the rotation direction of engine drive shaft 112.

In some embodiments, second directional control valve 544 is manually operable (e.g. by hand), as shown. This can allow the user to toggle between a series fluid configuration, which may more efficiently convert fluid energy to mechanical power, and a parallel fluid configuration, which may produce greater mechanical power output (compared to the series configuration, all else being equal). In other embodiments, the position of second directional control valve 544 may be controlled by a flow controller 156 (FIG. 23) based on demand at engine drive shaft 112. For example, flow controller 156 (FIG. 23) may direct directional control valve 544 to provide a parallel fluid connection unless demand (e.g. torque, speed, or power) exceeds a predetermined value, in response to which flow controller 156 may toggle directional control valve 544 to provide a series fluid connection.

As shown, a gas valve 152*d* may be positioned upstream of trigger valve 152*a*. Gas valve 152*d* may be operable to limit gas flow through pneumatic motor assembly 404. In use, gas valve 152*d* may provide an upper limit to gas flow through pneumatic motor assembly 404 when trigger valve 152 is fully open. Accordingly, gas valve 152*d* may be used to control the torque output at drive shaft 112. In some embodiments, gas valve 152*d* may be movable between a plurality of positions (e.g. numerically numbered positions), each position corresponding with a different output torque.

Figure 30A:
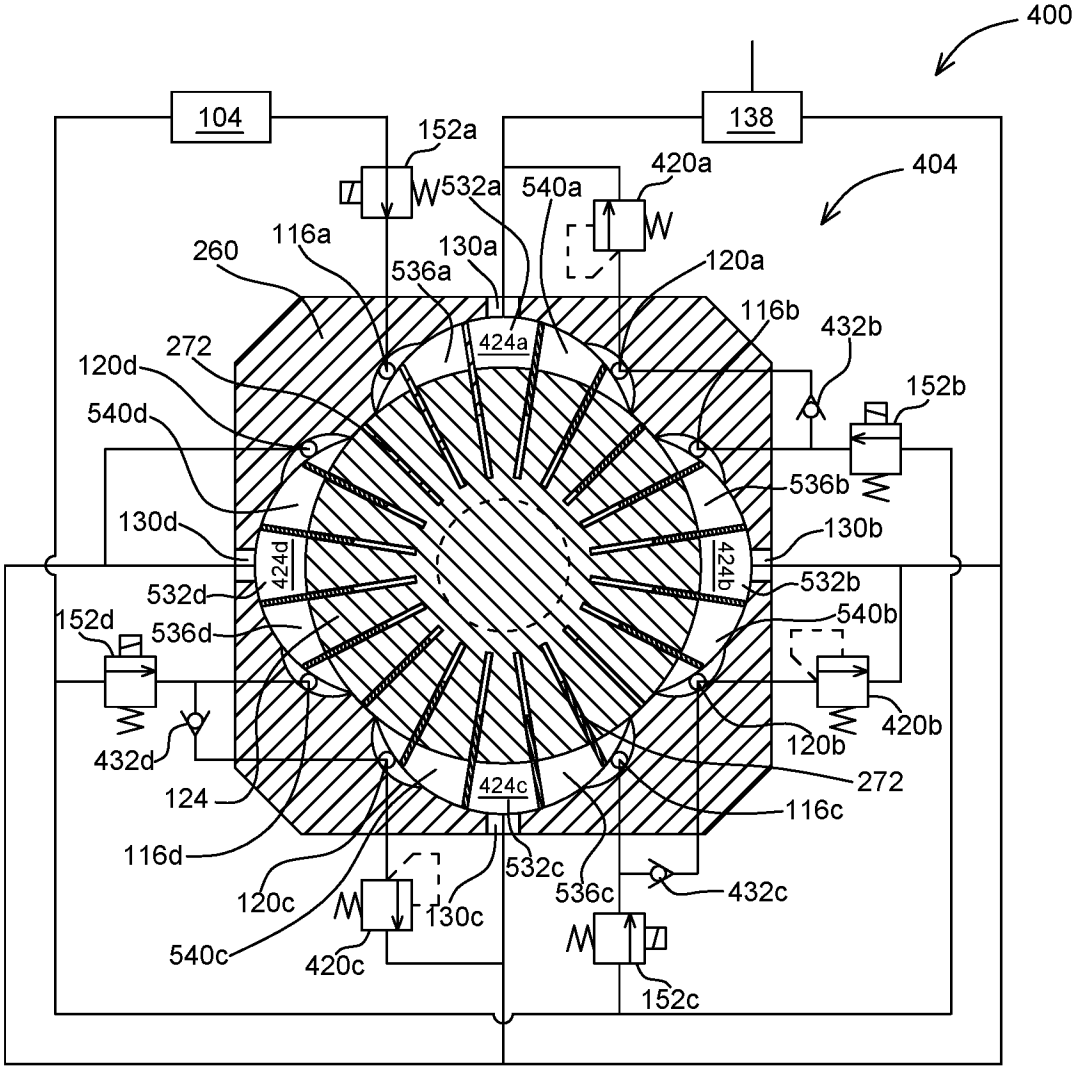
FIG. 30A is a schematic view of a pneumatic engine in accordance with an embodiment.

Reference is now made to FIG. 30A, which shows a pneumatic motor assembly 404 in accordance with another embodiment. Like part numbers refer to like parts in the previous figures. As shown, pneumatic motor assembly 404 may include a pneumatic motor 108 having a plurality of motor gas flow paths 532*a*-532*d*, each extending from a respective gas inlet 116 to a respective gas outlet 120. A further intermediate gas outlet 130 may be positioned between each pair of gas inlet and outlet 116, 120, as described above in connection with FIGS. 24A-24B. The flow energy of gas moving across each of the motor gas flow paths 532 is converted to mechanical energy which drives a common motor rotor 124 to rotate. Thus, pneumatic motor 108, which has a plurality of motor gas flow paths 532, may operate similar to a plurality of pneumatic motors 108 which each have a single gas flow path 532, except for example that pneumatic motor 108 drives a common motor rotor 124 instead of a plurality of motor rotors 124 which require gearing (or similar) to combine their outputs. In this way, pneumatic motor 108 may provide a simpler construction that may be more compact and require fewer parts.

The plurality of motor gas flow paths 532 may be arranged in parallel or in series, substantially as described above in connection with a plurality of pneumatic motors 108. The illustrated example shows motor gas flow paths 532 fluidly connected to each other and gas source 104 in the same manner as described above in connection with FIG. 24A-24B.

Pneumatic motor 108 can have any number of gas flow paths 532. For example, pneumatic motor 108 may include between 2 and 20 gas flow paths 532. In the illustrated example, pneumatic motor 108 includes four gas flow paths 532. For a given flow path volume, a larger diameter motor rotor 124 may support a greater number of flow paths 532. The plurality of gas flow paths 532 can have all the same volume as shown, or one or more (or all) of gas flow paths 532 can have a different volume. As shown, the plurality of gas flow paths 532 may be defined between a common motor rotor 124 and motor stator 260. Motor rotor 124 may include a plurality of vanes 272 that act to move gas across all of the gas flow paths 532 with each full revolution of motor rotor 124.

Figure 30B:
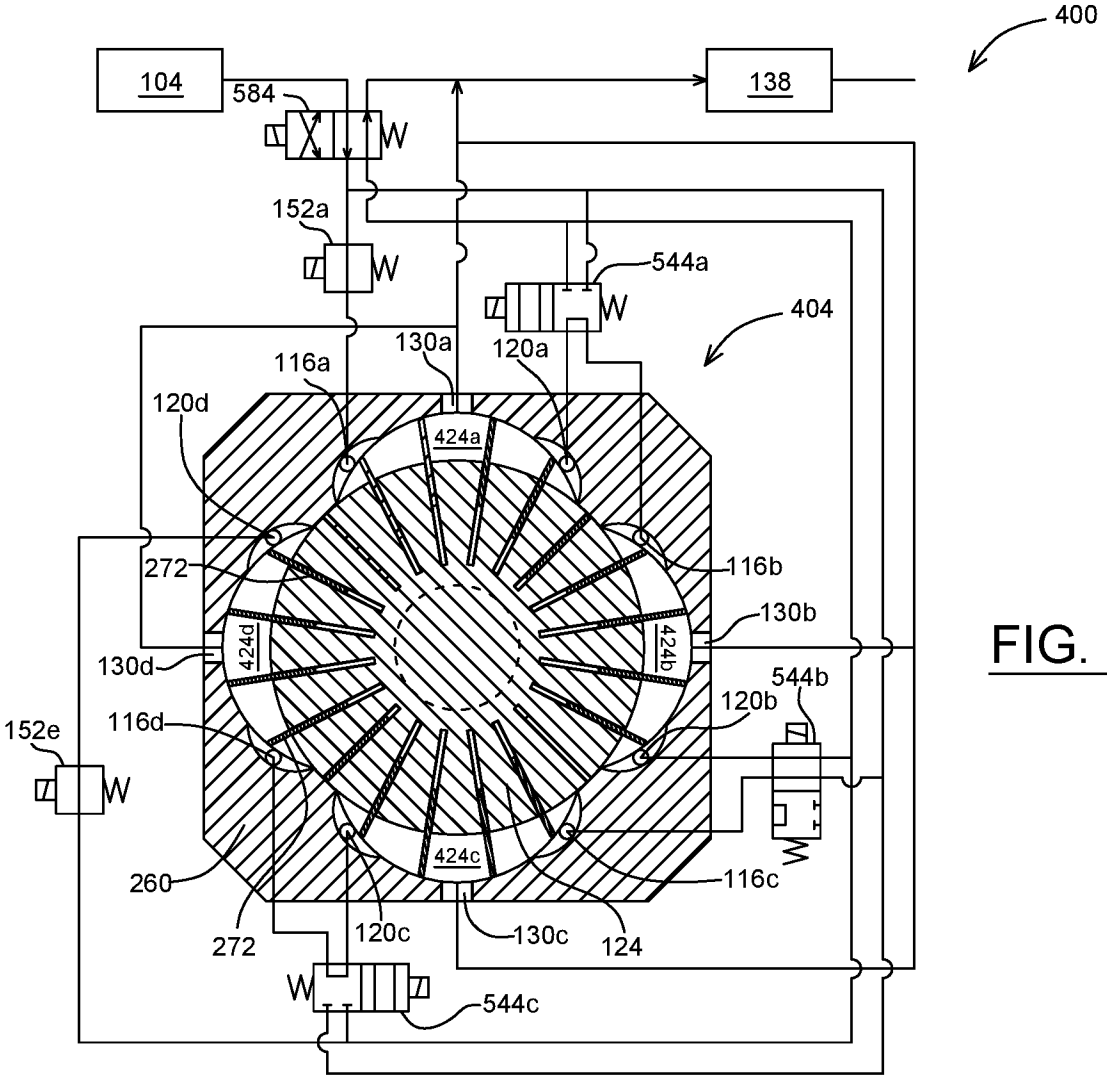
FIG. 30B is a schematic view of a pneumatic engine in accordance with an embodiment.

FIG. 30B shows a pneumatic engine 400 in accordance with another embodiment. Like part numbers refer to like parts in the other figures. Pneumatic engine 400 includes a pneumatic motor assembly 404 having a pneumatic motor 108 similar to pneumatic motor 108 of FIG. 30A. As shown, pneumatic motor 108 has a plurality of motor gas flow paths 532, which may operate similar to a plurality of pneumatic motors 108 which each have a single gas flow path 532, except for example that pneumatic motor 108 drives a common motor rotor 124 instead of a plurality of motor rotors 124 which require gearing (or similar) to combine their outputs. The inlets and outlets 116, 120, and 130 of the gas flow paths 532 may be fluidly connected within pneumatic motor assembly 404 similar to as described above in connection with FIGS. 26A-27B.

Figure 31:
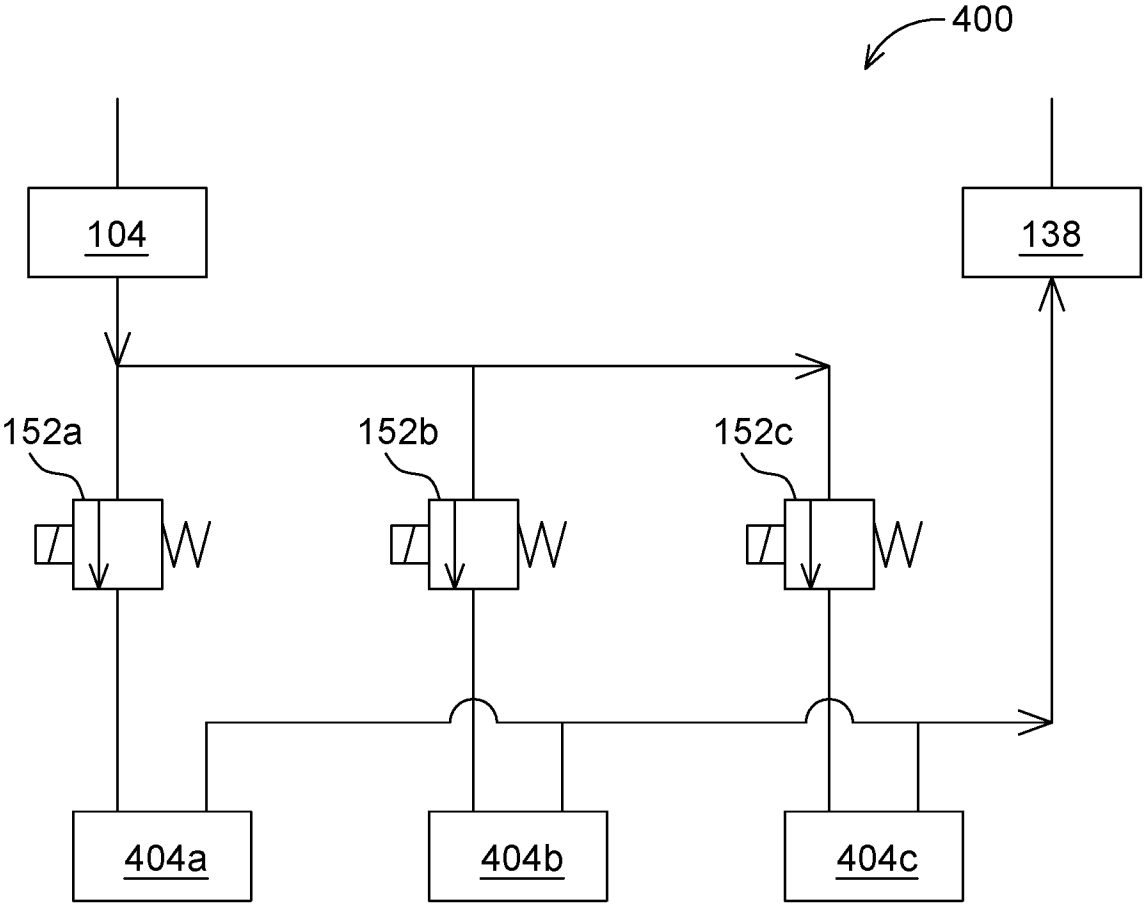
FIG. 31 is a schematic view of a pneumatic engine in accordance with an embodiment.

FIG. 31 shows a pneumatic engine 400, in accordance with another embodiment. As shown, pneumatic engine 400 includes a plurality of pneumatic motor assemblies 404 fluidly connected in parallel. The plurality of pneumatic motor assemblies 404 may provide mechanical power to a common drive shaft. Gas flow to each pneumatic motor assembly 404 may be controlled by a respective gas valve 152, which may allow pneumatic motor assemblies 404 to be independently activated, disabled, or throttled. As a result, pneumatic engine 400 may provide fine control over the collectively output power generated by pneumatic motor assemblies 404.

Figure 32A:
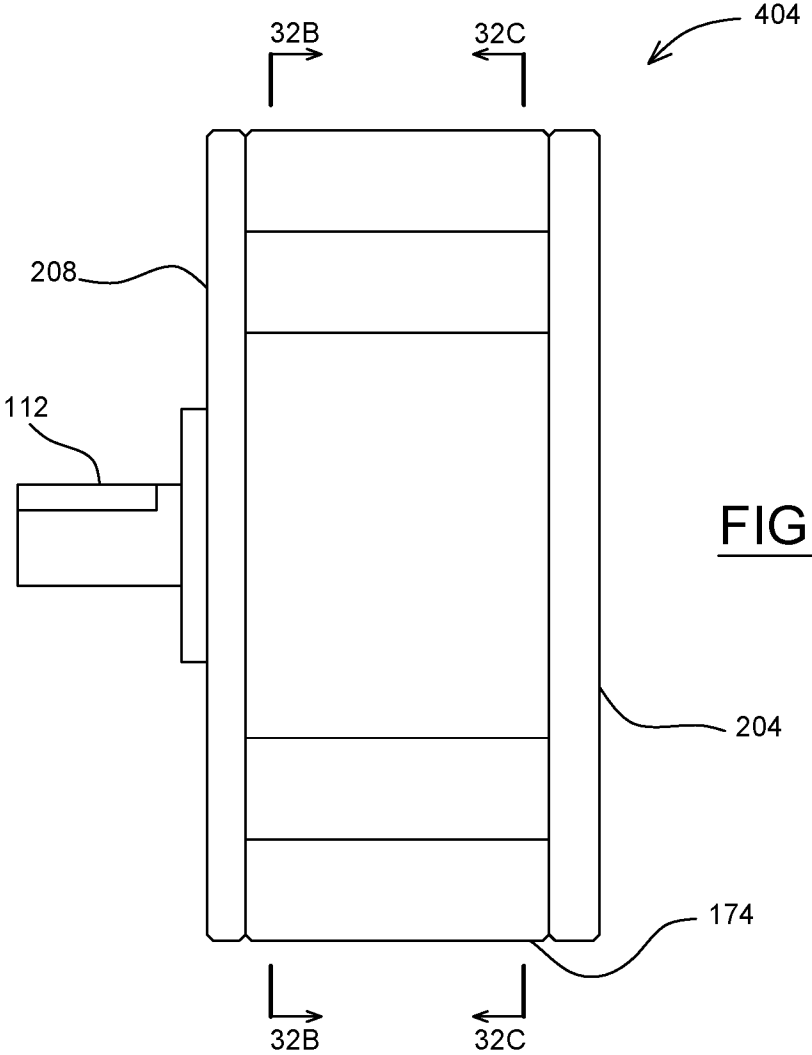
FIG. 32A is a side elevation view of a pneumatic motor assembly in accordance with an embodiment.
Figure 32B:
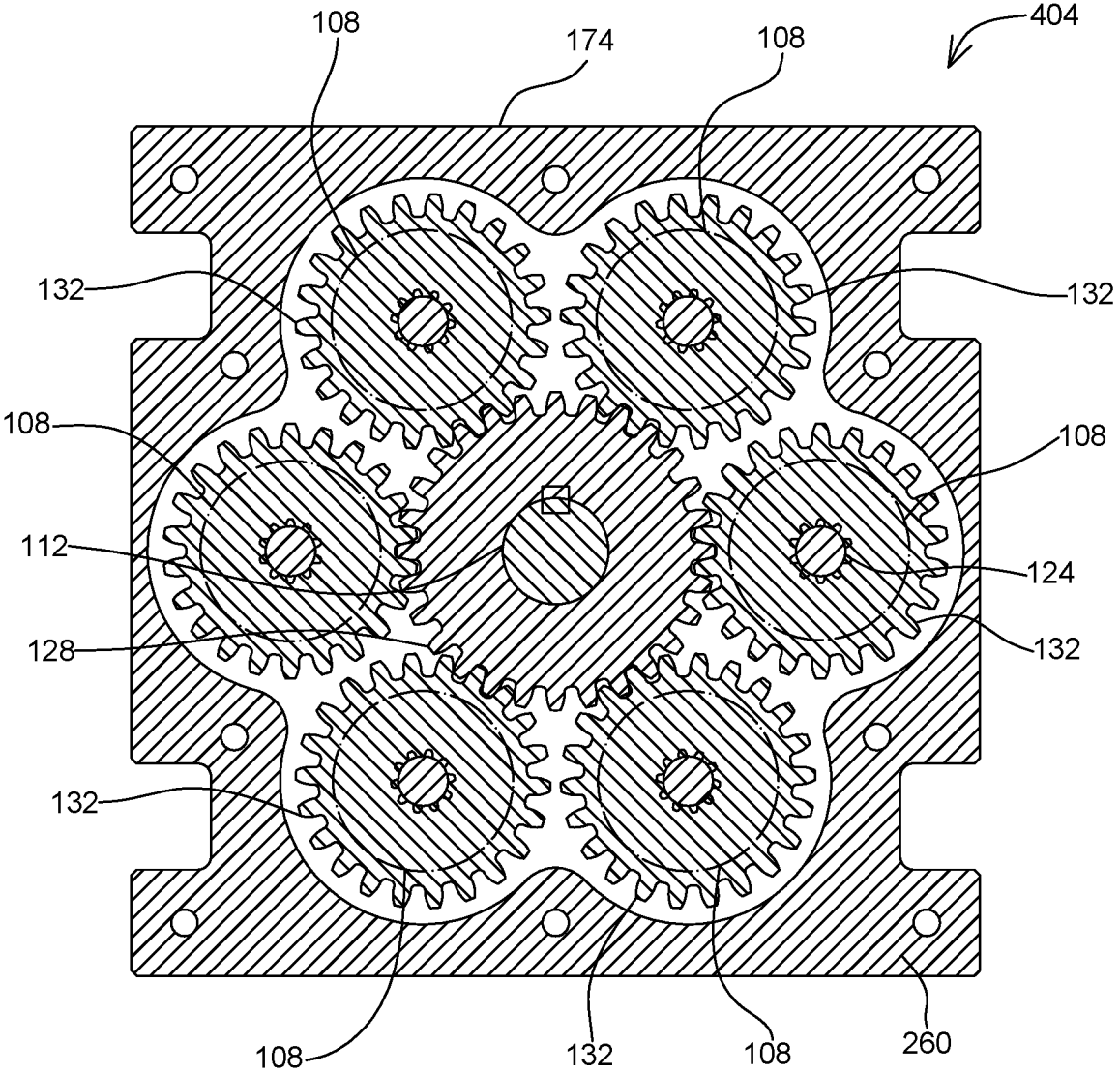
FIG. 32B is a cross-sectional view taken along line 32B-32B in FIG. 32A.
Figure 32C:
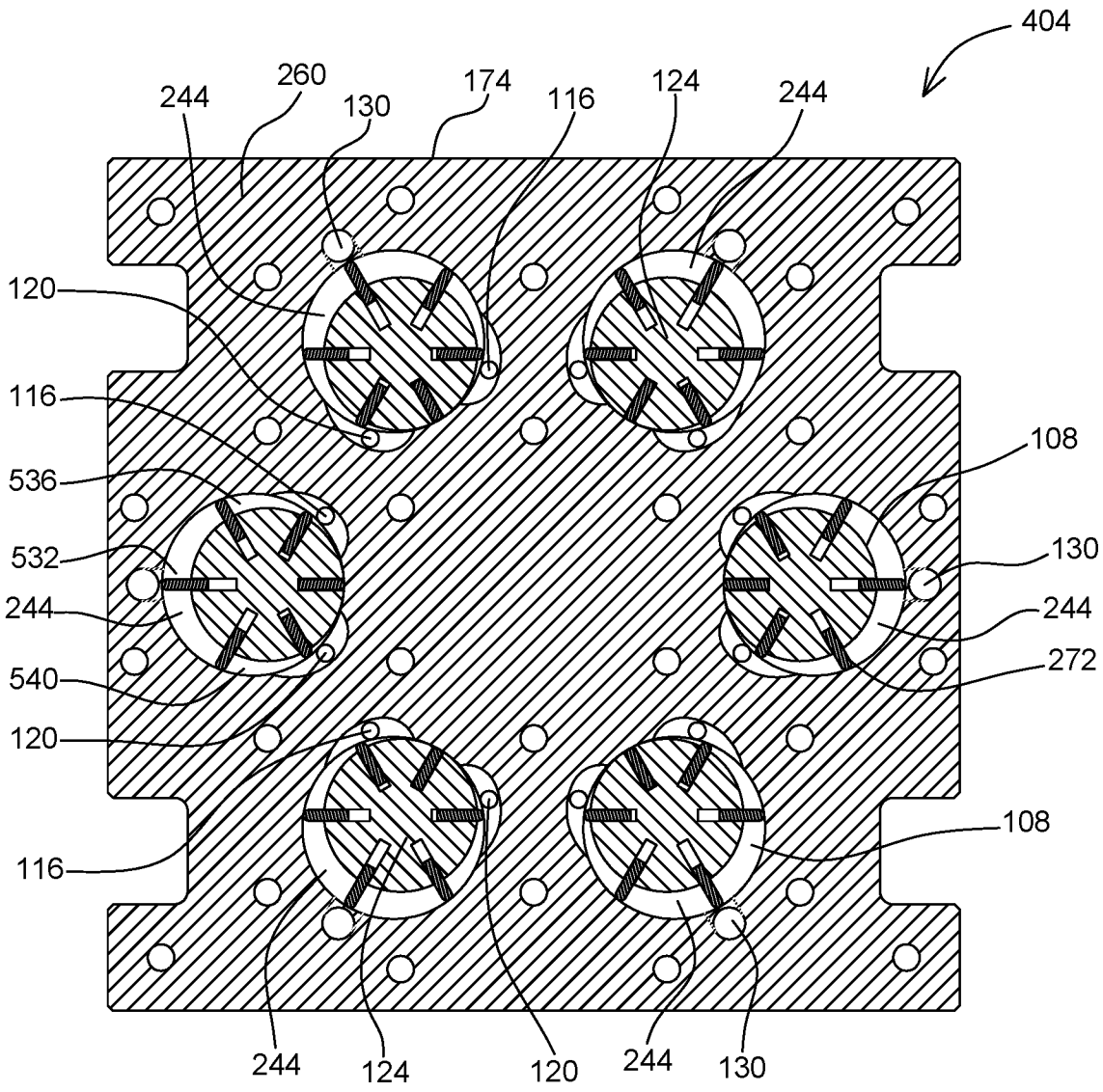
FIG. 32C is a cross-sectional view taken along line 32C-32C in FIG. 32A.

Reference is now made to FIGS. 32A-32C, which show a pneumatic motor assembly 404 in accordance with an embodiment. As shown, pneumatic motor assembly 404 may include a plurality of pneumatic motors 108 that collectively drive rotation of a drive shaft 112. Pneumatic motors 108 can be mechanically connected to drive shaft 112 in any manner that can transmit power output by the pneumatic motors 108 to drive shaft 112. In the example shown, each pneumatic motor 108 has a motor rotor 124 that rotates a rotor gear 132, and each rotor gear 132 is engaged with a drive gear 128 that rotates drive shaft 112.

As shown, the plurality of pneumatic motors 108 may be positioned in a common housing 174. In some embodiments, housing 174 may define the motor stator 260 of all the pneumatic motors 108. For example, the gas flow path 532 of each respective pneumatic motor 108 may be defined by motor stator 260 and a respective motor rotor 124. FIG. 32C illustrates that motor rotors 124 may be directly inserted (i.e. without sleeves) into a motor cavity 244 (e.g. bored hole) formed in a common housing 174. This may permit pneumatic motors 108 (and pneumatic motor assembly 404 as a whole) to operate with high-pressure gas flow.

In some embodiments, body 174 may include an end wall 208 and/or 204, which is removable to provide access to remove/insert components (e.g. motor rotor 124) of pneumatic motors 108 for inspection, cleaning, repair, or replacement.

Pneumatic motor assembly 404 may include any number of pneumatic motors 108. For example, pneumatic motor assembly 404 may include 2-100 pneumatic motors 108. In the illustrated example, pneumatic motor assembly 404 includes six pneumatic motors 108.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

ITEMS

Item 1. A pneumatic engine comprising:
- a plurality of pneumatic motors, each motor having a motor gas inlet, a motor gas outlet, and a rotor driven by gas flow between the motor gas inlet and the motor gas outlet; and
- an engine drive shaft drivingly coupled to the motor drive shaft of each of the pneumatic motors.

Item 2. The pneumatic engine of item 1, further comprising:
- a drive gear drivingly coupled to the draft shaft, and
- each of the rotors is connected to a respective rotor gear, wherein each rotor gear is engaged with the drive gear.

Item 3. The pneumatic engine of item 1, further comprising:
- an inlet manifold having a manifold gas inlet and a plurality of manifold gas outlets,
- each manifold gas outlet positioned downstream of the manifold gas inlet and upstream of the motor gas inlet of at least one of the pneumatic motors.

Item 4. The pneumatic engine of item 1, further comprising:
- an outlet manifold having a manifold gas outlet and a plurality of manifold gas inlets,
- each manifold gas inlet positioned upstream of the manifold gas outlet and downstream of the motor gas outlet of at least one of the pneumatic motors.

Item 5. The pneumatic engine of item 1, further comprising:
- a body having a plurality of motor cavities,
- wherein each of the pneumatic motors is removably positioned in one of the motor cavities.

Item 6. The pneumatic engine of item 5, wherein:
- each motor cavity has a rear opening sized for removal and insertion of one of the plurality of pneumatic motors, and
- the body further comprises a removable rear portion overlaying at least a portion of the rear opening of each of the motor cavities.

Item 7. The pneumatic engine of item 6, wherein:
- the removable rear engine cover comprises a manifold having at least one manifold gas inlet and at least one manifold gas outlet.

Item 8. The pneumatic engine of item 5, wherein:

the rotor of each pneumatic motor comprises a rotor shaft, and each motor cavity has a front wall comprising a rotor shaft opening that receives the rotor shaft of the rotor of the respective pneumatic motor.

Item 9. The pneumatic engine of item 8, wherein:

each rotor shaft is connected to a rotor gear, and the front wall of one of the motor cavities is positioned rearward of the respective rotor gear.

Item 10. The pneumatic engine of item 1, wherein:

the plurality of pneumatic motors includes at least a first pneumatic motor and a second pneumatic motor, and the motor gas outlet of the first pneumatic motor is positioned upstream of the motor gas inlet of the second pneumatic motor.

Item 11. The pneumatic engine of item 1, further comprising:

a flow controller operable to selectively restrict gas flow through a subset of the pneumatic motors.

Item 12. The pneumatic engine of item 11, further comprising:

a sensor positioned to measure at least one operating characteristic of the pneumatic engine and communicatively coupled to the flow controller, wherein the flow controller selectively restricts gas flow through a subset of the pneumatic motors based on readings from the sensor.

Item 13. The pneumatic engine of item 11, further comprising:

a control interface communicatively coupled to the flow controller and user operable to direct the flow controller to restrict gas flow through a subset of the pneumatic motors.

Item 14. The pneumatic engine of item 13, wherein:

the controller interface includes a control that is manually operable to select between at least a first and second operating mode, and the controller interface directs the flow controller to interrupt gas flow to a first subset of the pneumatic motors in the first operating mode, and the controller interface directs the flow controller to interrupt gas flow to a second subset of the pneumatic motors different from the first subset in the second operating mode.

Item 15. The pneumatic engine of item 11, wherein:

the flow controller is communicatively coupled to one or more valves positioned upstream of at least one of the pneumatic motors, and the flow controller is operable to direct the one or more valves to change a degree of gas flow restriction to the one or more of the pneumatic motors downstream of those one or more valves.

Item 16. The pneumatic engine of item 1, further comprising:

a condenser positioned downstream of the plurality of motors.

Item 17. The pneumatic engine of item 16, further comprising:

a low pressure reservoir positioned downstream of the condenser. Item 18. The pneumatic engine of item 1, further comprising:

a high pressure reservoir positioned upstream of the plurality of motors.

Item 19. The pneumatic engine of item 10, further comprising:

a expansion valve positioned downstream of the motor gas outlet of the first pneumatic motor and in parallel with the motor gas inlet of the second pneumatic motor.

Item 20. The pneumatic engine of item 19, wherein:

a capacity ratio of the first and second pneumatic motors is less than or equal to 1.

Item 21. The pneumatic engine of item 1, further comprising:

a first series motor stage including one or more of the pneumatic motors, and a second series motor stage including one or more of the pneumatic motors, the second series motor stage positioned downstream of the first series motor stage.

Item 22. The pneumatic engine of item 1, wherein:

a first series motor stage including two or more of the pneumatic motors positioned in parallel, and a second series motor stage including two or more of the pneumatic motors positioned in parallel, the second series motor stage positioned downstream of the first series motor stage;

Item 23. The pneumatic engine of item 21, further comprising:

one or more valves collectively operable to direct gas flow to the second series motor stage bypassing the first series motor stage.

Item 24. The pneumatic engine of item 21, further comprising:

a third series motor stage including one or more of the pneumatic motors, the third series motor stage positioned downstream of the first series motor stage, and one or more valves collectively movable between a first configuration in which the third series motor stage is downstream of the second series motor stage, and a second configuration in which the third series motor stage is in parallel with the second series motor stage.

Item 25. The pneumatic engine of item 24, wherein:

the one or more valves are passively gas pressure actuated, fluidly coupled to gas exhausted from the first series motor stage in both the first and second configurations.

Item 26. The pneumatic engine of item 22, further comprising:

an expansion valve positioned downstream of the first series motor stage and in parallel with the second series motor stage.

Item 27. The pneumatic engine of item 26, wherein:

a capacity ratio of the first and second series motor stages is less than 1.

Item 28. A method of operating a pneumatic engine, the method comprising:

receiving an input of gas flow at a plurality of pneumatic motors, and driving an output shaft using each of the plurality of pneumatic motors simultaneously.

Item 29. The method of item 28, further comprising:

restricting the gas flow directed to a subset of the plurality of pneumatic motors.

Item 30. The method of item 28, further comprising:

a flow controller restricting the gas flow directed to a subset of the plurality of pneumatic motors in response to receiving sensor data indicative of one or more operating characteristics of the pneumatic engine.

Item 31. The method of item 28, further comprising:

receiving an operating mode selection, and a flow controller restricting the gas flow directed to a subset of the plurality of pneumatic motors based on the selected operating mode.

Item 32. The method of item 28, further comprising:
heating the gas flow upstream of at least one of the pneumatic motors.

Item 33. A pneumatic tool comprising the pneumatic engine of any one of items 1-27.

Item 34. A vehicle comprising the pneumatic engine of any one of items 1-27.

Item 35. The vehicle of item 33, wherein the engine drive shaft is coupled to one or more wheels.

Item 36. A facility comprising the pneumatic engine of any one of items 1-27.

Item 37. The facility of item 36, wherein the engine drive shaft is coupled to an electrical generator.

Item 38. The facility of item 36 or 37, wherein an air heater is fluidly connected downstream of the plurality of pneumatic motors.

Item 39. The facility of any one of items 36-38, wherein a water heater is fluidly connected downstream of the plurality of pneumatic motors.

Item 40. A pneumatic engine comprising:
first and second pneumatic motors, each pneumatic motor having
a stator;
a rotor rotatably connected to the stator; and
a gas flow path defined at least in part by the stator and the rotor, the gas flow path extending from a gas inlet to a terminal gas outlet,
the gas flow path having an expansion portion extending between the gas inlet and an intermediate gas outlet, and a compression portion extending between the intermediate gas outlet and the terminal gas outlet,
the terminal gas outlet of the first pneumatic motor fluidly connected upstream of the gas inlet of the second pneumatic motor.

Item 41. The pneumatic motor of item 40, wherein:
the gas flow path expands in a downstream direction in the expansion portion; and
the gas flow path compresses in a downstream direction in the compression portion.

Item 42. The pneumatic motor of item 40, further comprising:
a plurality of vanes extending radially outwardly of the stator into the gas flow path.

Item 43. A pneumatic engine comprising:
first and second pneumatic motors, each pneumatic motor having a gas inlet and a gas outlet;
a gas flow path extending through both of the first and second pneumatic motors; and
a first gas valve movable between a first position and a second position to reconfigure flow through the first and second pneumatic motors in the gas flow path,
in the first position, the first and second pneumatic motors are fluidly connected in parallel, and
in the second position, the first and second pneumatic motors are fluidly connected in series.

Item 44. The pneumatic engine of item 43, further comprising:
a second gas valve movable between a first position and a second position to toggle between forward and reverse flow directions of the gas flow path through the first and second pneumatic motors.

45. The pneumatic engine of item 43, further comprising:
a third gas valve manually operable to selectively inhibit or allow gas flow through the gas flow path.

Item 46. A pneumatic tool comprising:
the pneumatic engine of item 43, and
a drive shaft drivingly connected to the first and second pneumatic motors.

Item 47. The pneumatic tool of item 46, further comprising:
a second gas valve manually movable between a first position and a second position to toggle between forward and reverse flow directions of the gas flow path through the first and second pneumatic motors, and thereby toggle between forward and reverse directions of the drive shaft.

Item 48. The pneumatic tool of item 46, further comprising:
a trigger coupled to a third gas valve that is movable to selectively inhibit or allow gas flow through the gas flow path.

Item 49. A pneumatic motor comprising:
a stator;
a rotor rotatably connected to the stator; and
a plurality of gas flow paths defined by the stator and the rotor, each gas flow path extending from a respective gas inlet to a respective terminal gas outlet.

Item 50. The pneumatic motor of item 49, wherein:
each gas flow path has an expansion portion extending between the respective gas inlet and a respective intermediate gas outlet, and a compression portion extending between the respective intermediate gas outlet and the respective terminal gas outlet.

Item 51. The pneumatic motor of item 49, wherein:
the plurality of gas flow paths are fluidly connected in series.

Item 52. The pneumatic motor of item 49, wherein:
the plurality of gas flow paths are fluidly connected in parallel.

The invention claimed is:

1. A pneumatic engine comprising:
first and second pneumatic motors, each pneumatic motor having
a stator;
a rotor rotatably connected to the stator, and rotatable in a rotation direction relative to the stator; and
a gas flow path defined at least in part by the stator and the rotor, the gas flow path extending from a first end to a second end, the first end having a gas inlet, and the second end having a terminal gas outlet, wherein the terminal gas outlet is the farthest outlet and/or inlet from the gas inlet in the rotation direction,
the gas flow path having an expansion portion extending between the gas inlet and an intermediate gas outlet, and a compression portion extending between the intermediate gas outlet and the terminal gas outlet,
the terminal gas outlet of the first pneumatic motor fluidly connected to the gas inlet of the second pneumatic motor.

2. The pneumatic motor of claim 1, wherein:
the gas flow path expands in a downstream direction in the expansion portion; and
the gas flow path compresses in a downstream direction in the compression portion.

3. The pneumatic motor of claim 1, further comprising:
a plurality of vanes extending radially outwardly of the stator into the gas flow path.

4. The pneumatic engine of claim 1, further comprising:
a first gas valve positioned downstream of the intermediate gas outlet of the first pneumatic motor to control gas flow exiting the intermediate gas outlet of the first pneumatic motor.

5. The pneumatic engine of claim 4, further comprising:
a second gas valve positioned downstream of the intermediate gas outlet of the second pneumatic motor to control gas flow exiting the intermediate gas outlet of the second pneumatic motor.

6. A pneumatic motor comprising:

a stator;

a rotor rotatably connected to the stator, and rotatable in a rotation direction relative to the stator; and a plurality of gas flow paths defined by the stator and the rotor, each gas flow path extending in the rotation direction from a respective gas inlet to a respective terminal gas outlet, wherein the gas inlet and terminal gas outlet of each gas flow path of the plurality of gas flow paths is different from the gas inlet and terminal gas outlet of each other gas flow path of the plurality of gas flow paths;

wherein the plurality of gas flow paths are fluidly connected in series.

7. The pneumatic motor of claim 6, wherein:

each gas flow path has an expansion portion extending between the respective gas inlet and a respective intermediate gas outlet, and a compression portion extending between the respective intermediate gas outlet and the respective terminal gas outlet.

* * * * *